US011848499B2

(12) United States Patent
Chan et al.

(10) Patent No.: US 11,848,499 B2
(45) Date of Patent: Dec. 19, 2023

(54) ON-CHIP ANTENNA AND ON-CHIP ANTENNA ARRAY

(71) Applicant: City University, Kowloon (HK)

(72) Inventors: Chi Hou Chan, Kowloon (HK); Shang Cheng Kong, Kowloon (HK); Kam Man Shum, Kowloon (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 0 days.

(21) Appl. No.: 17/333,231

(22) Filed: May 28, 2021

(65) Prior Publication Data

US 2021/0376482 A1 Dec. 2, 2021

Related U.S. Application Data

(60) Provisional application No. 63/031,727, filed on May 29, 2020.

(51) Int. Cl.

| | |
|---|---|
| ***H01Q 21/00*** | (2006.01) |
| ***H01Q 21/06*** | (2006.01) |
| ***H01Q 9/28*** | (2006.01) |
| ***H01Q 1/22*** | (2006.01) |
| ***H01Q 9/04*** | (2006.01) |

(52) U.S. Cl.

CPC ..... *H01Q 21/0025* (2013.01); *H01Q 1/2283* (2013.01); *H01Q 9/0457* (2013.01); *H01Q 9/0485* (2013.01); *H01Q 9/285* (2013.01); *H01Q 21/062* (2013.01)

(58) Field of Classification Search

CPC ..... H01Q 1/38; H01Q 1/2283; H01Q 1/2225; H01Q 1/36; H01Q 7/00; H01Q 1/2266; H01Q 9/045; H01Q 9/285; H01Q 9/0485; H01Q 13/08; H01Q 9/0457; H01Q 13/10; H01Q 5/50; H01Q 21/08; H01Q 13/18; H01Q 3/24; H01Q 13/106; H01Q 21/065; H01Q 21/24; H01Q 21/062; H01Q 9/28; H01Q 1/50; H01Q 1/48; H01Q 1/24; H01Q 1/364; H01Q 5/25; H01Q 9/0414; H01Q 1/2208; H01Q 9/26; H01Q 21/28; H01Q 9/0407

See application file for complete search history.

(56) References Cited

U.S. PATENT DOCUMENTS

| | | | | |
|---|---|---|---|---|
| 6,552,693 | B1 * | 4/2003 | Leisten | H01Q 1/242 343/702 |
| 10,581,177 | B2 * | 3/2020 | Isom | H01P 5/227 |
| 10,615,134 | B2 * | 4/2020 | Spella | H01Q 19/28 |
| 2021/0376479 | A1 * | 12/2021 | Chan | H01Q 21/062 |
| 2021/0399427 | A1 * | 12/2021 | Hu | H01Q 21/0075 |

* cited by examiner

*Primary Examiner* — Vibol Tan

(57) ABSTRACT

An on-chip antenna comprising an electrically insulating substrate having first and second faces; a metal layer arranged on the second face; and, a dipole antenna structure arranged on the first face, the dipole antenna structure comprising a dipole antenna and a feed structure connected to the dipole antenna; the on-chip antenna being configured such that when the feed structure is fed with an electrical signal it operates simultaneously in (i) at least one dielectric resonator mode to function as a dielectric resonance antenna, and (ii) at least one dipole mode to function as a cavity backed dipole antenna.

20 Claims, 70 Drawing Sheets

Table I Dimensions of the 320 GHz on-chip antenna (Unit: μm)

| Paramet | *h_si* | *w_slot* | *l_slot* | *d_slot* | *x*0 | *y*0 | *y*1 | *r* |
|---|---|---|---|---|---|---|---|---|
| Value | 190 | 10 | 150 | 50 | 15 | 26 | 30 | 185 |
| Paramet | *deg*1 | *w*_CPW | *l*_CPW | *w*1 | *w*2 | *g*1 | *g*2 | |
| Value | 40deg | 60 | 220 | 10 | 5 | 8 | 6 | |

Figure 4A:
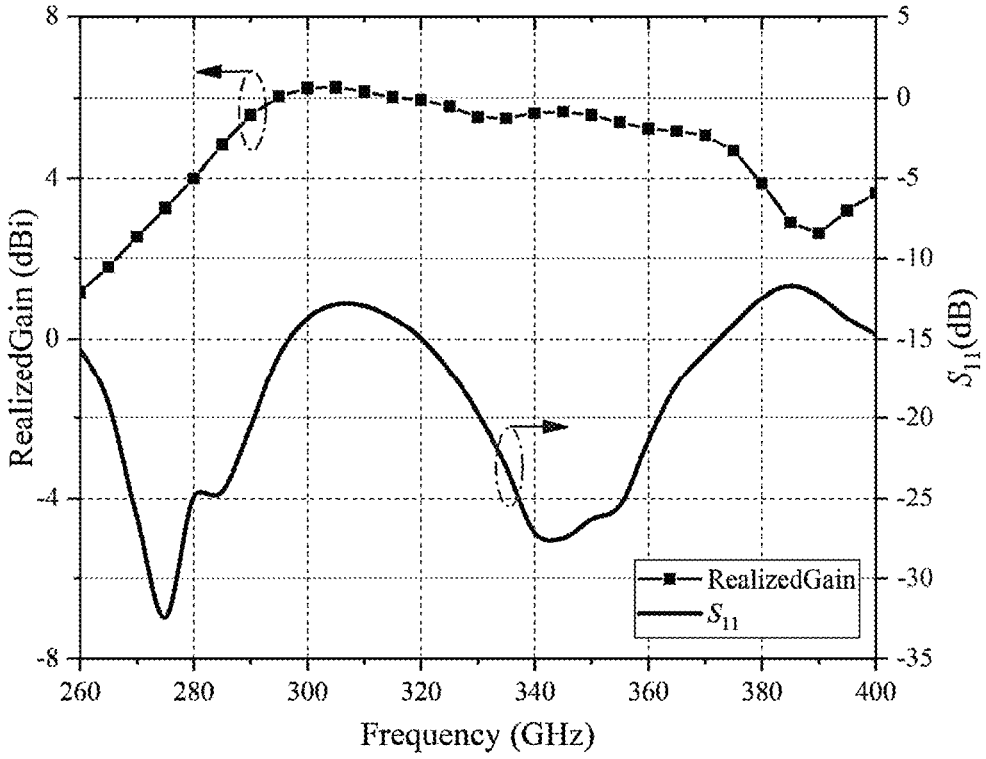
Figure 4B:
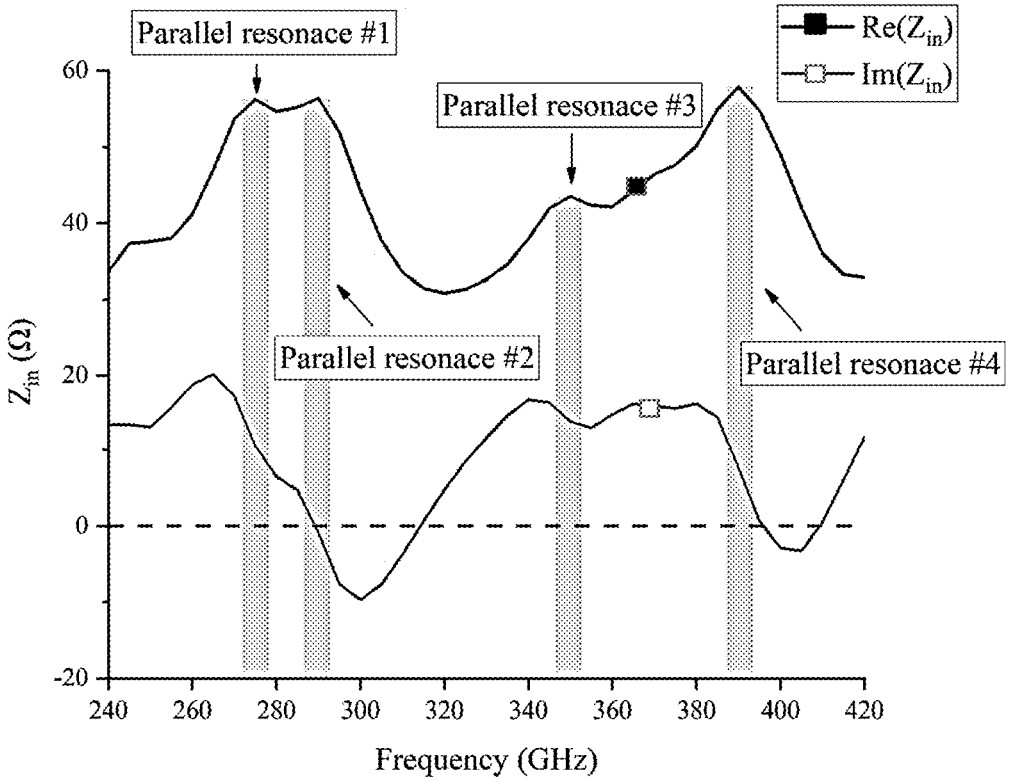
Figure 4C:
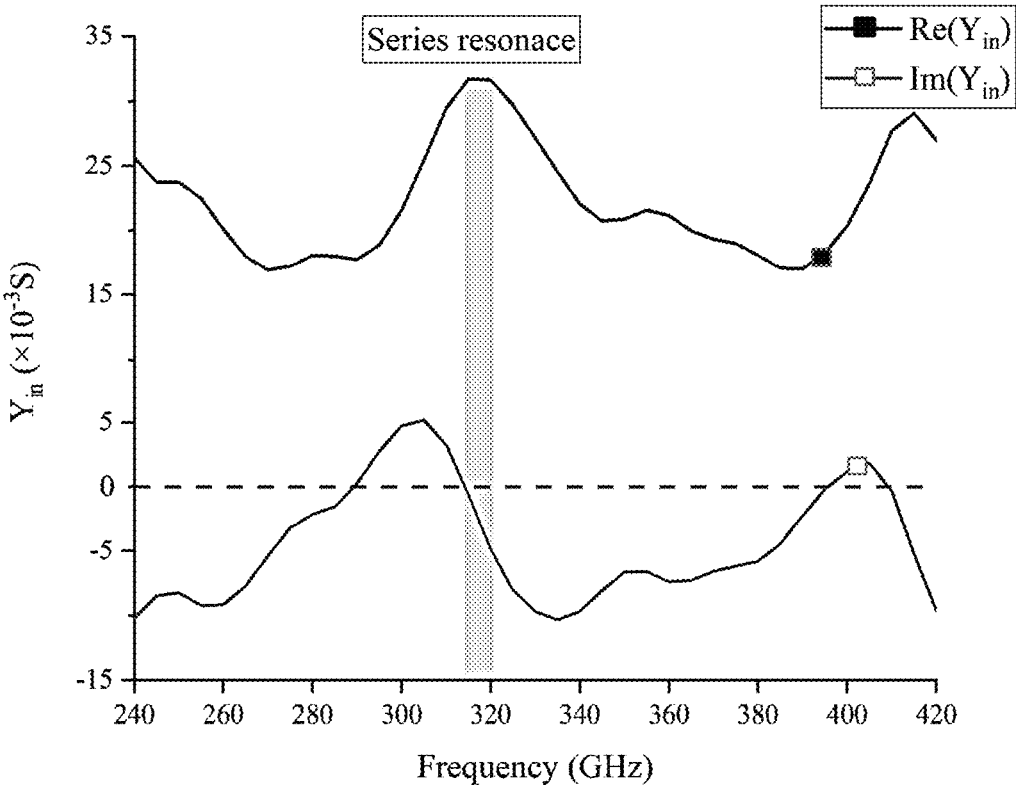
Figure 4D:
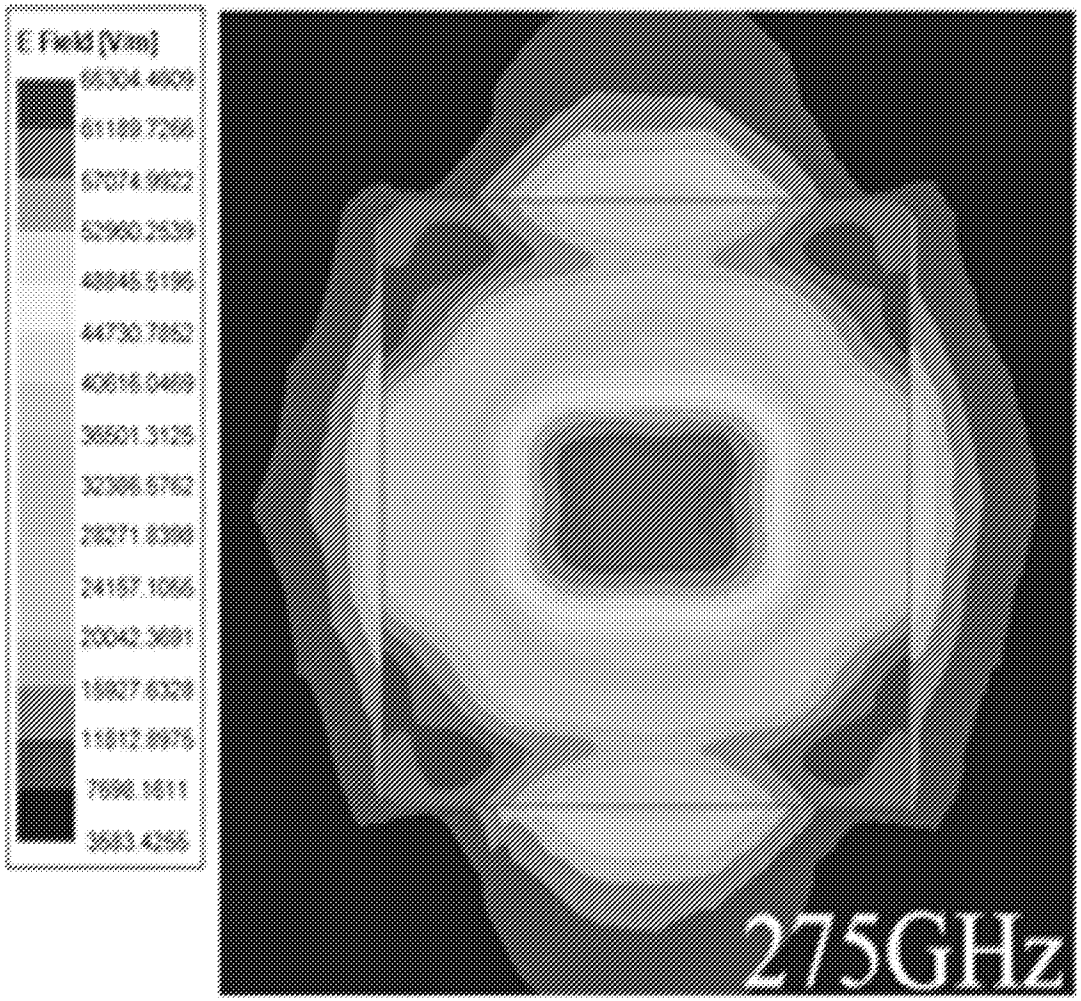
Figure 4D:
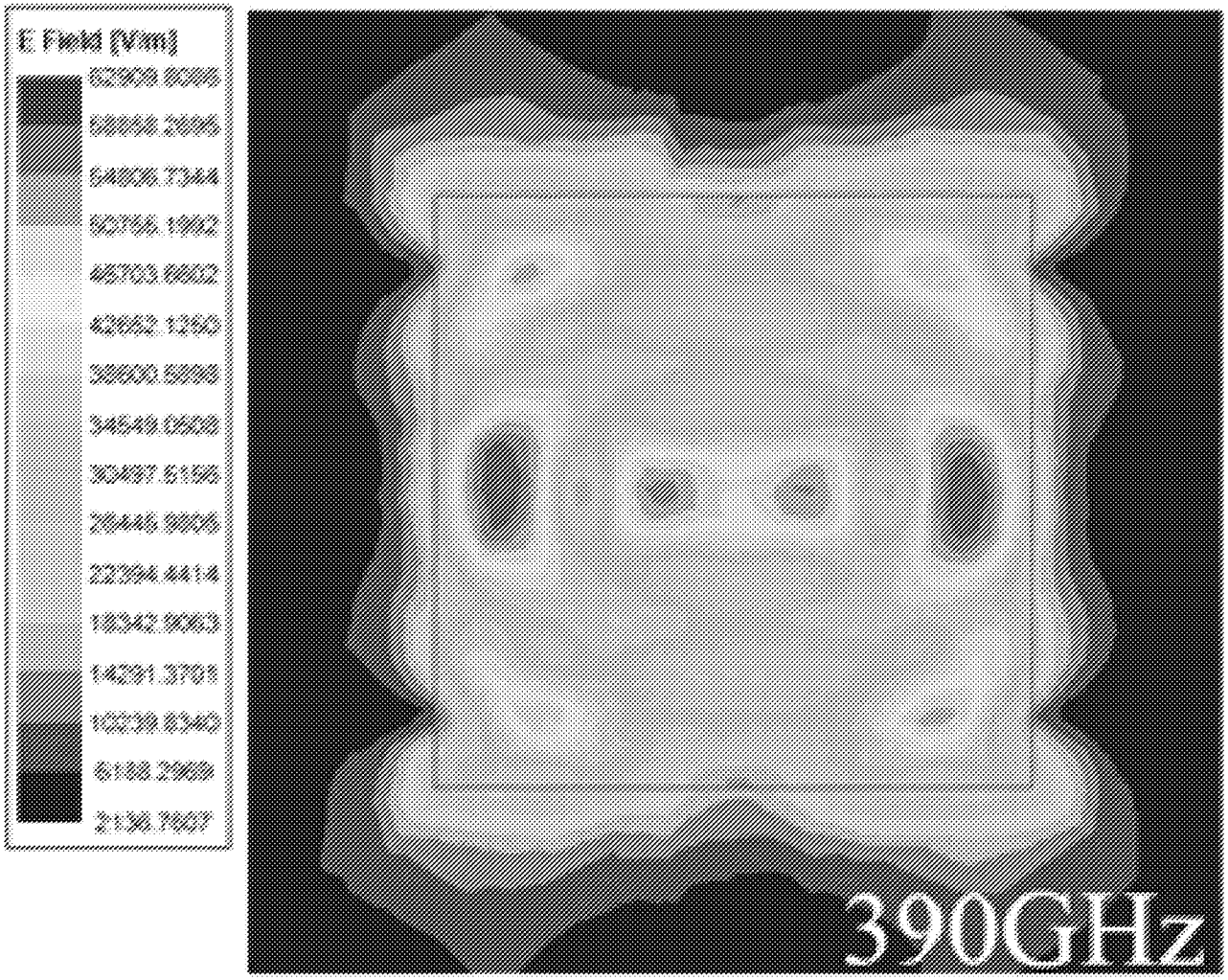

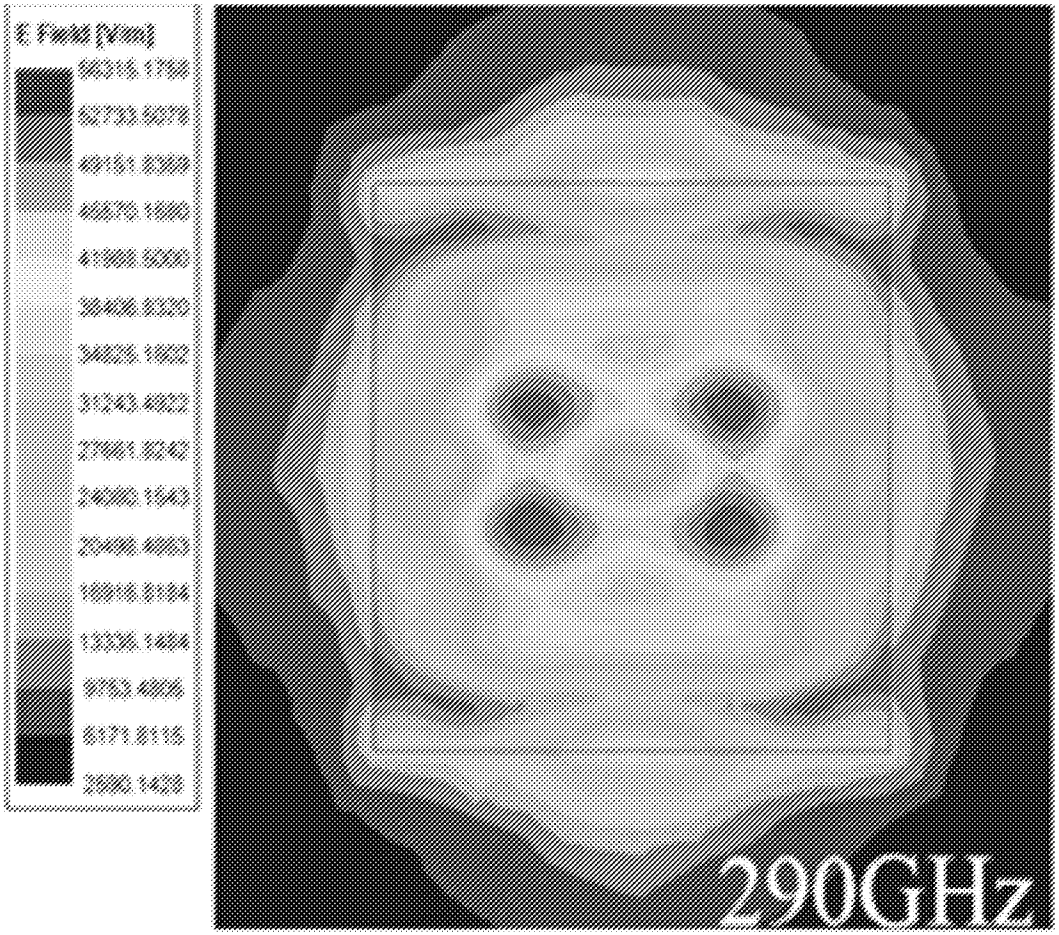
Figure 4d(ii)

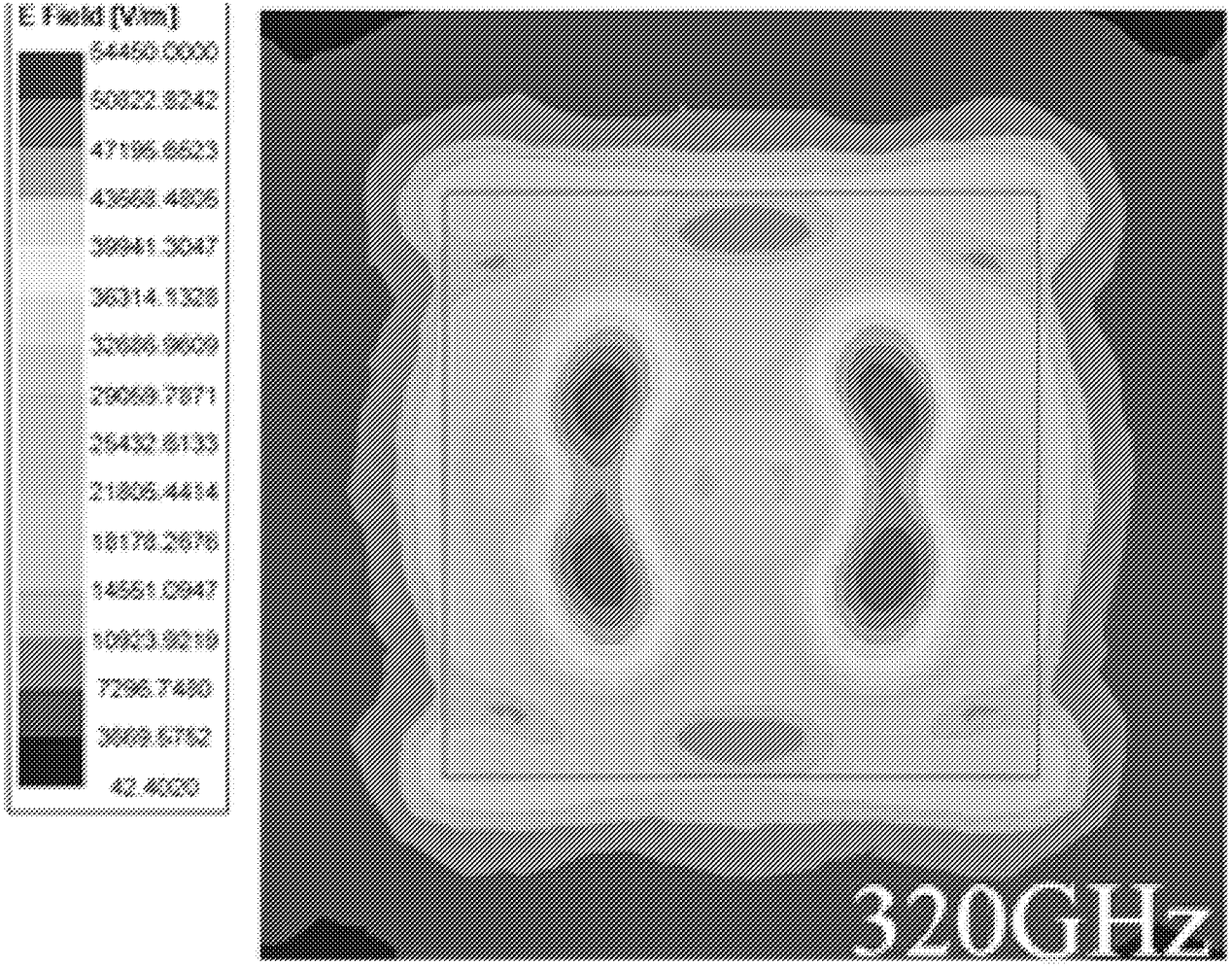
Figure 4d(iii)

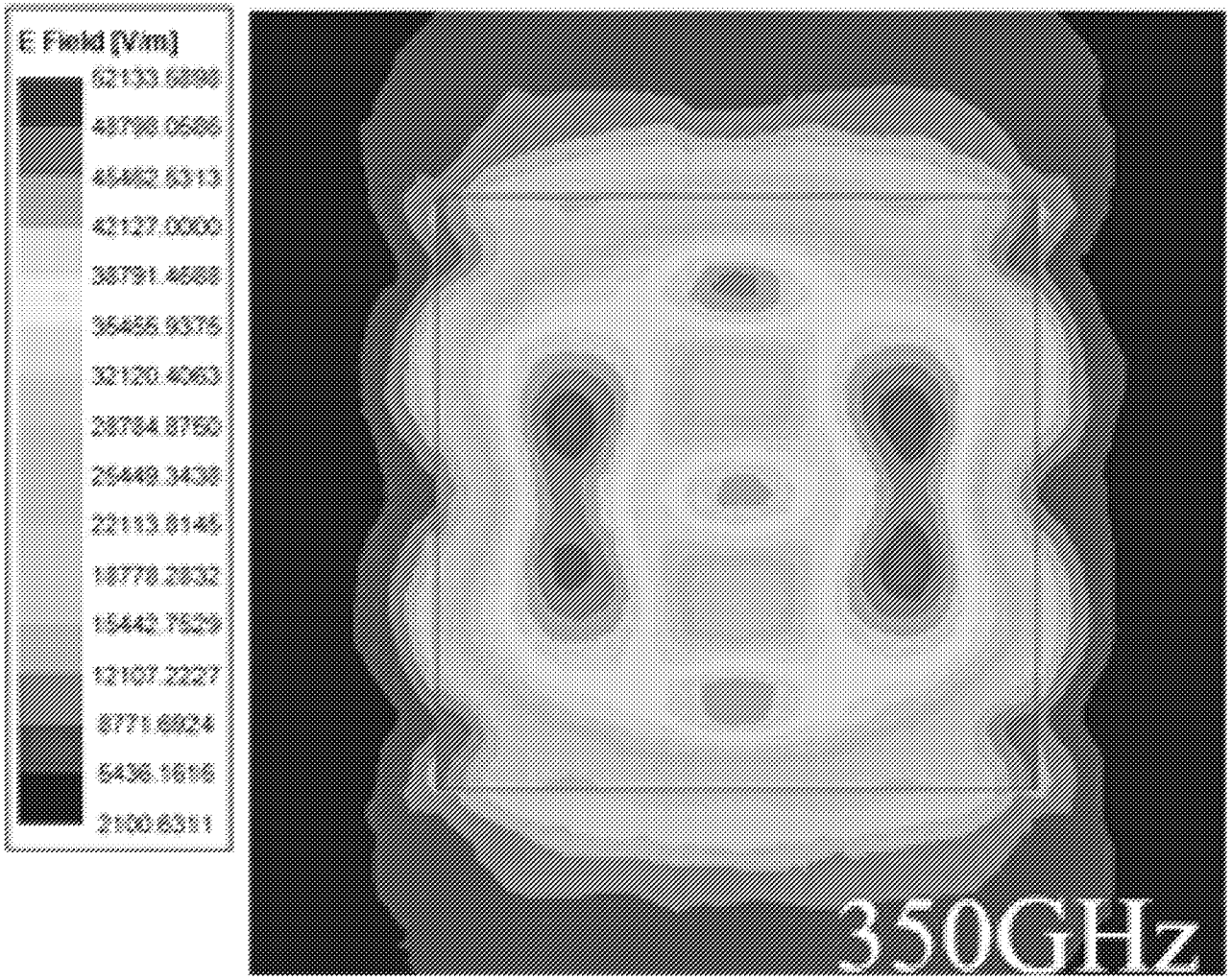
Figure 4d(iv)

Figure 4E:
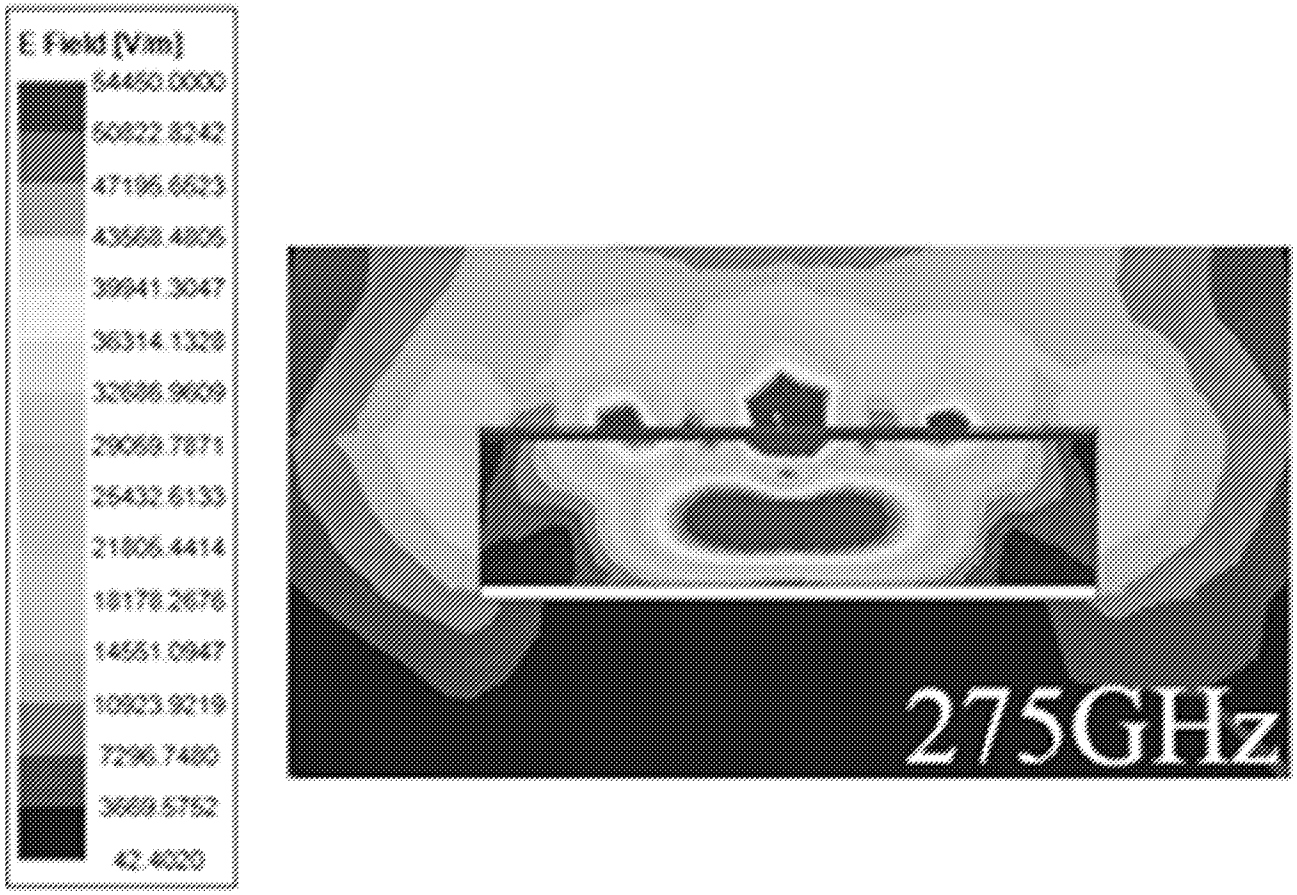
Figure 4E:
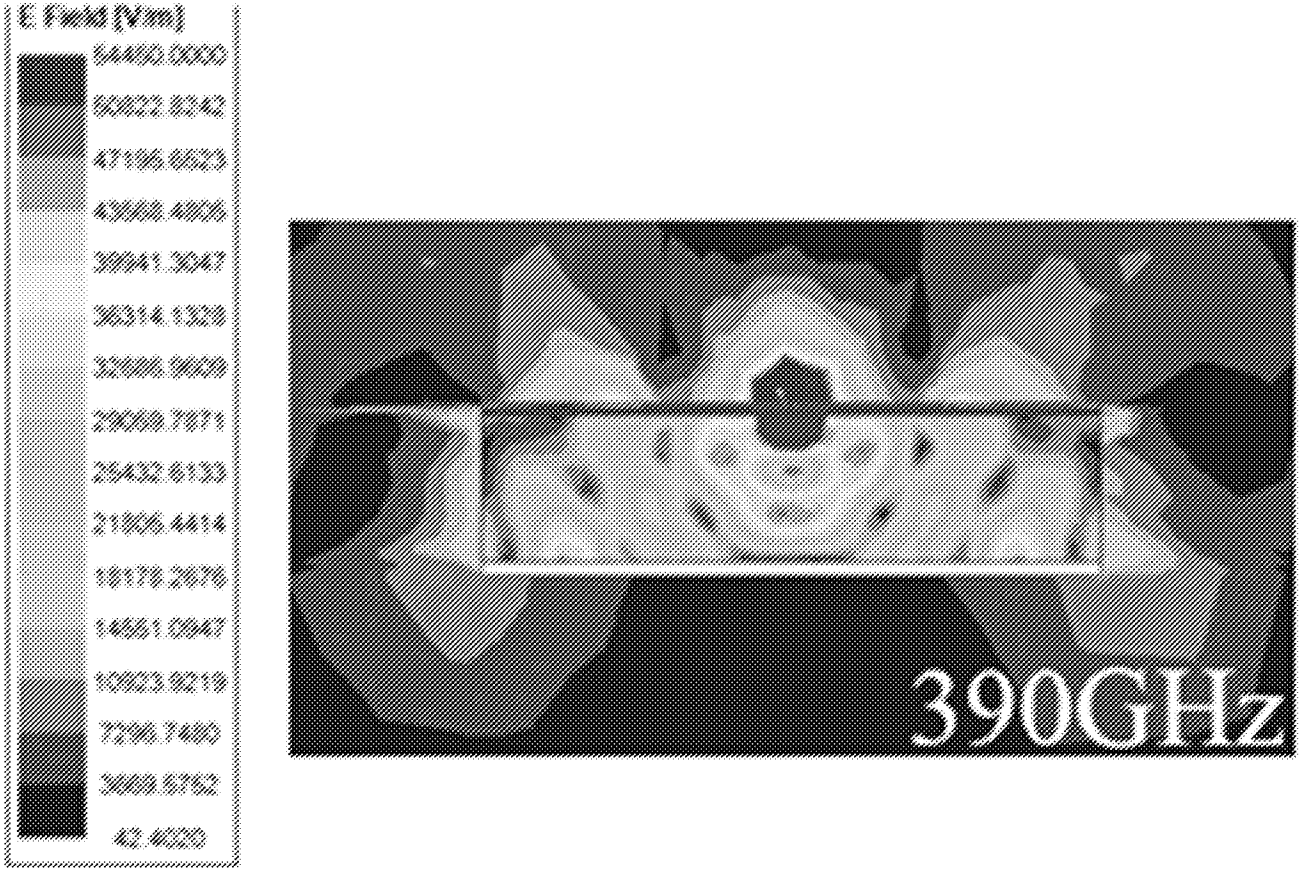

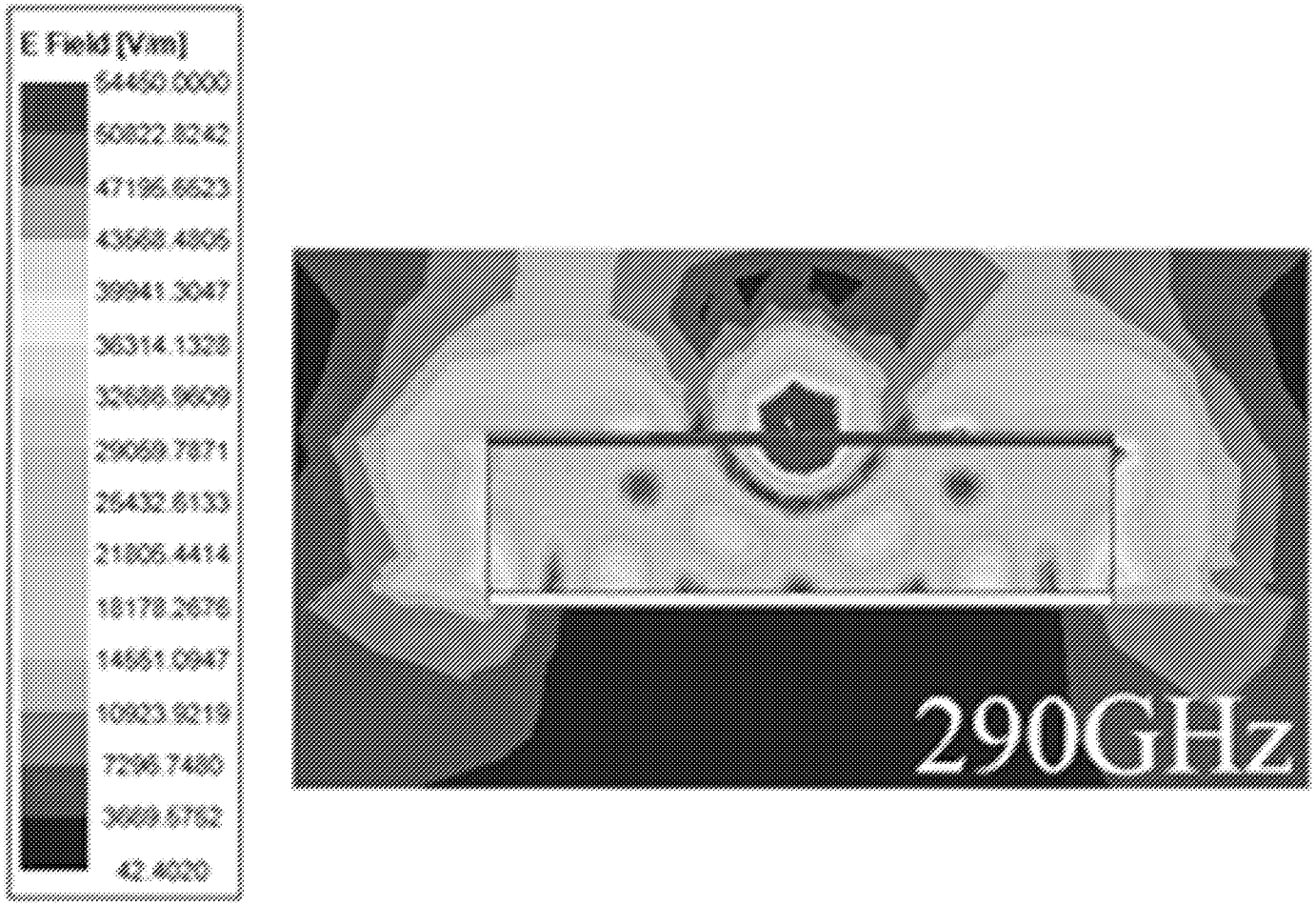
Figure 4e (ii)

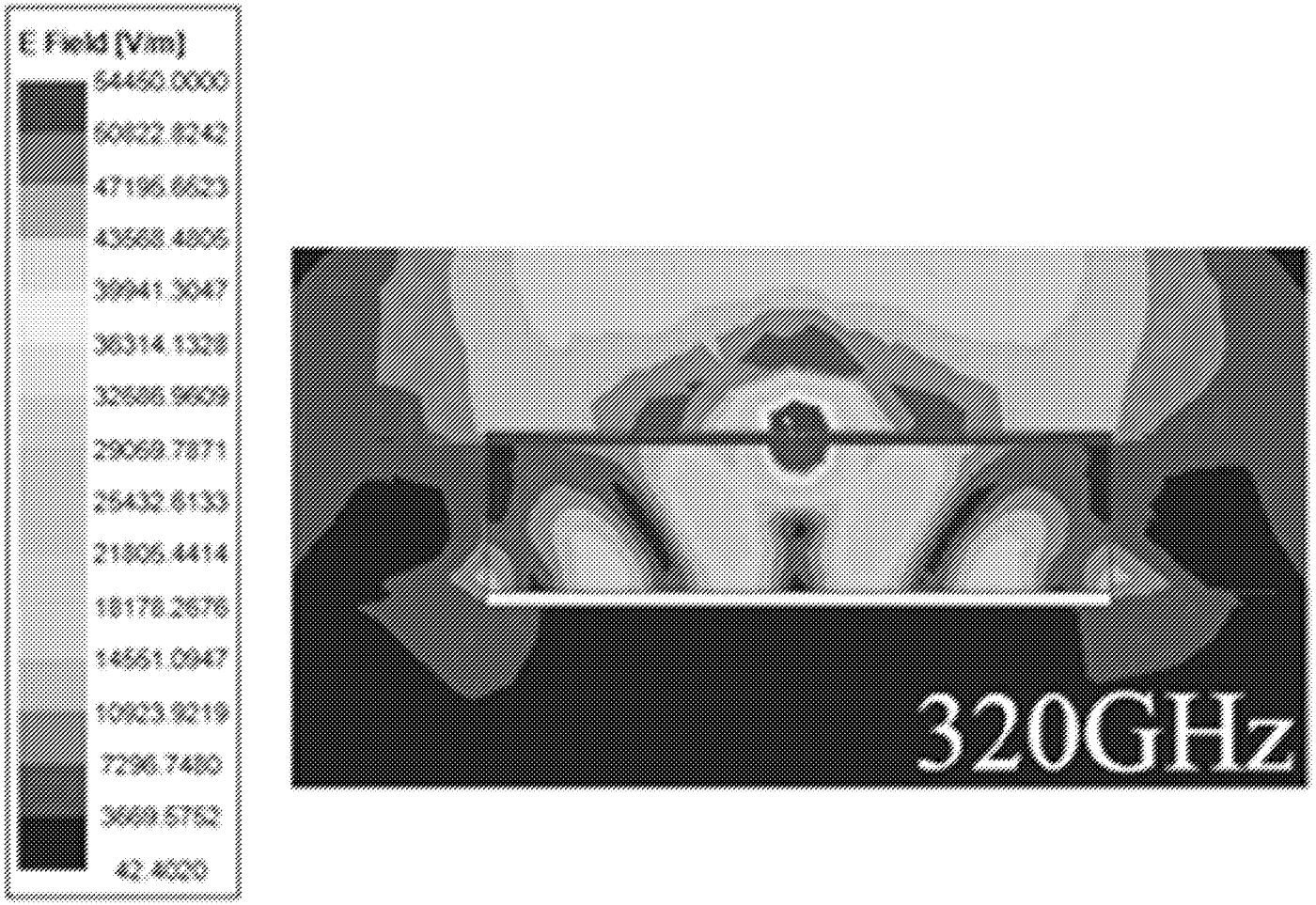
Figure 4e (iii)

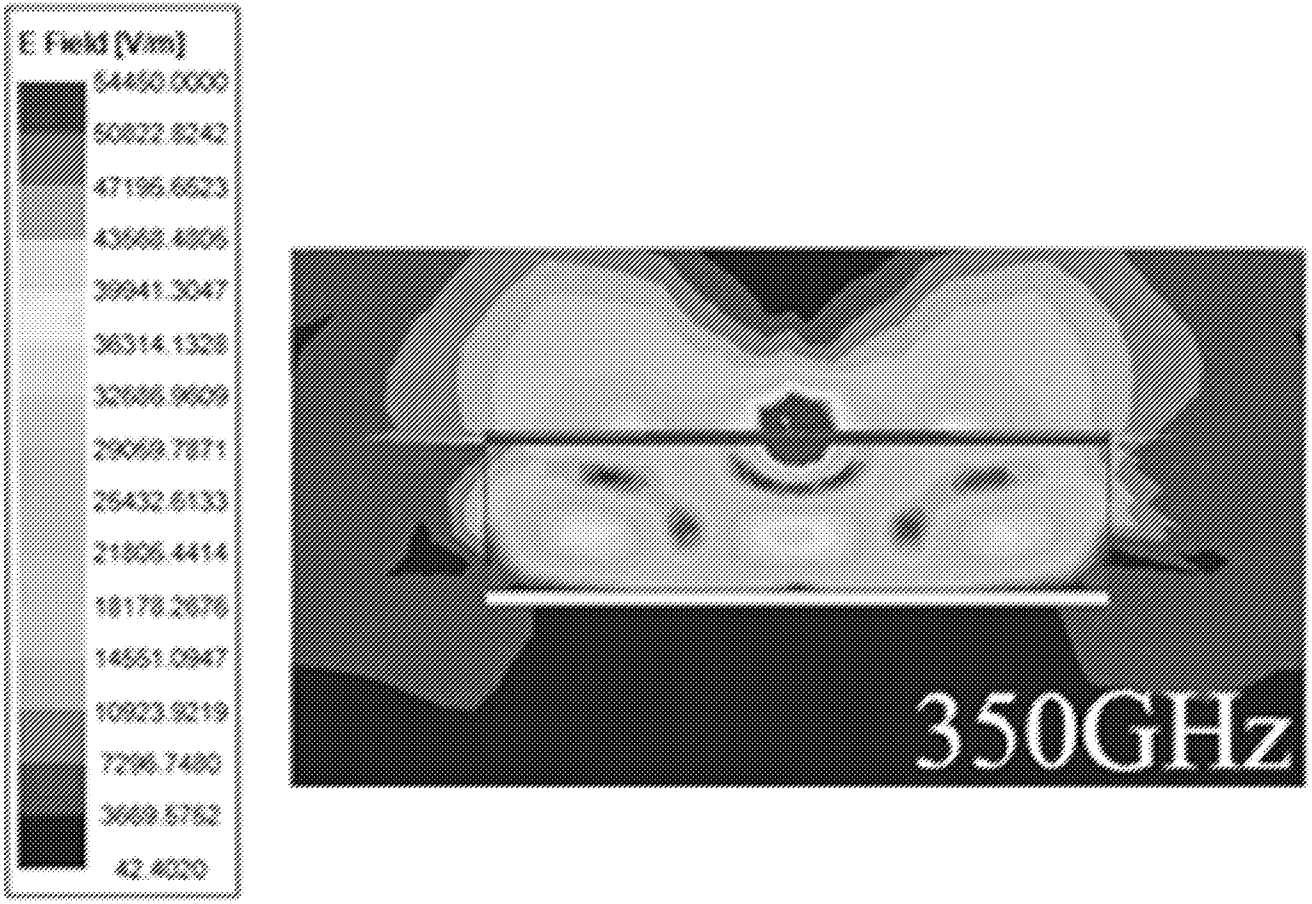
Figure 4e (iv)

Figure 4F:
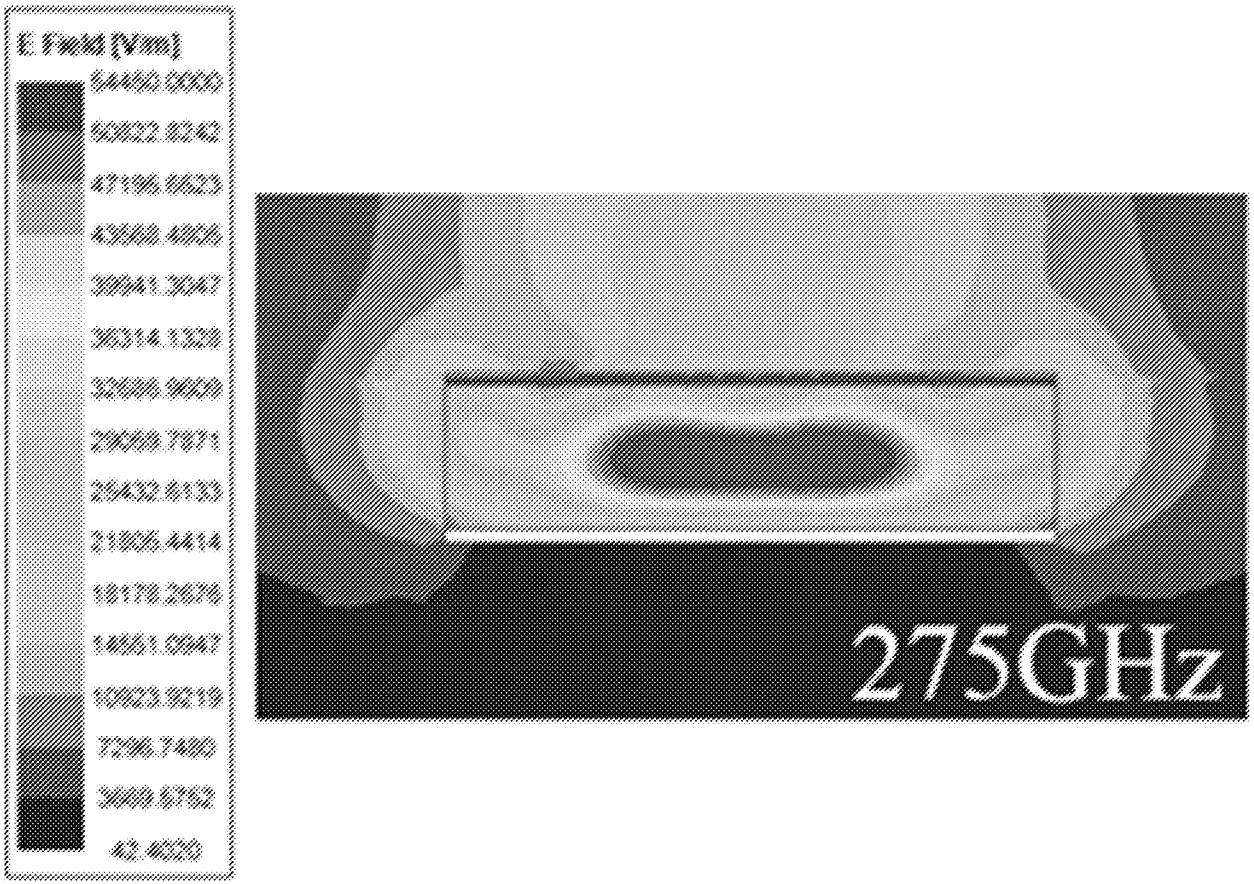
Figure 4F:
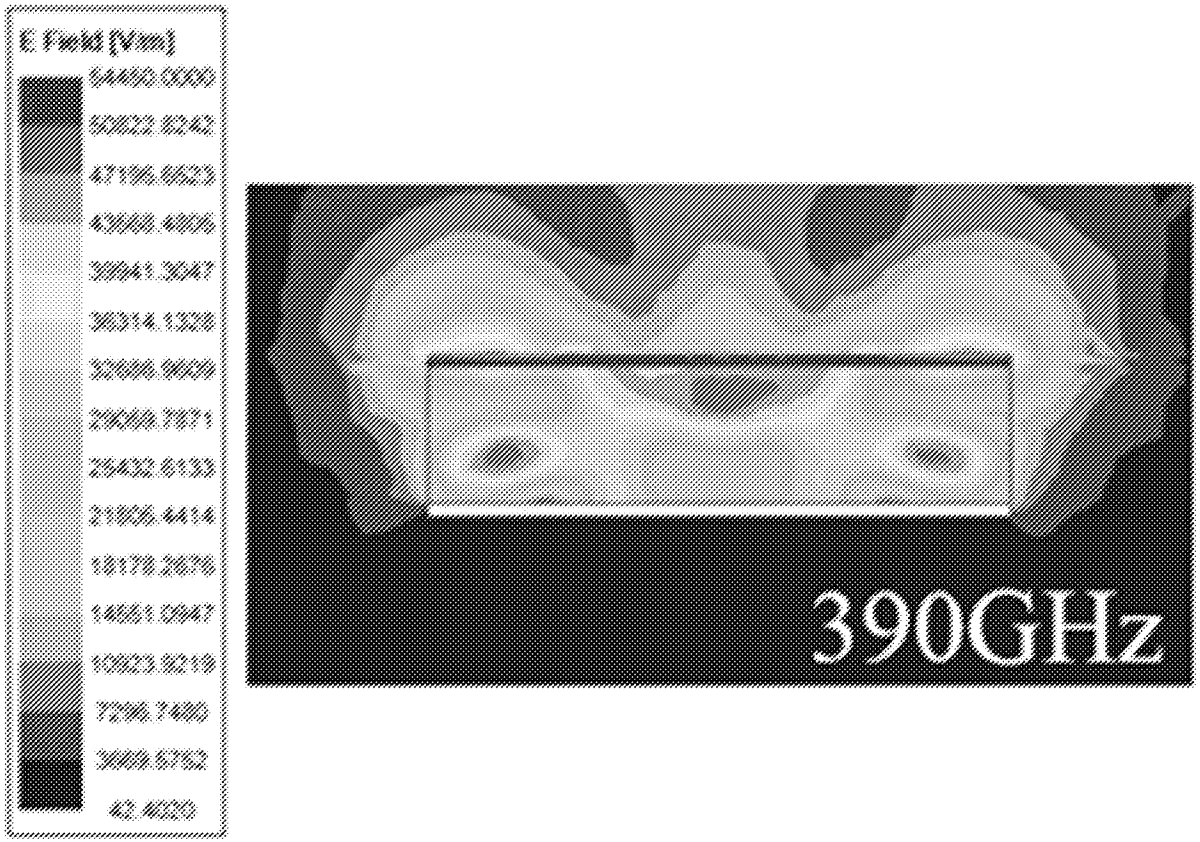

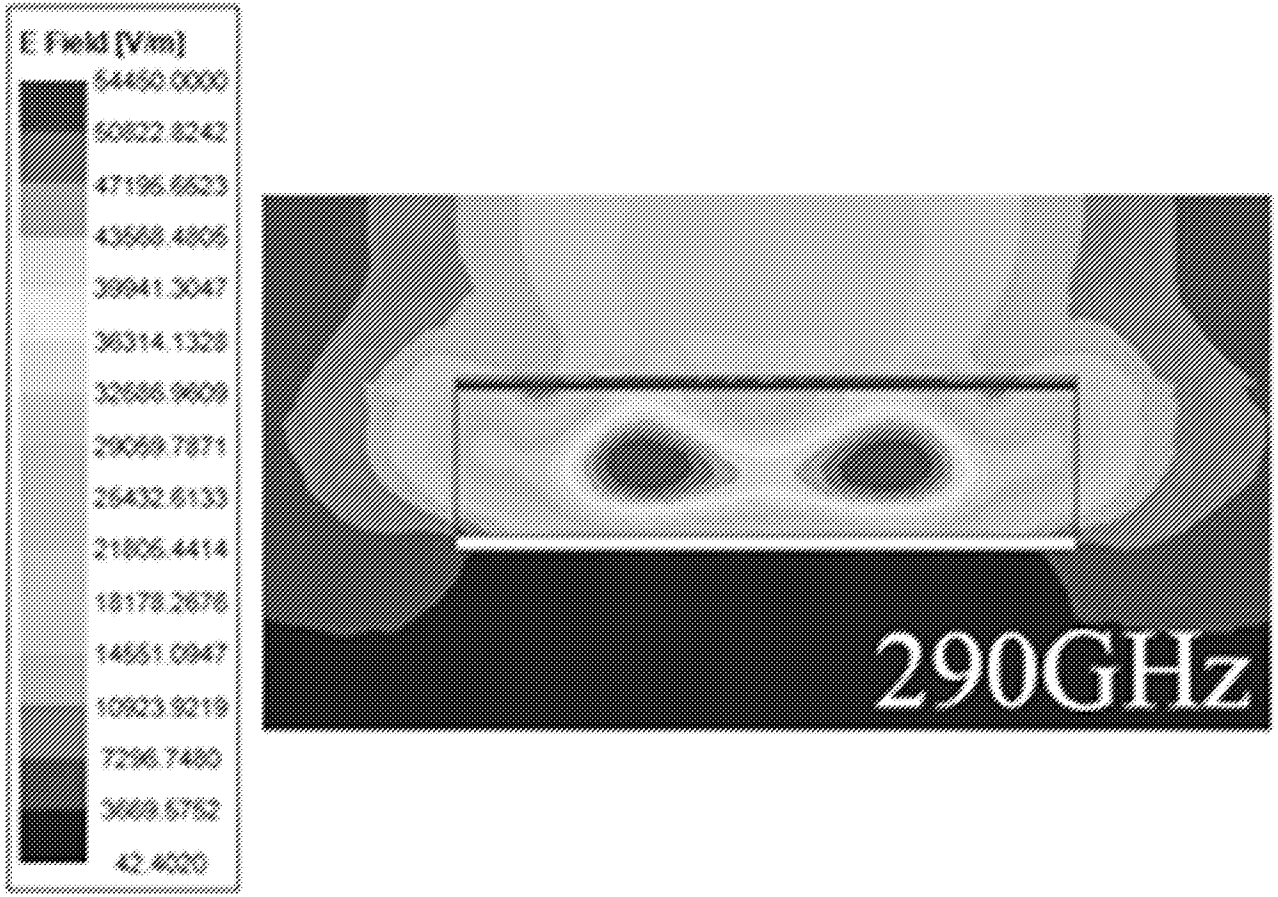
Figure 4f (ii)

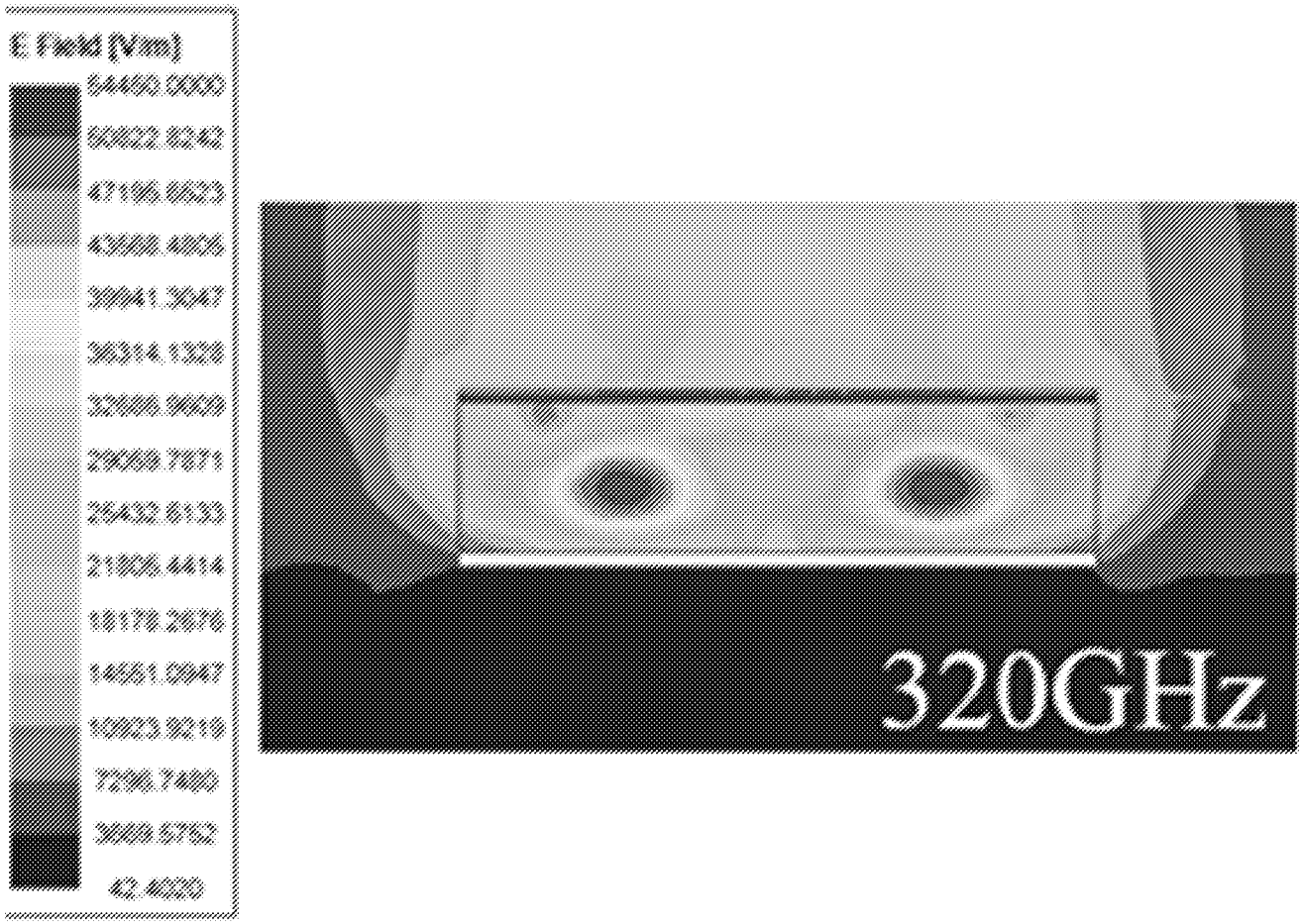
Figure 4f (iii)

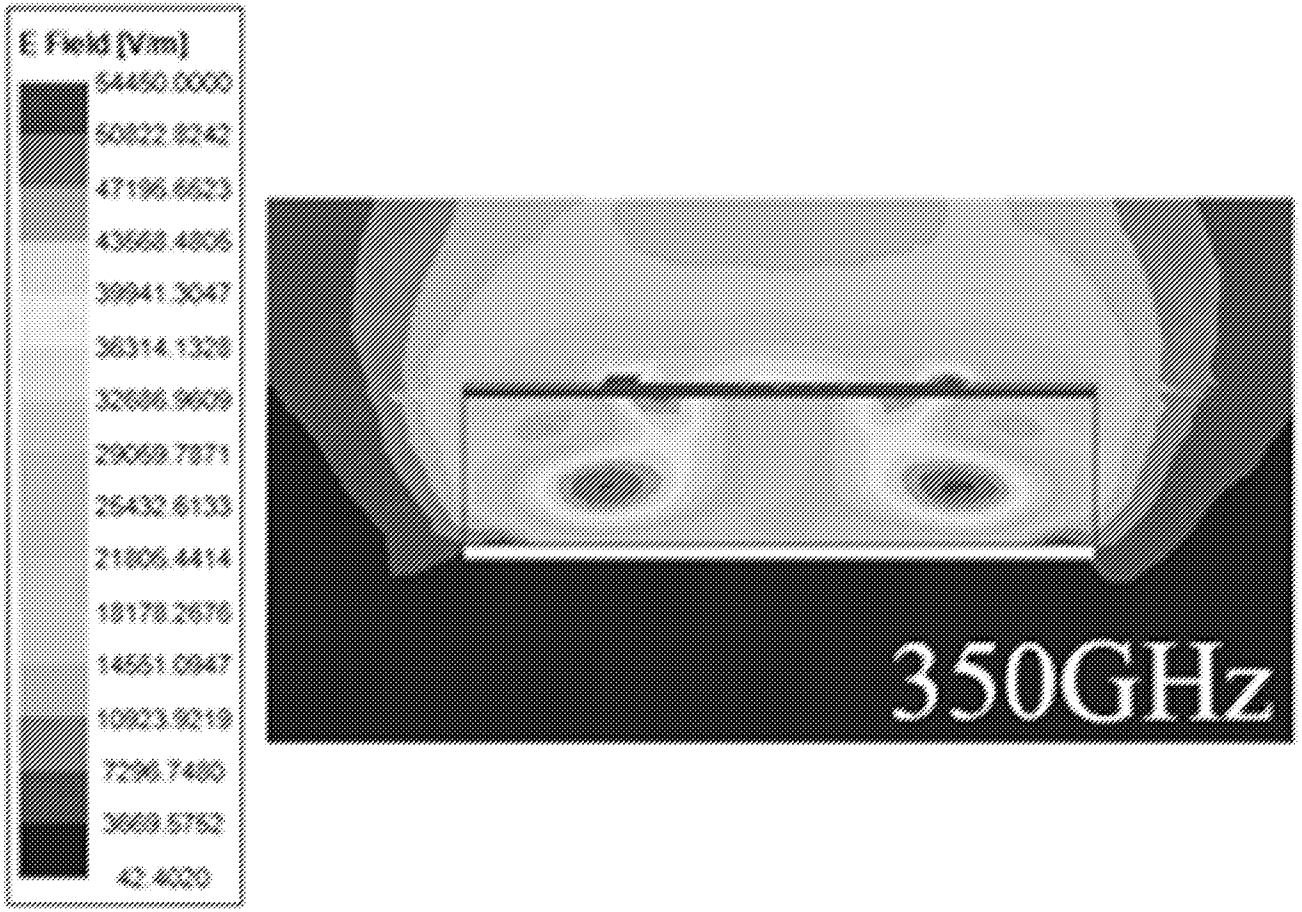
Figure 4f (iv)

Figure 4G:
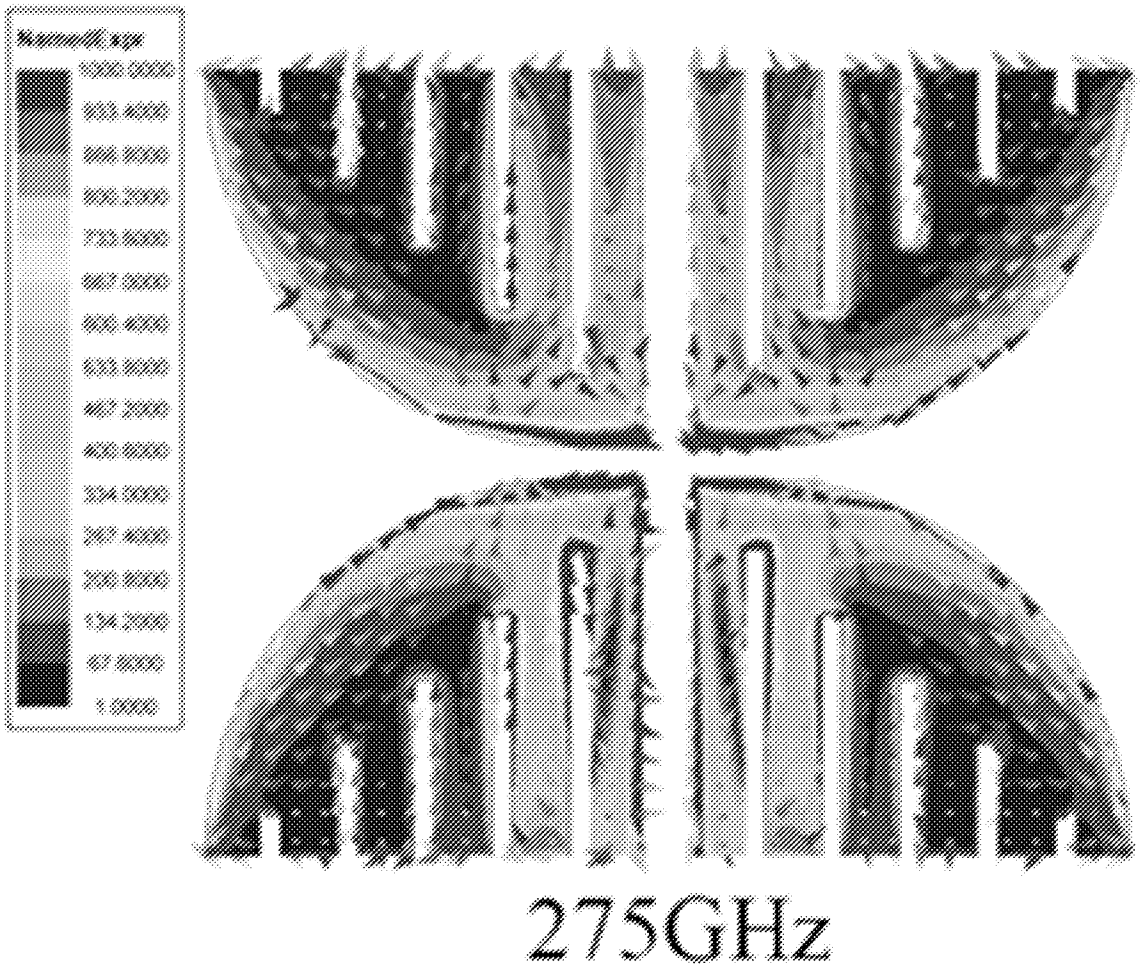
Figure 4G:
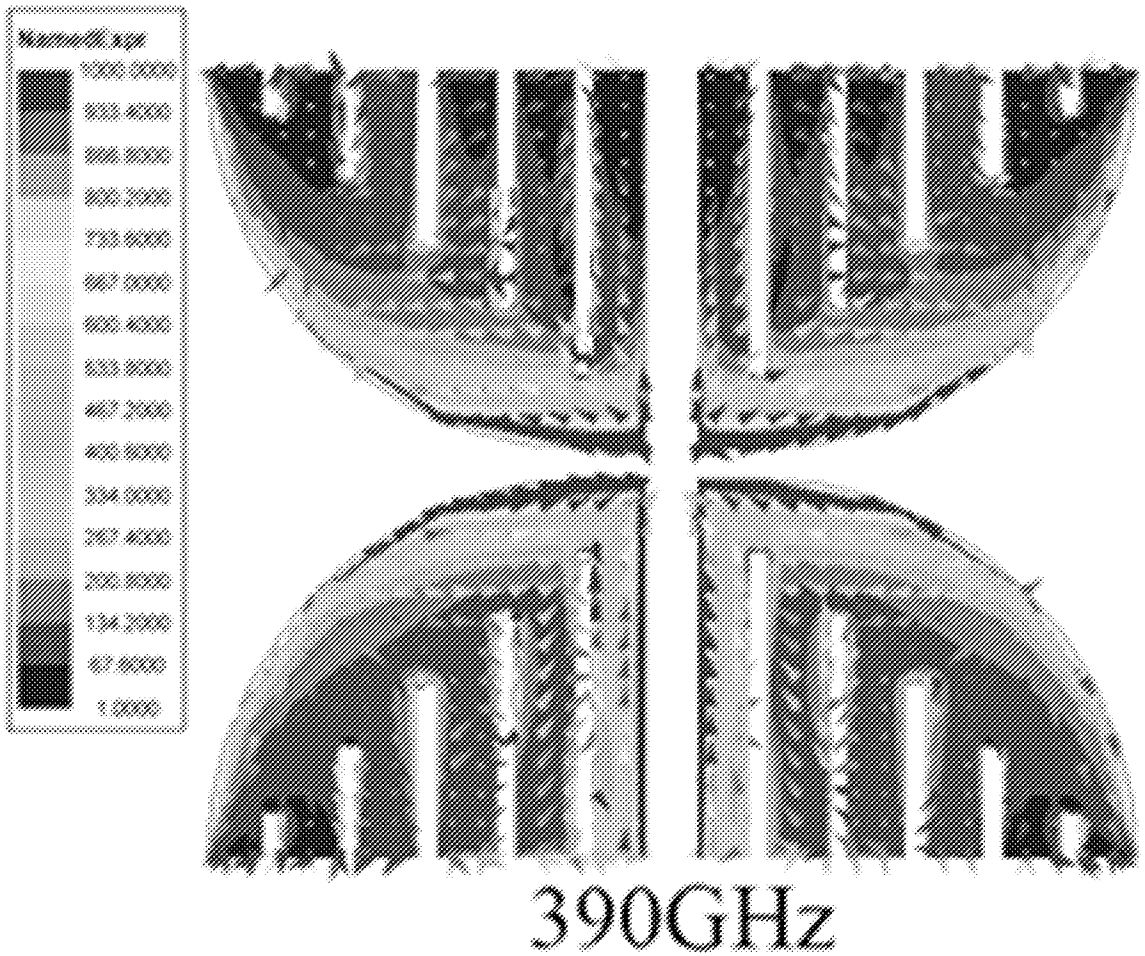
Figure 5A:
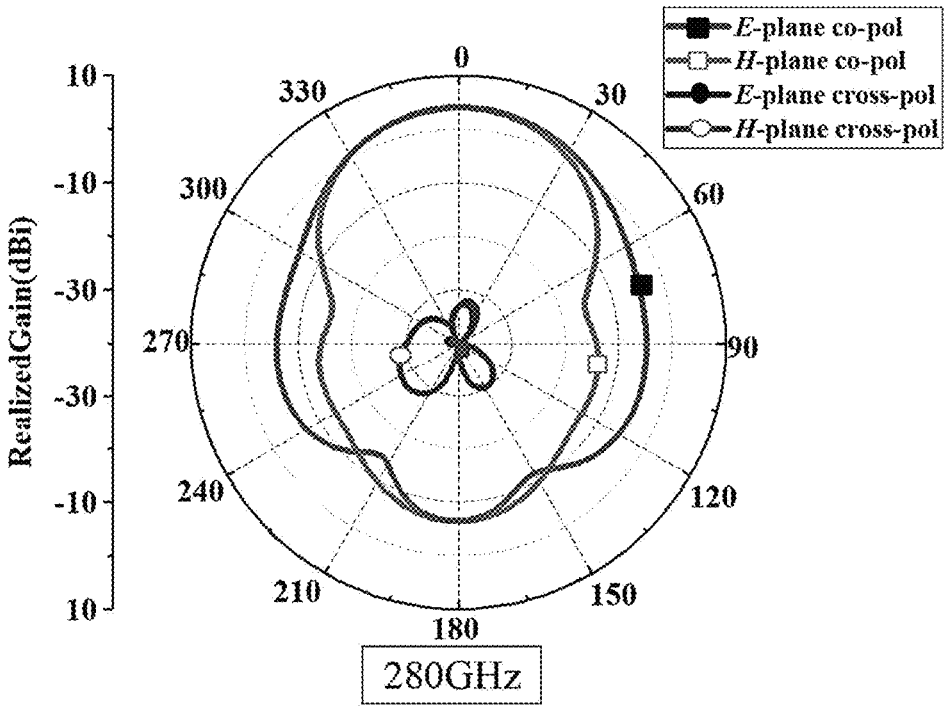
Figure 5B:
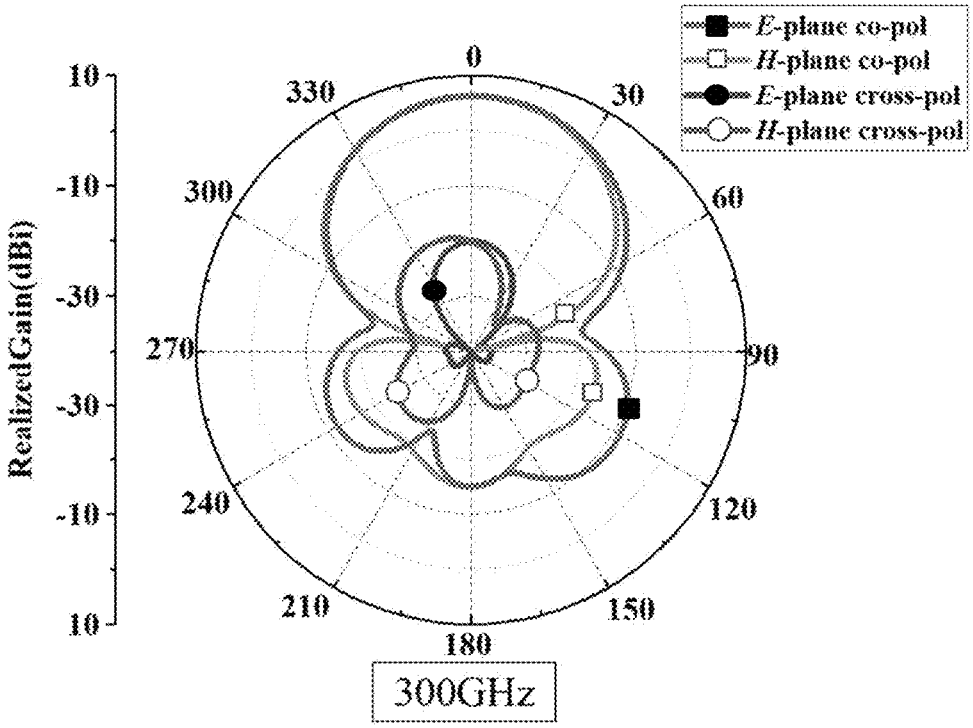
Figure 5C:
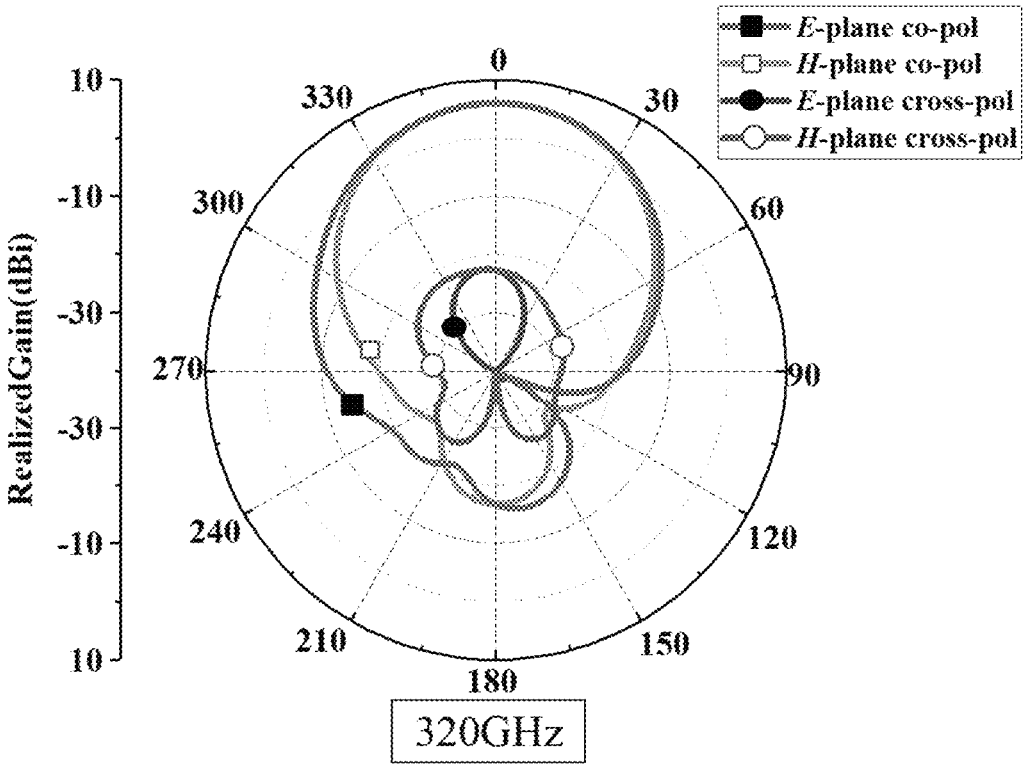
Figure 5D:
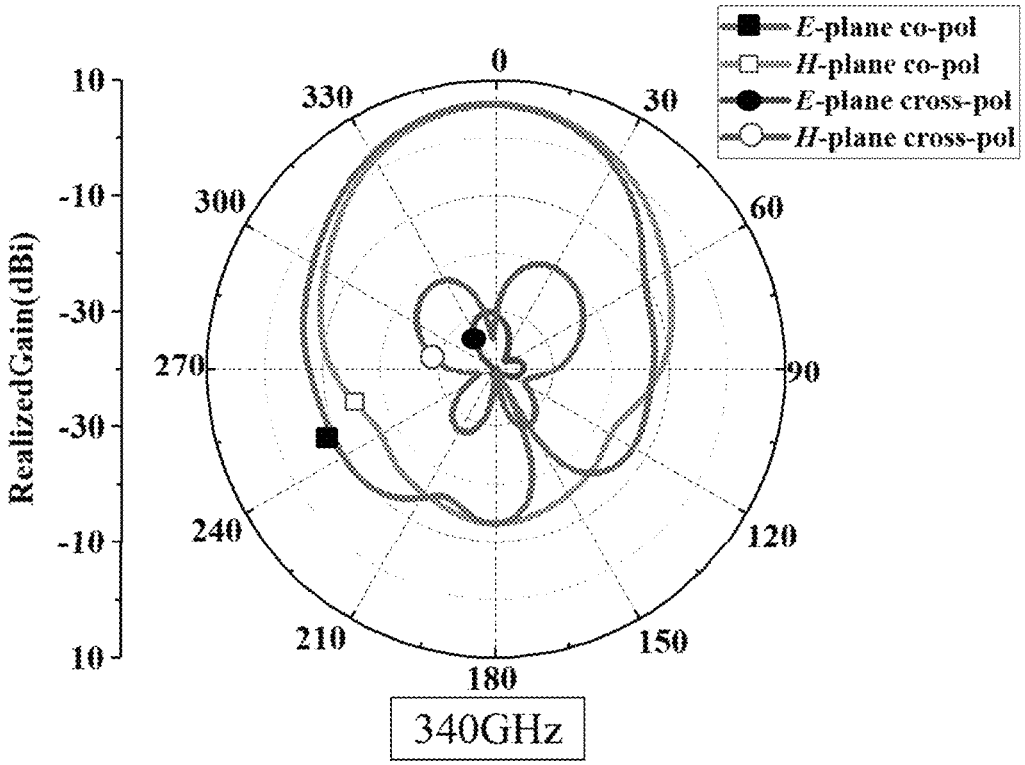
Figure 5E:
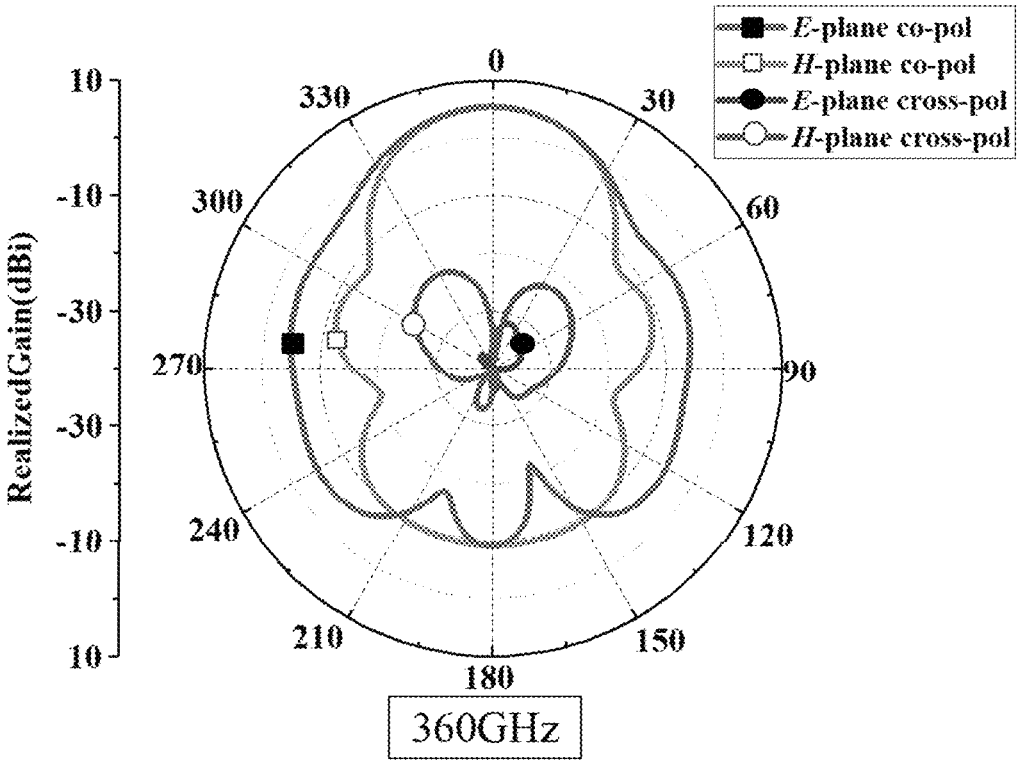
Figure 5F:
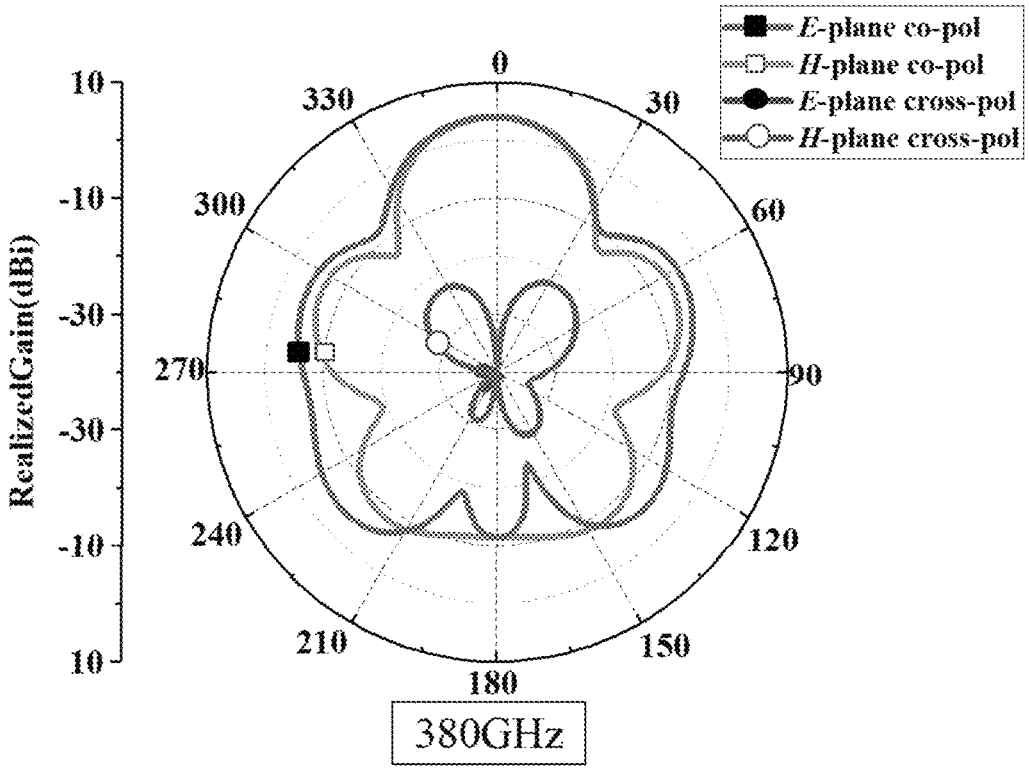

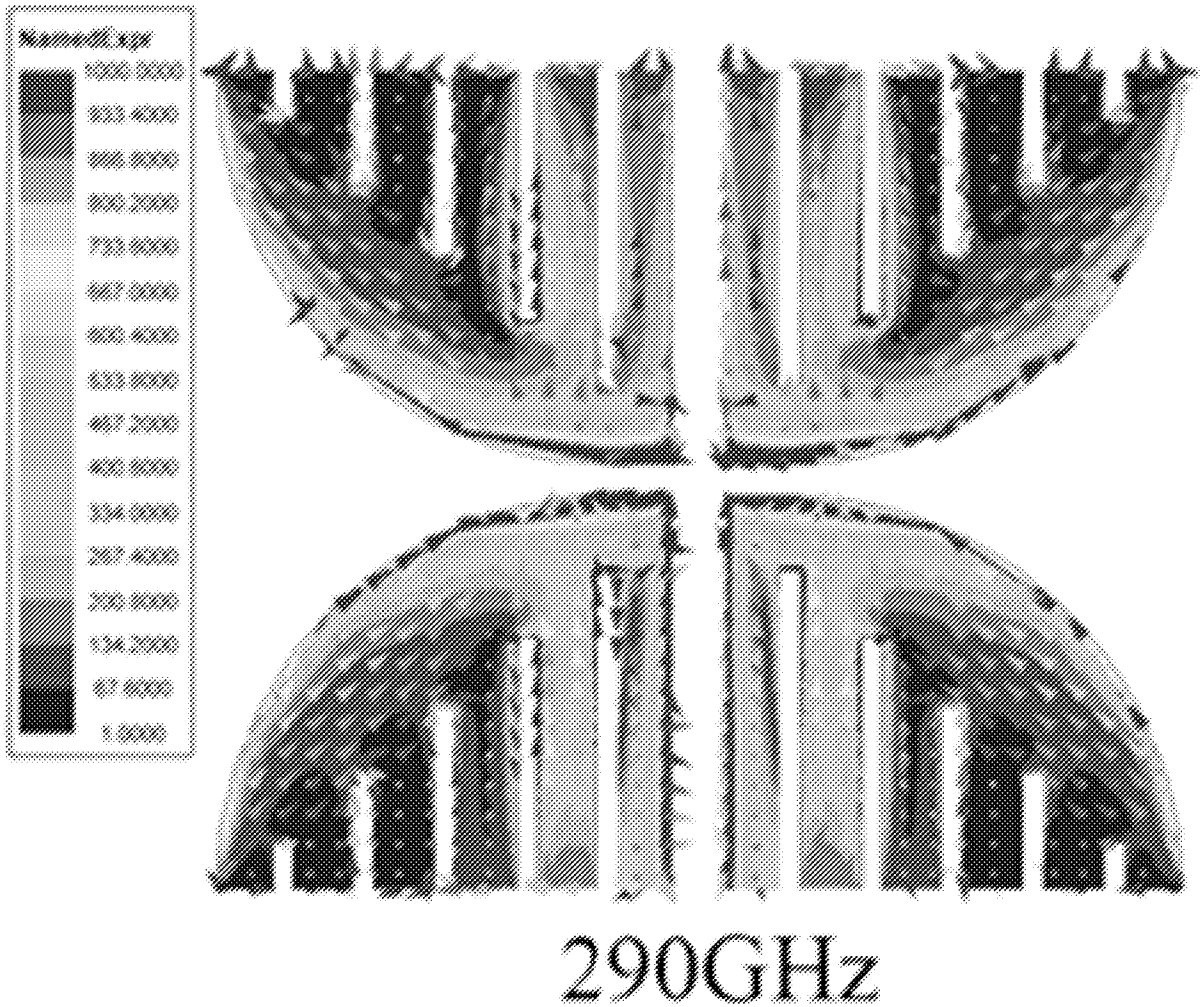
Figure 4g(ii)

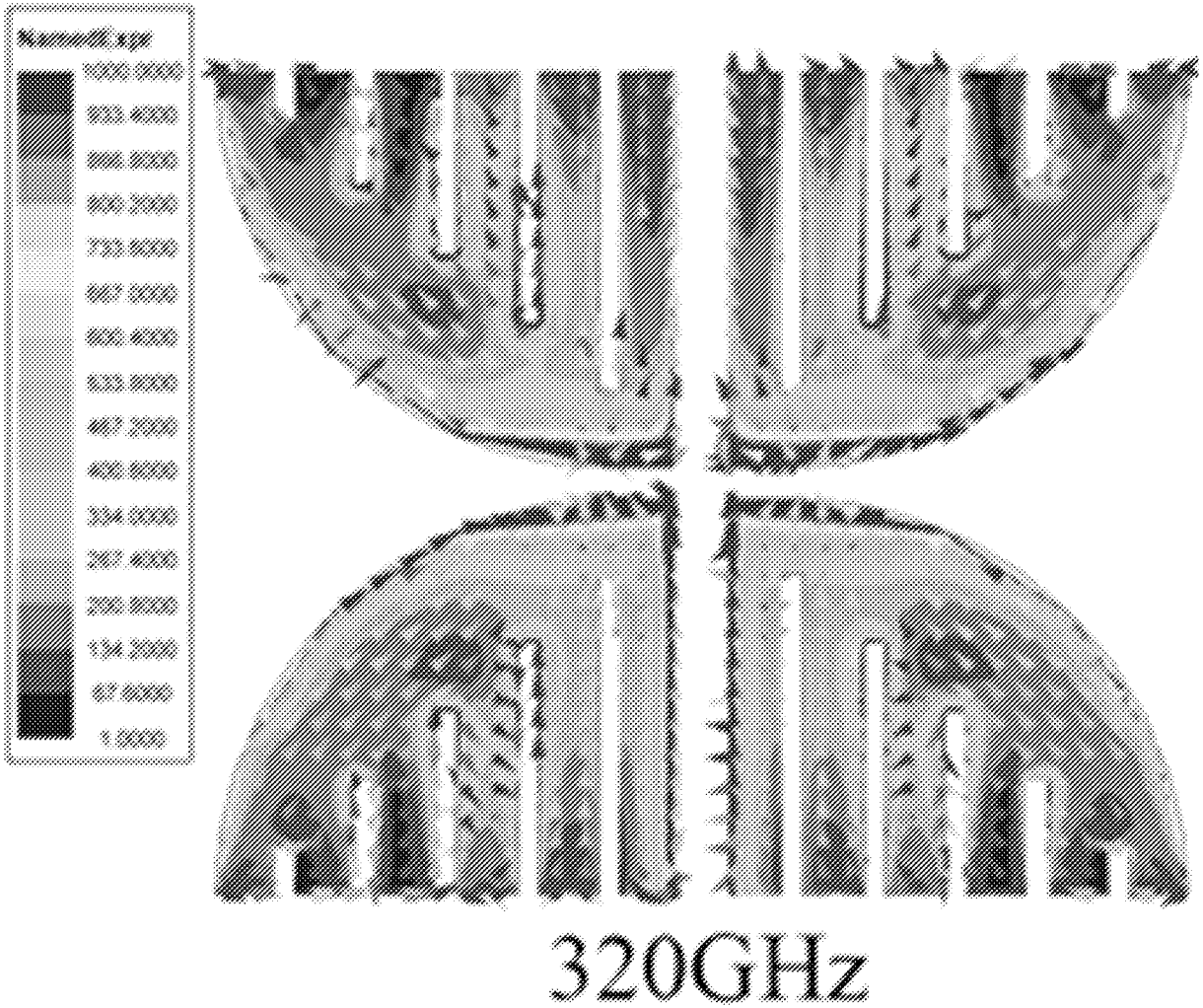
Figure 4g(iii)

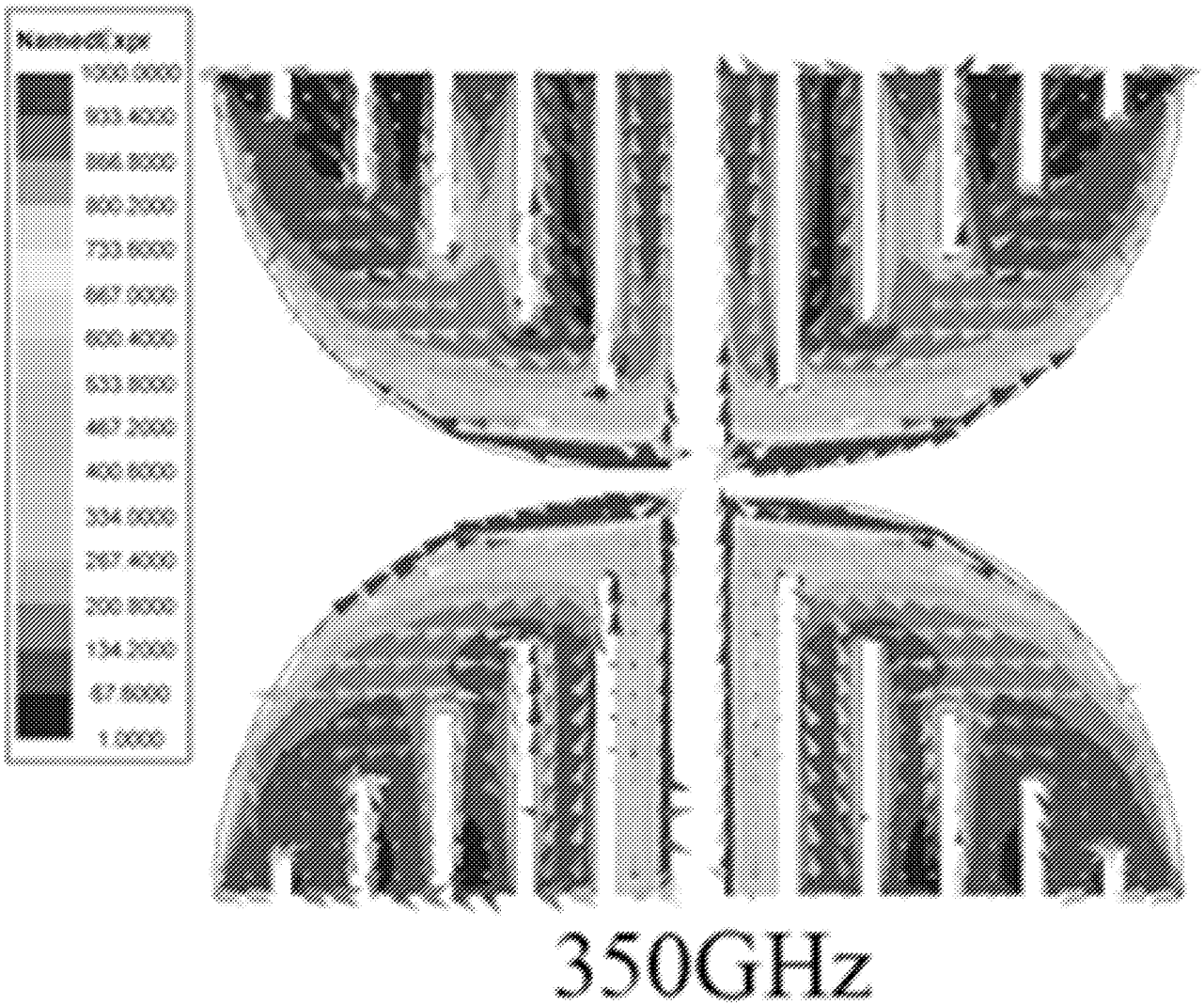
Figure 4g(iv)

Table II: Dimensions of the 1.1THz on-chip antenna (Unit: microns)

| Parameter | *h_si* | *w_slot* | *l_slot* | *d_slot* | *x*0 | *y*1 | *r* | *deg*1 |
|---|---|---|---|---|---|---|---|---|
| Value | 60 | 3 | 50 | 16 | 5 | 10 | 60 | 40deg |
| Parameter | *w_CPW* | *l_CPW* | *w*1 | *w*2 | *g*1 | *g*2 | | |
| Value | 20 | 77.5 | 3.5 | 1.5 | 2.6 | 2 | | |

Table II

Figure 9A:
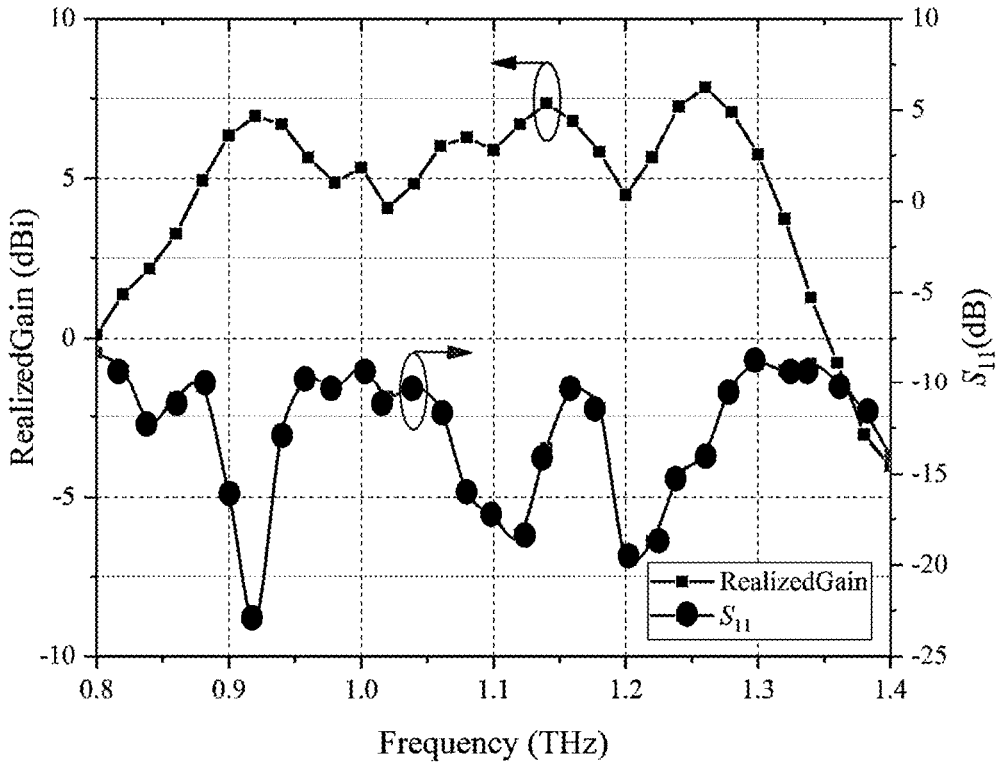
Figure 9B:
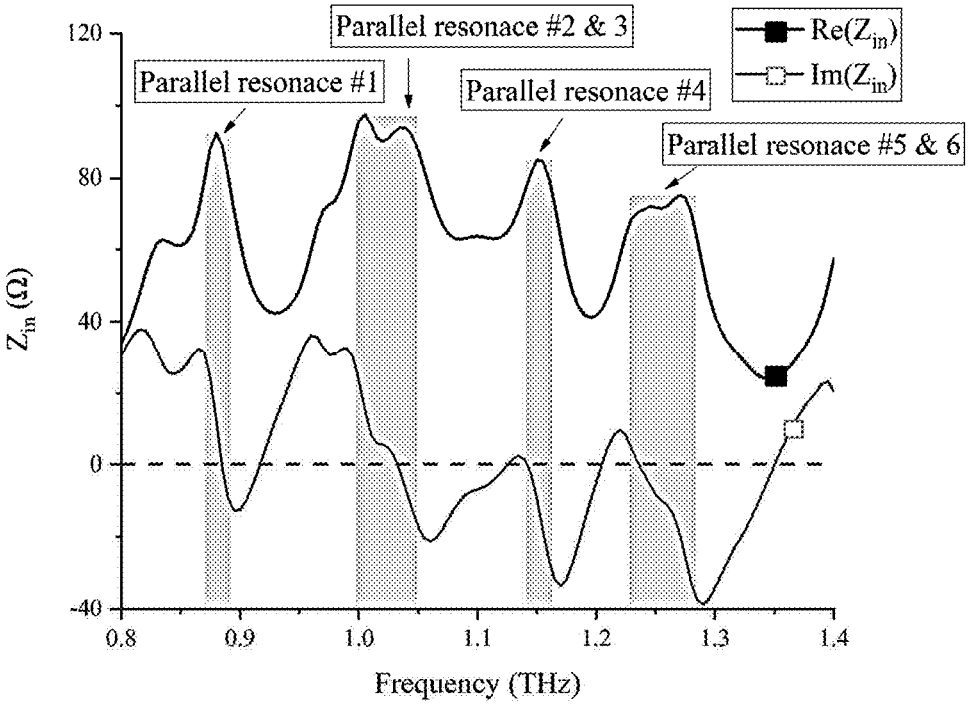
Figure 9C:
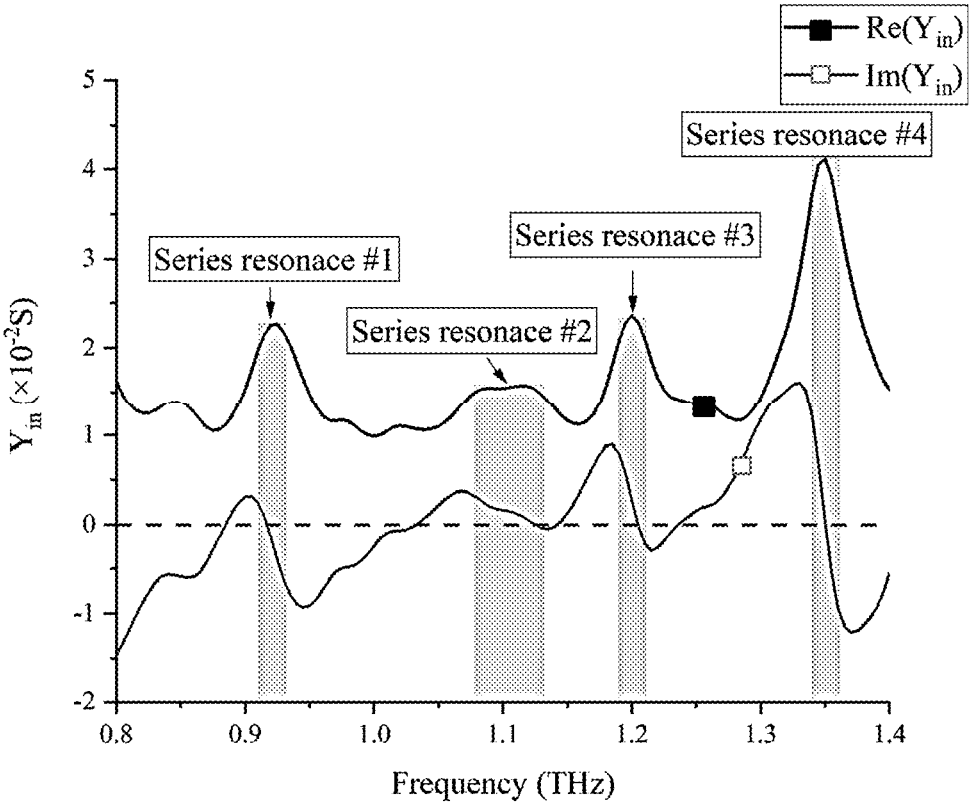
Figure 9D:
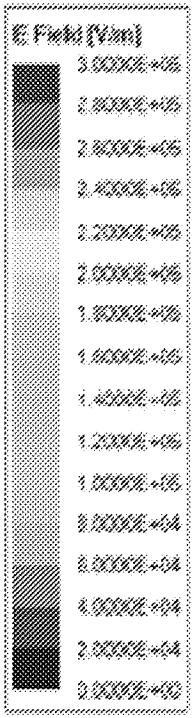
Figure 9D:
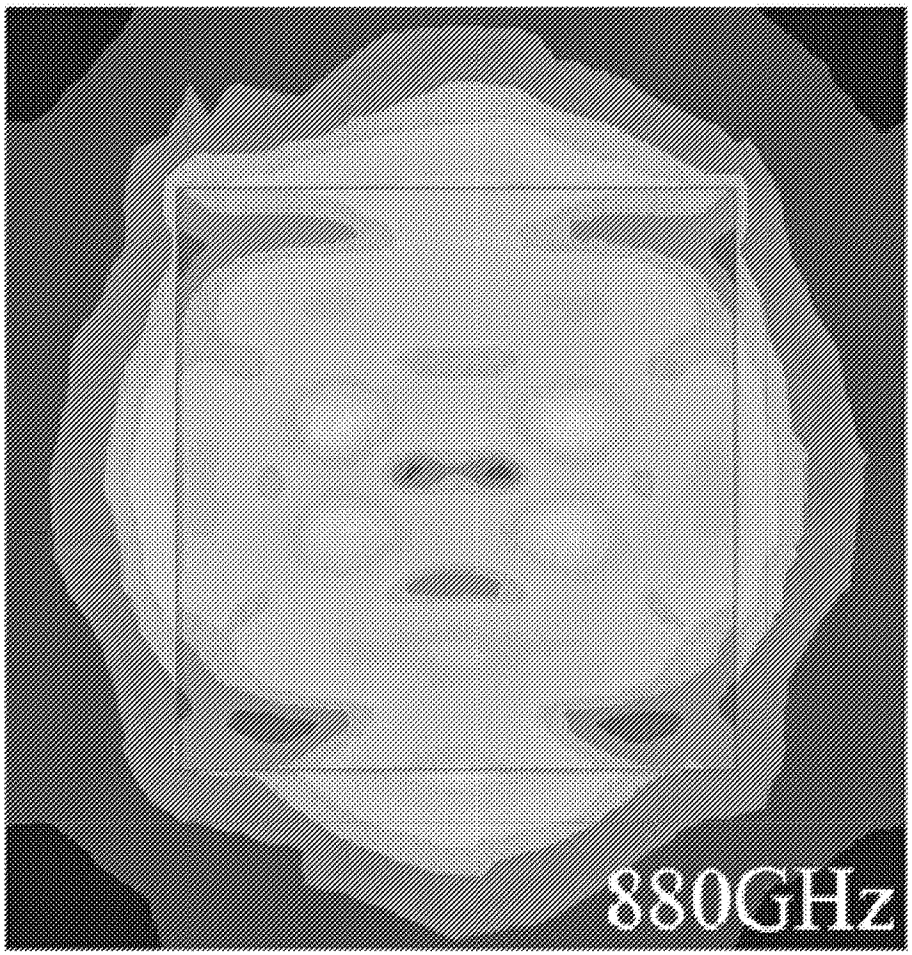

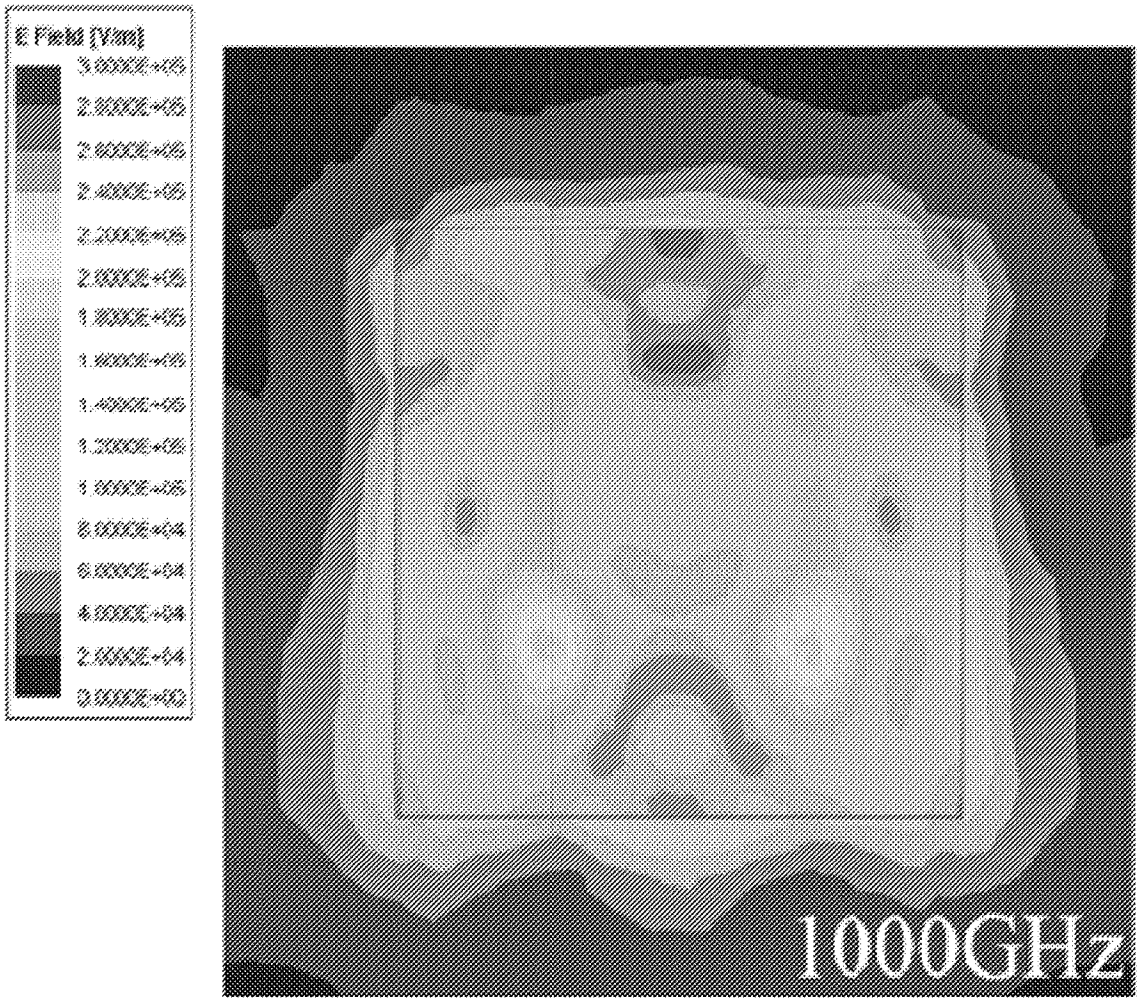
Figure 9d(ii)

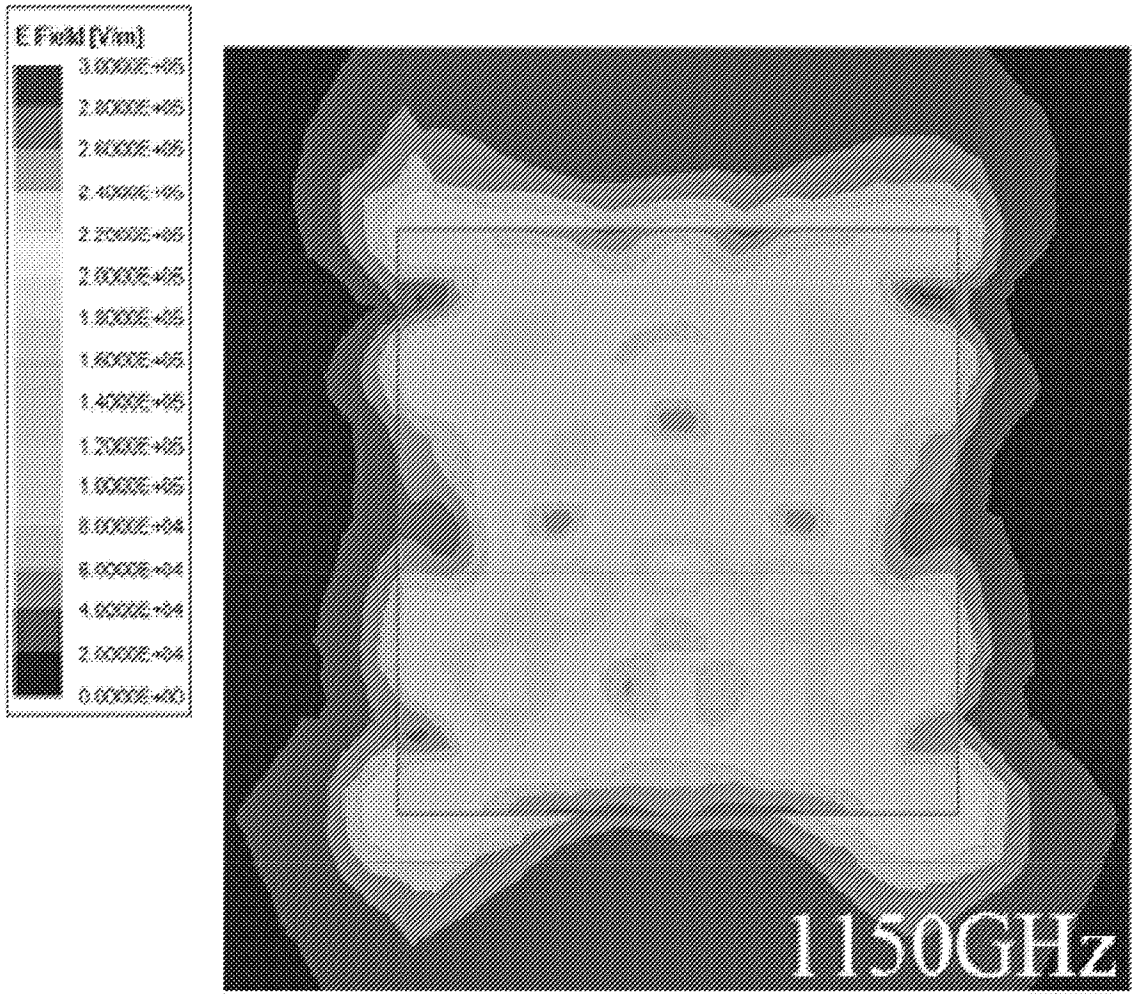
Figure 9d(iii)

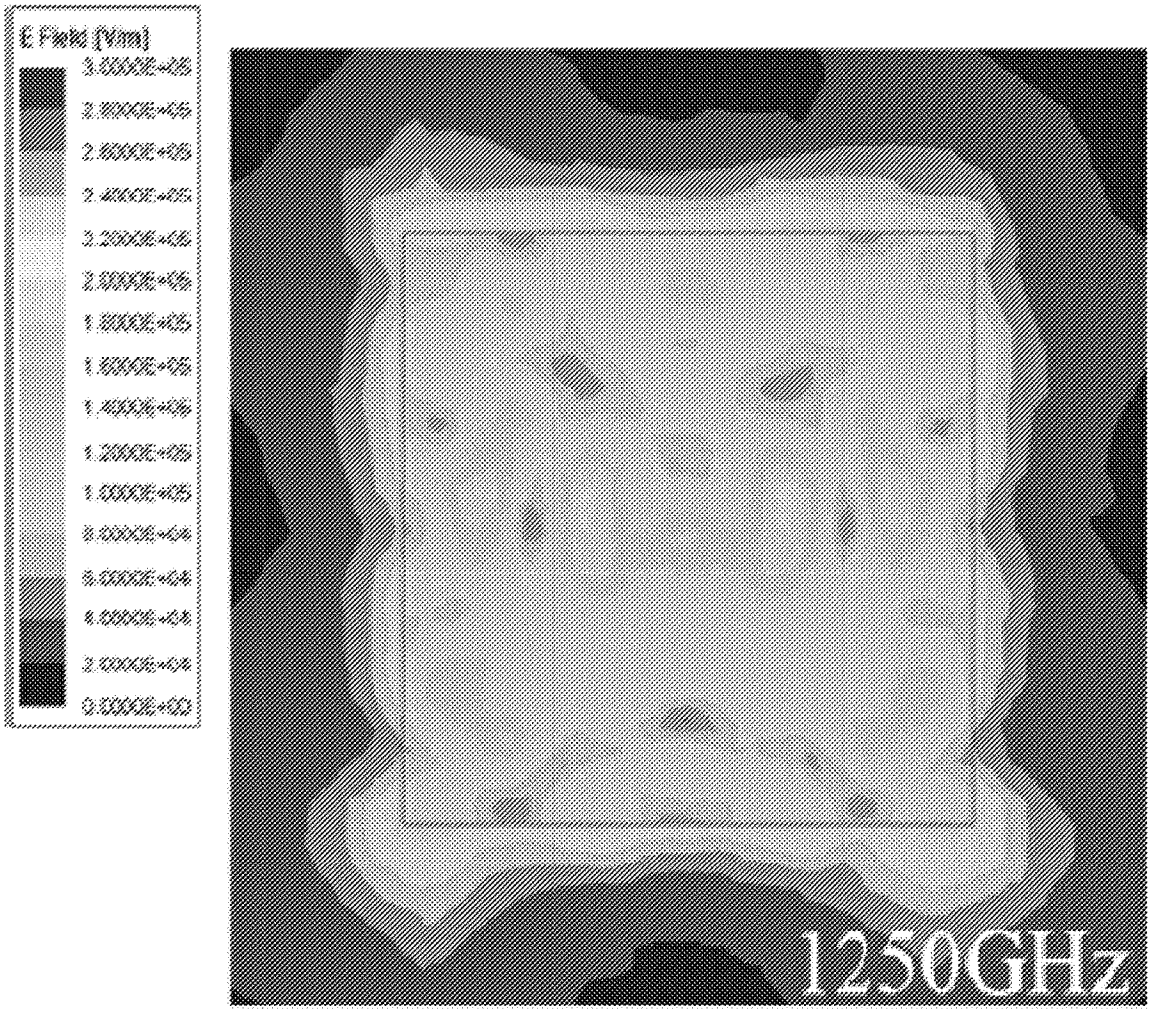
Figure 9d(iv)

Figure 9E:
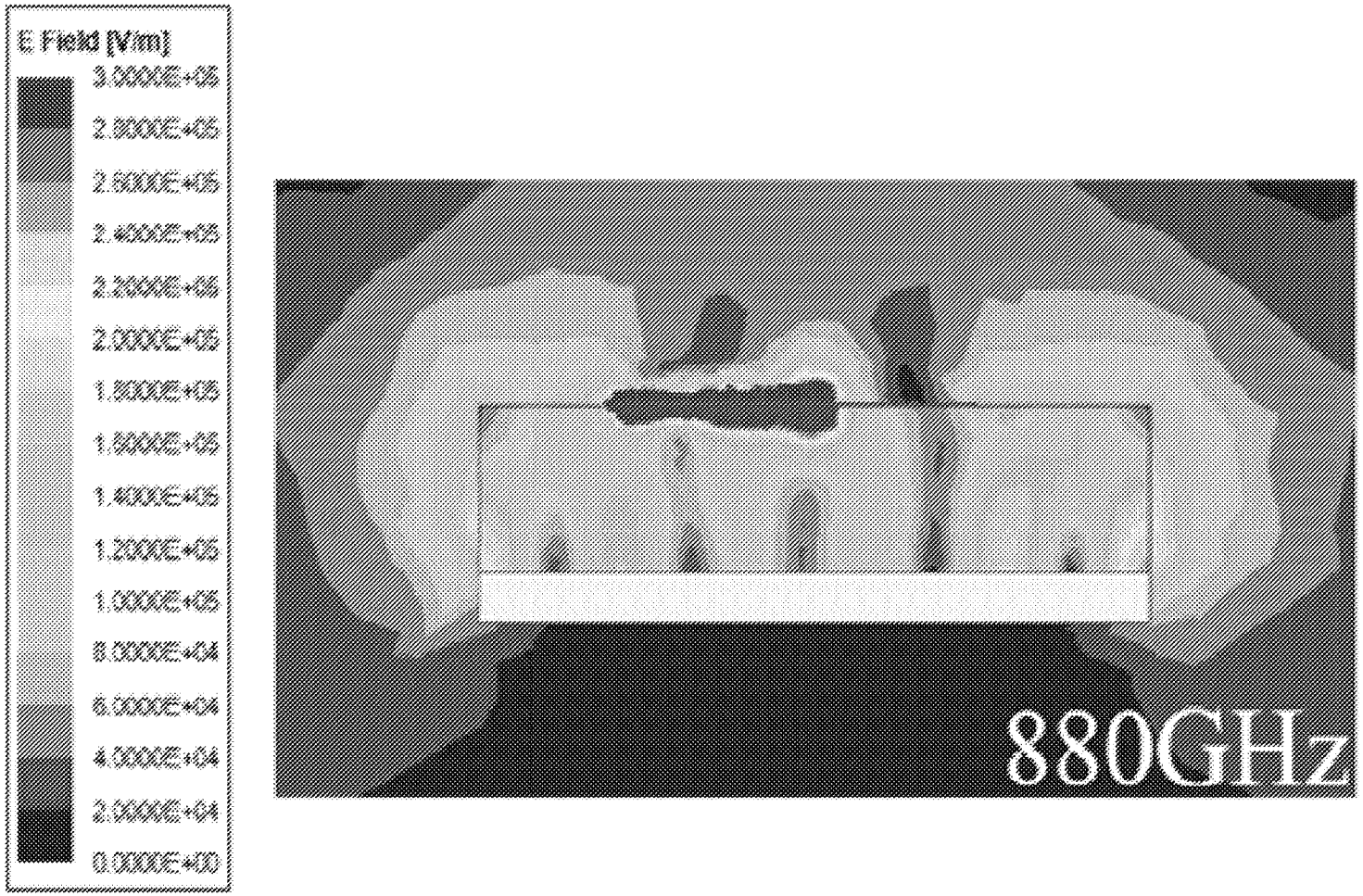

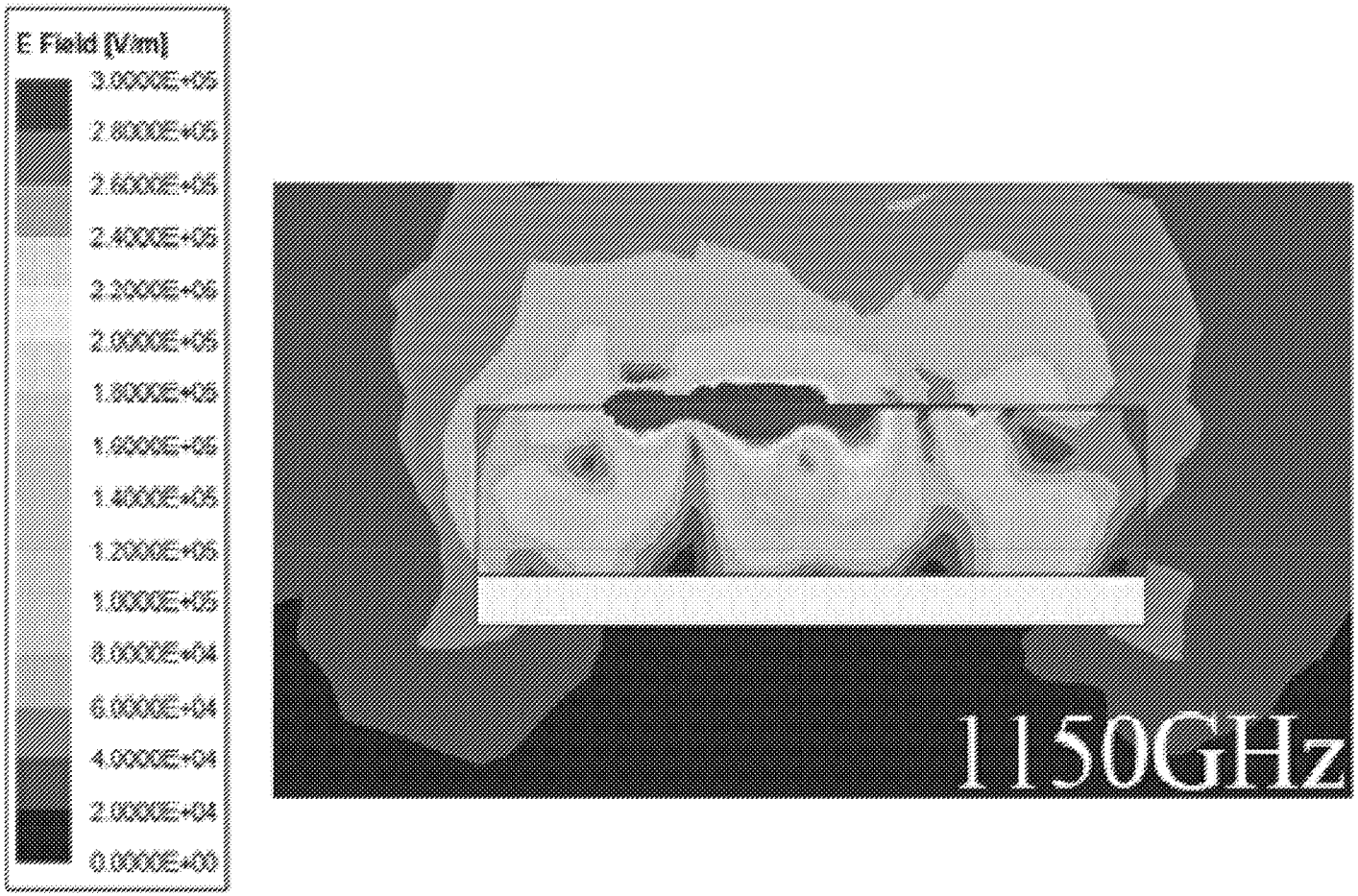
Figure 9e(ii)

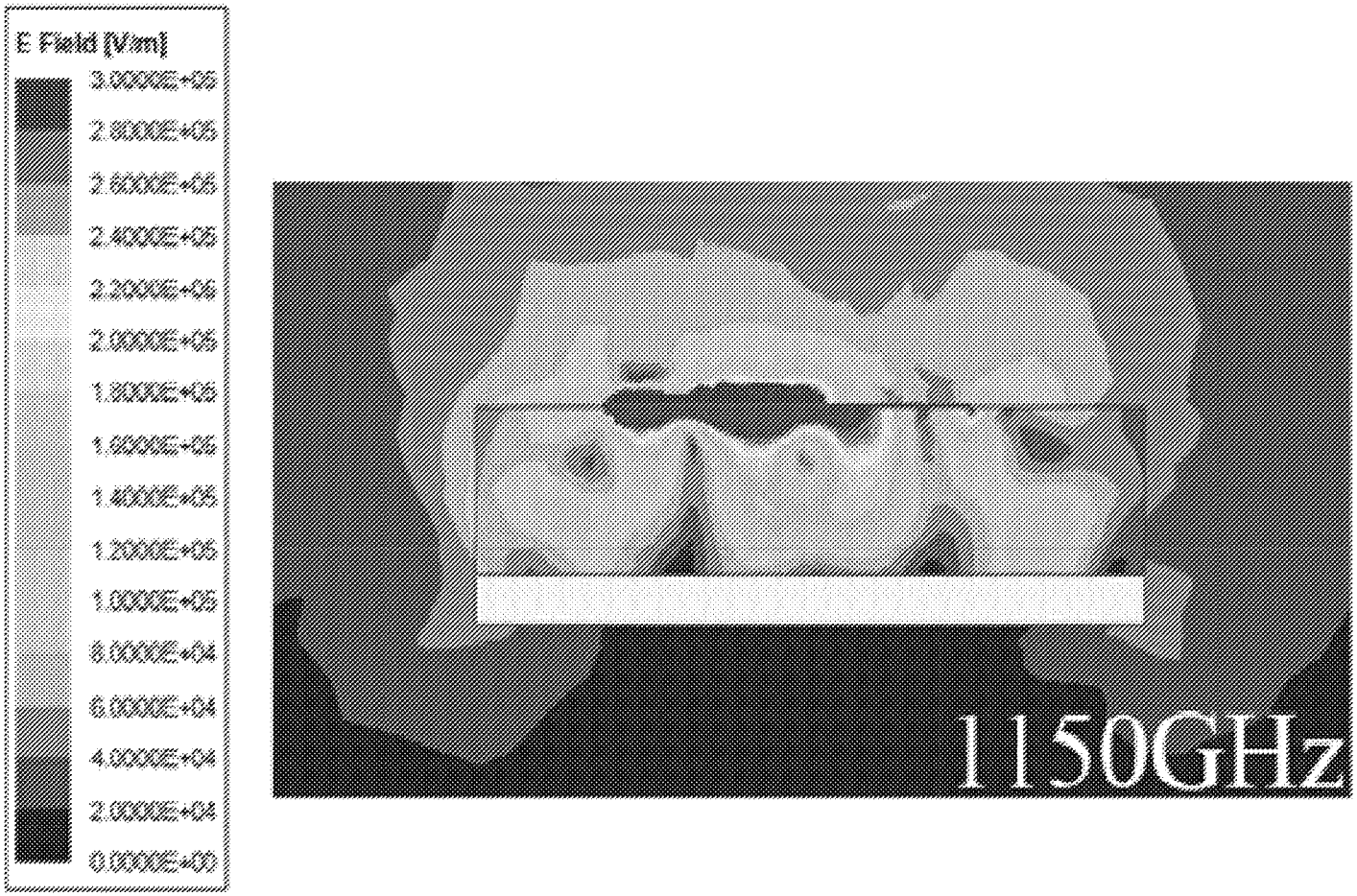
Figure 9e(iii)

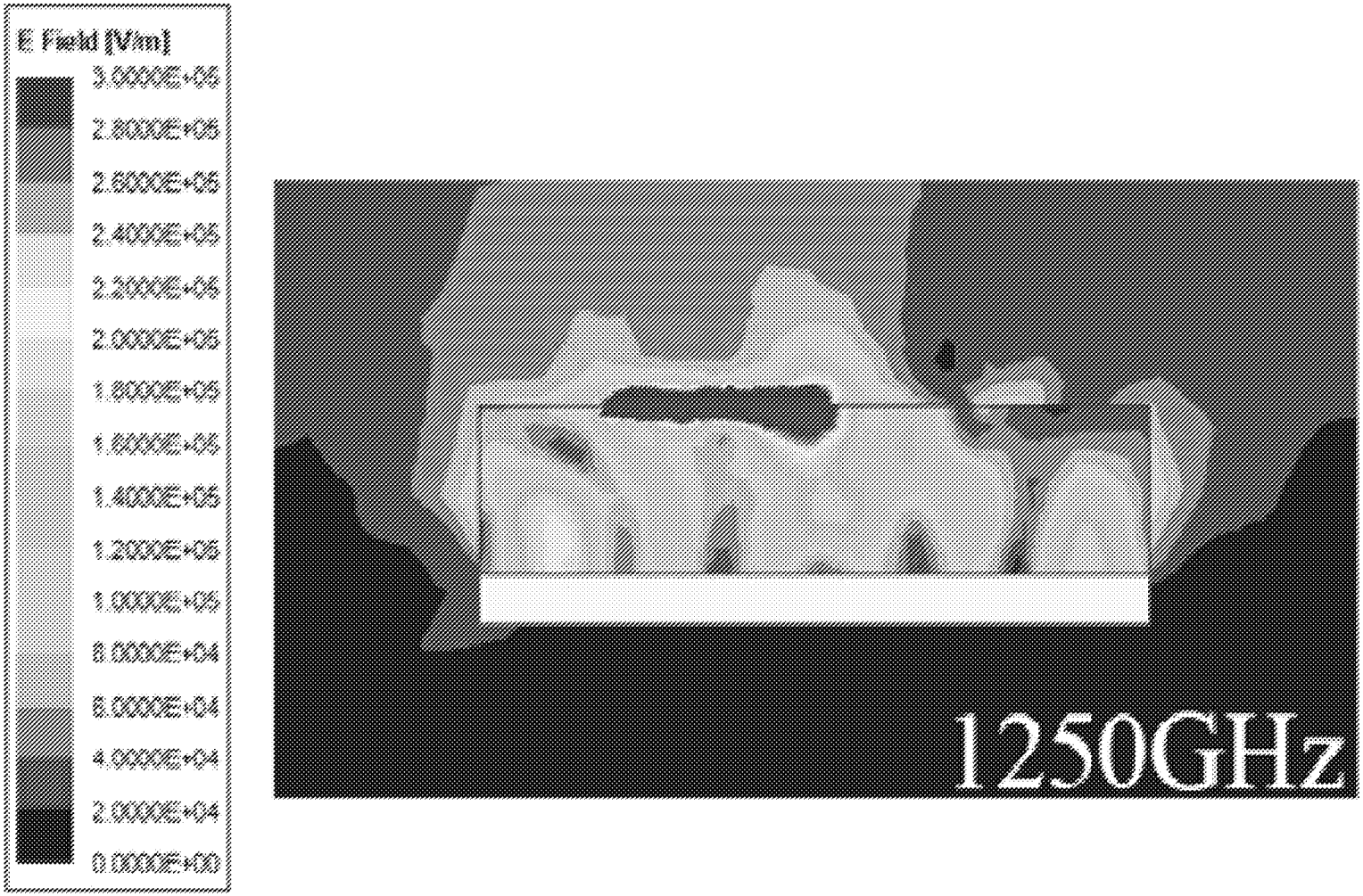
Figure 9e(iv)

Figure 9F:
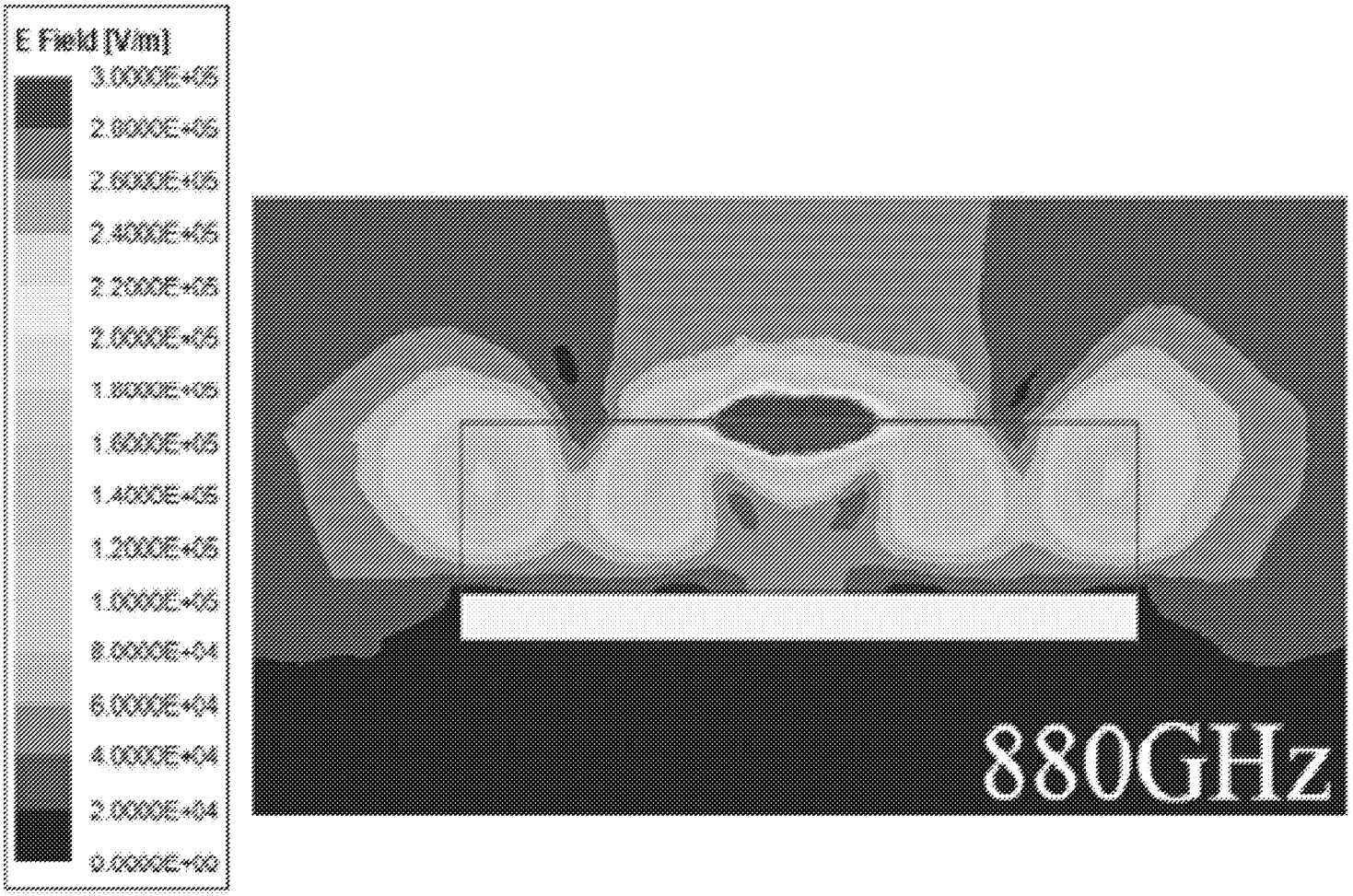

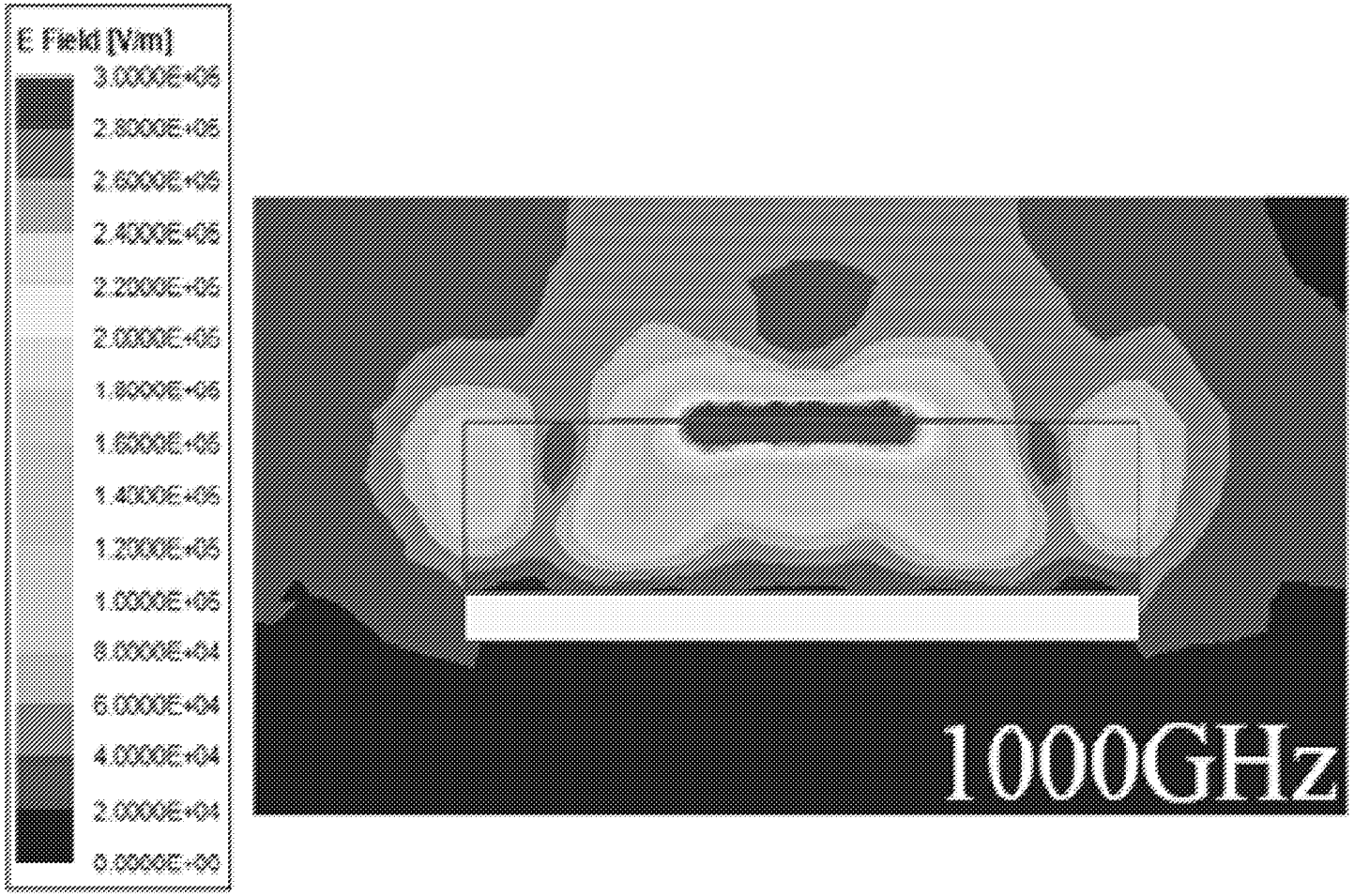
Figure 9f(ii)

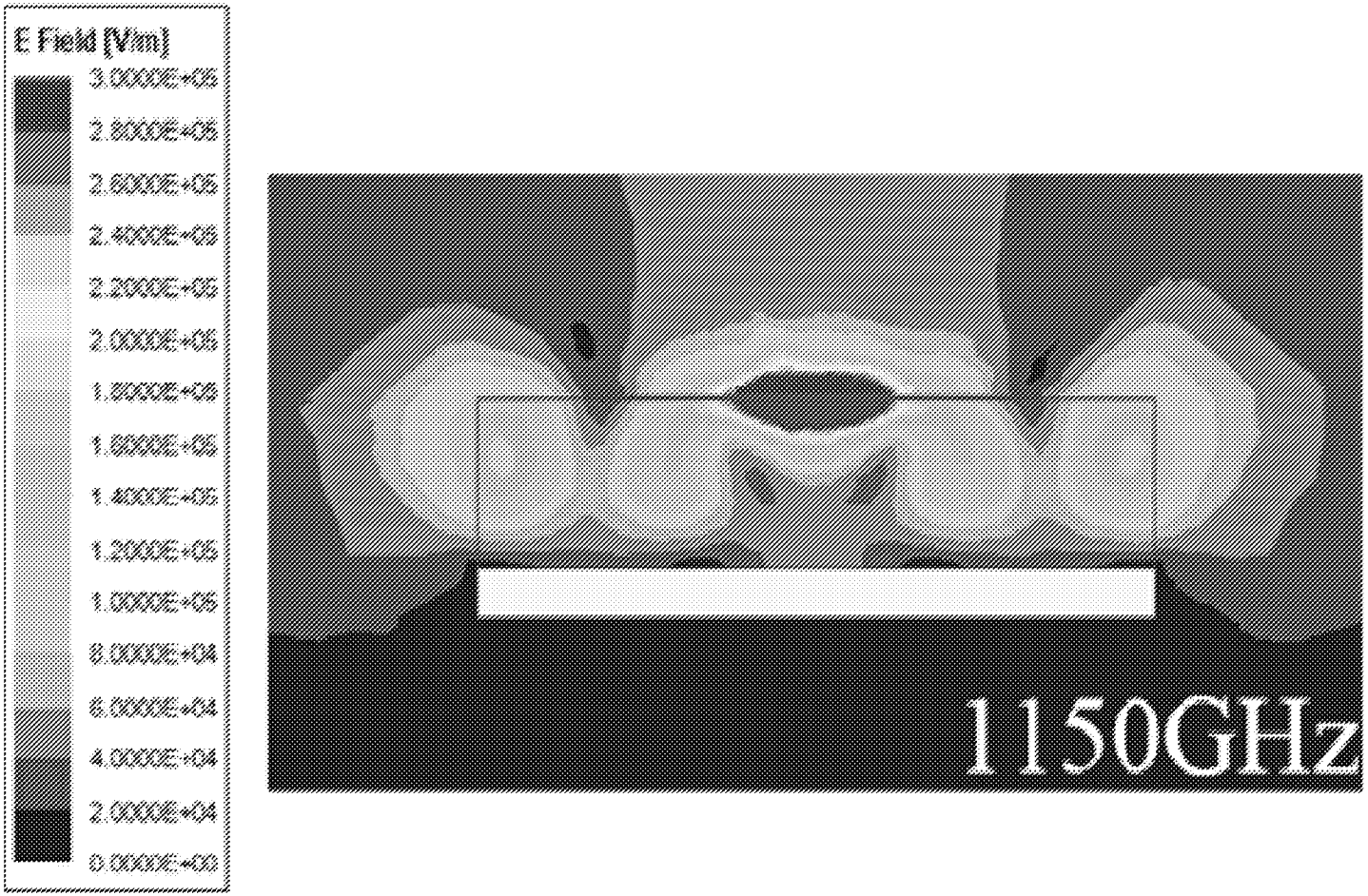
Figure 9f(iii)

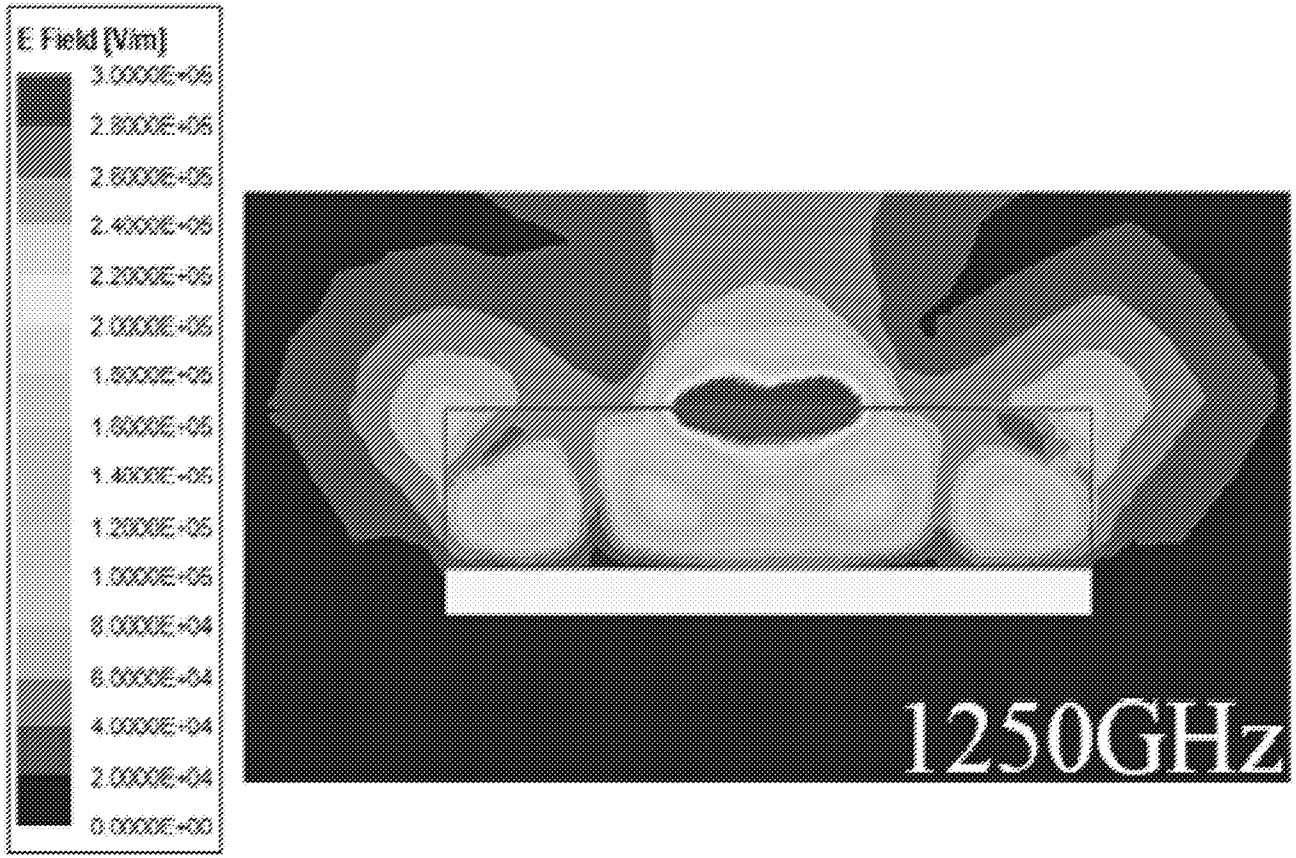
Figure 9f(iv)

Figure 9G:
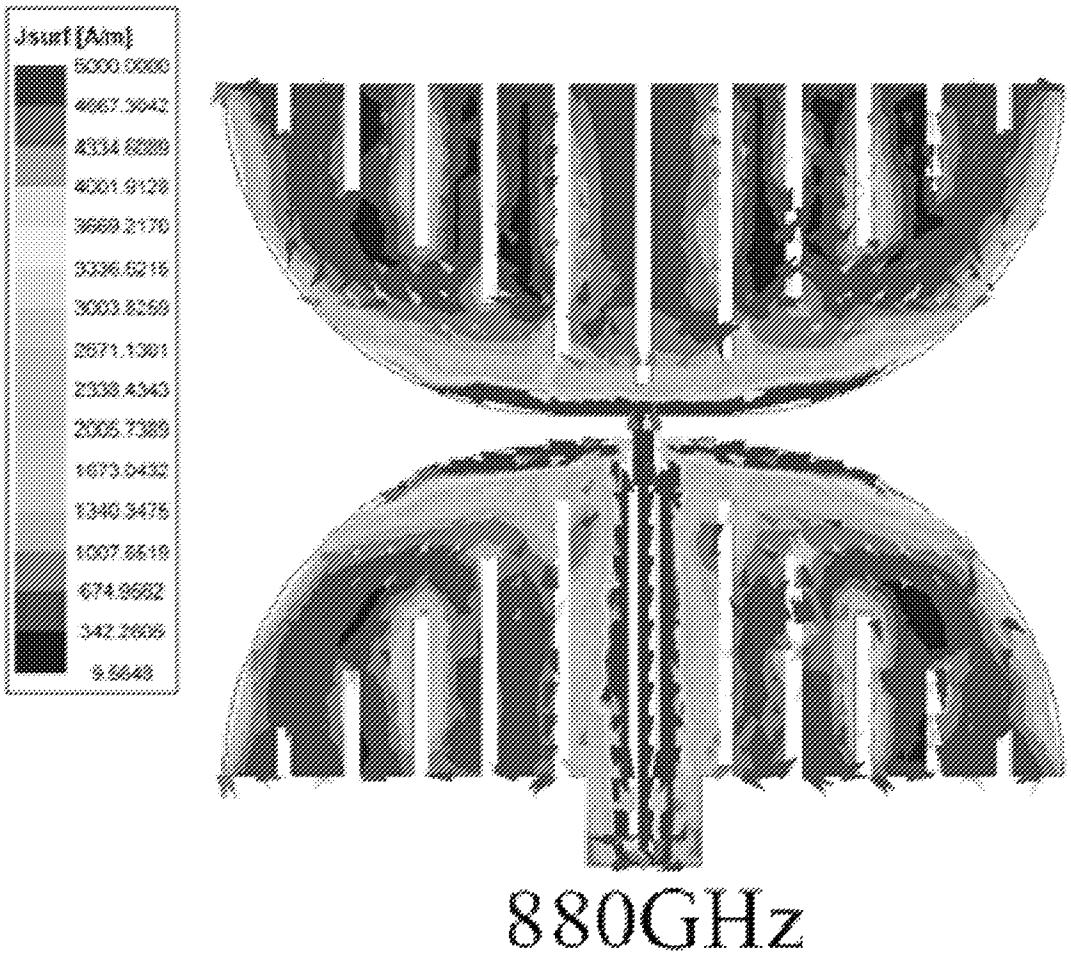
Figure 10A:
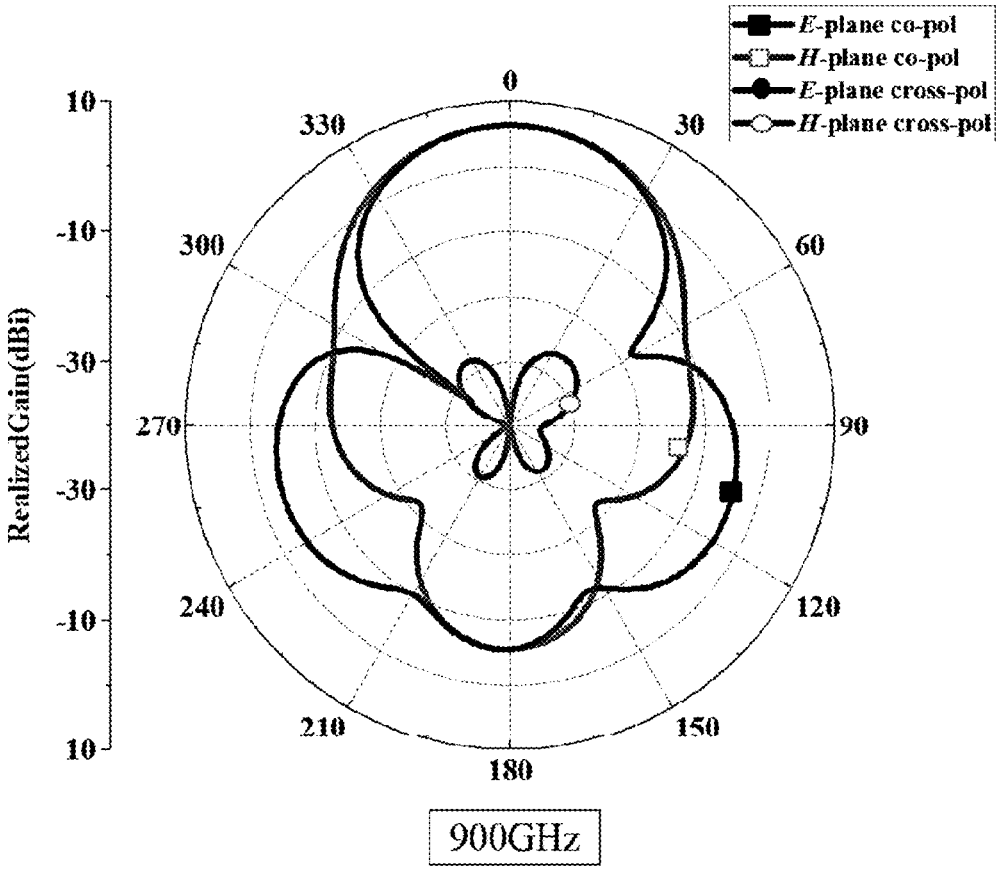
Figure 10B:
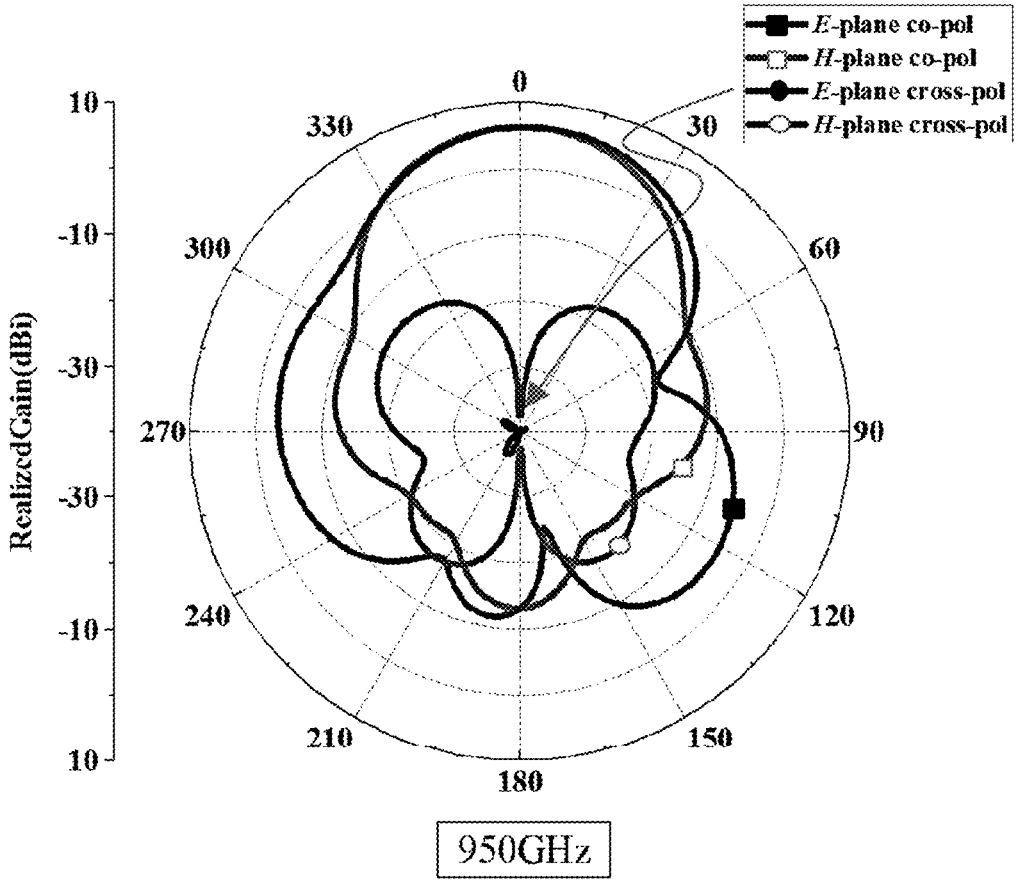
Figure 10C:
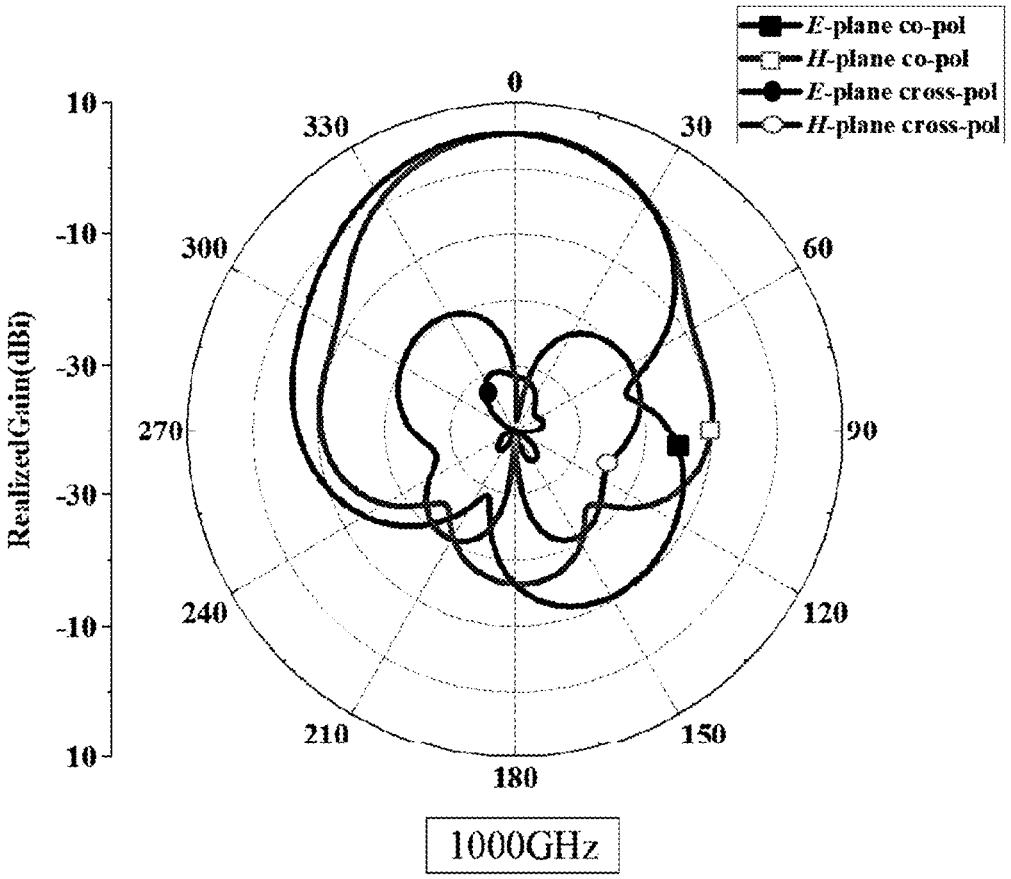
Figure 10D:
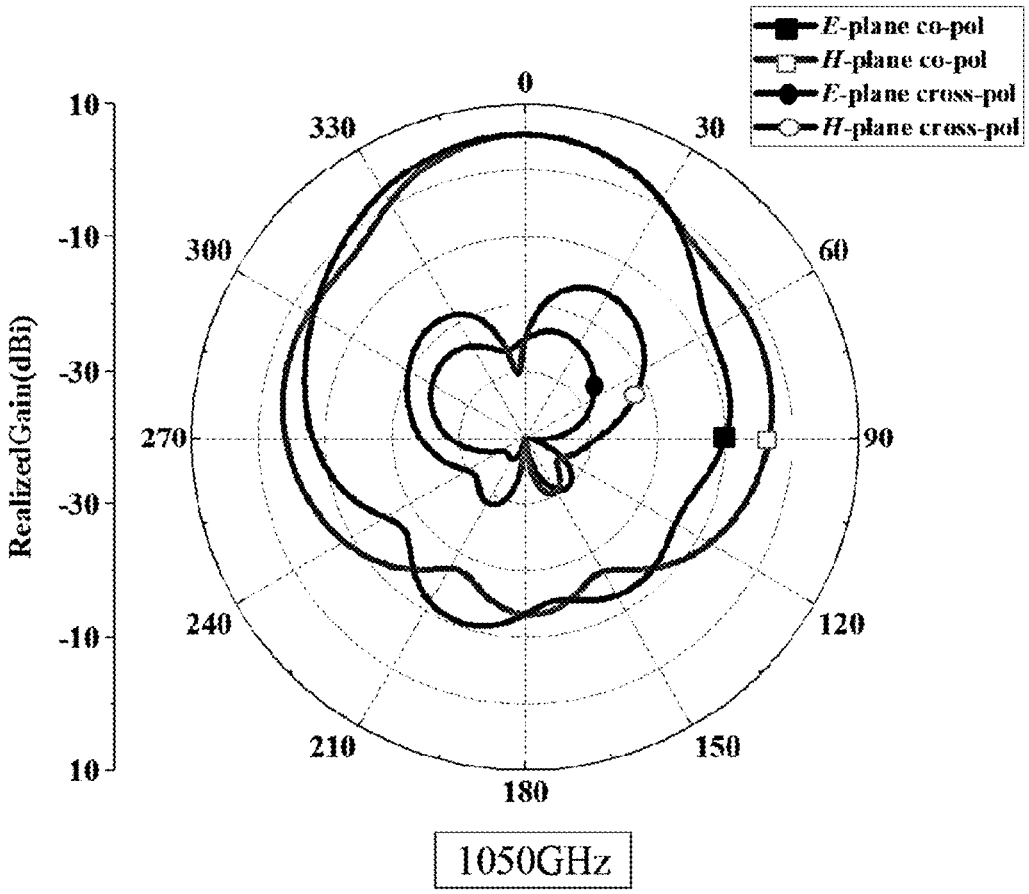
Figure 10E:
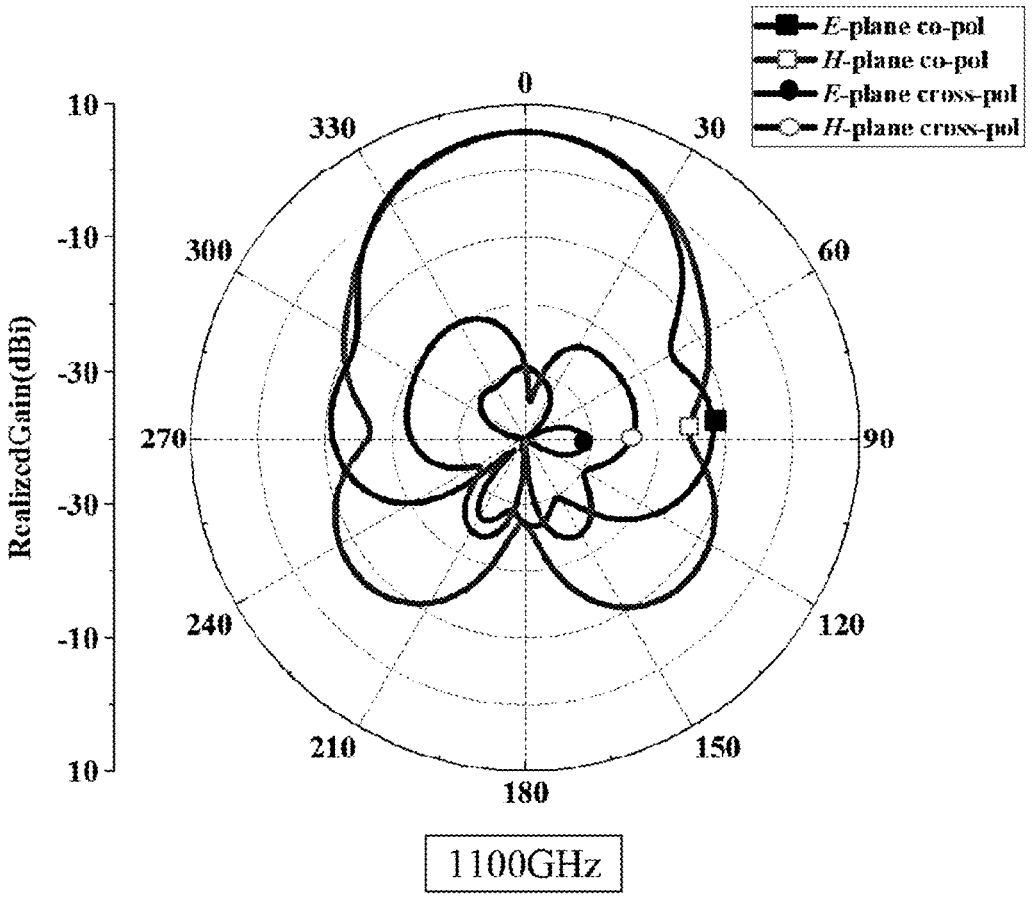
Figure 10F:
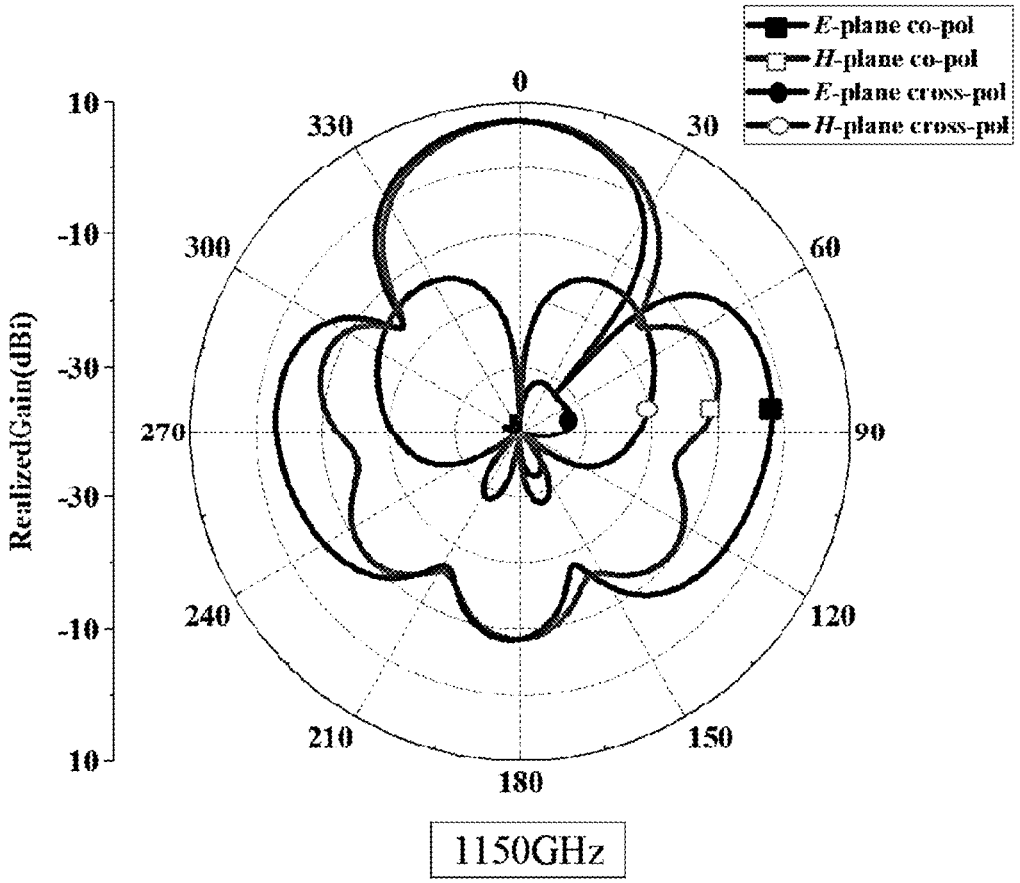
Figure 10G:
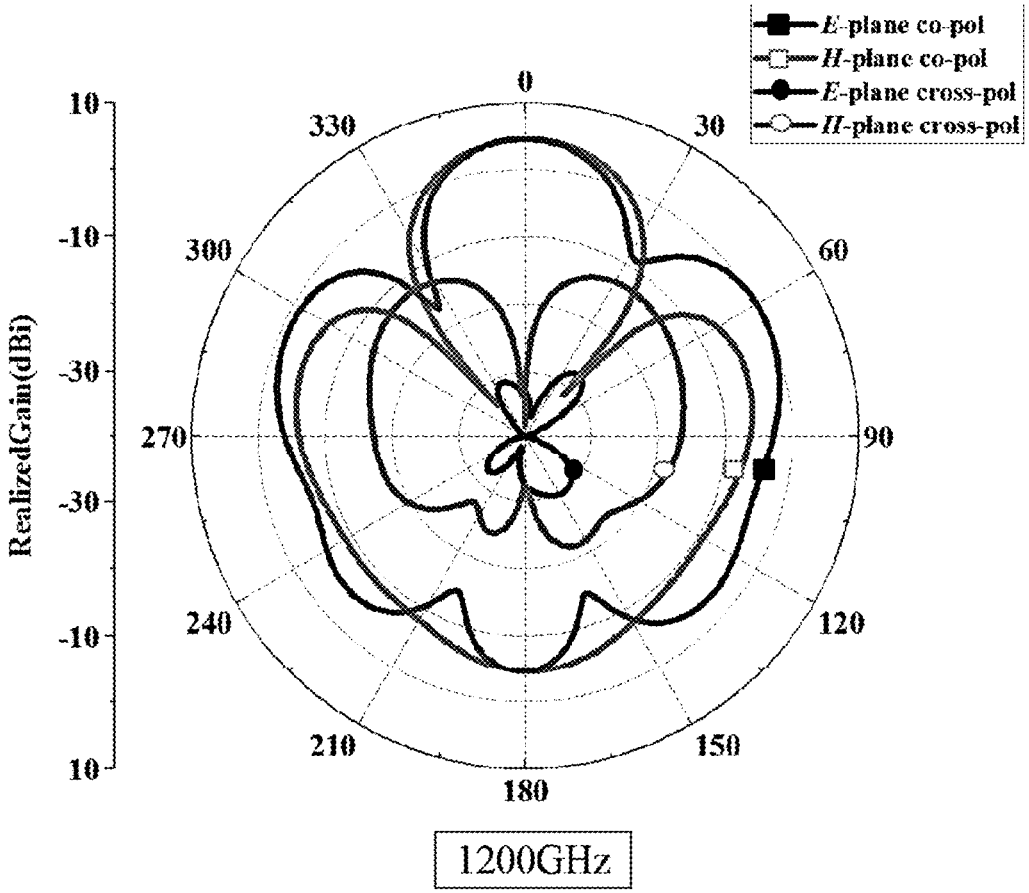
Figure 10H:
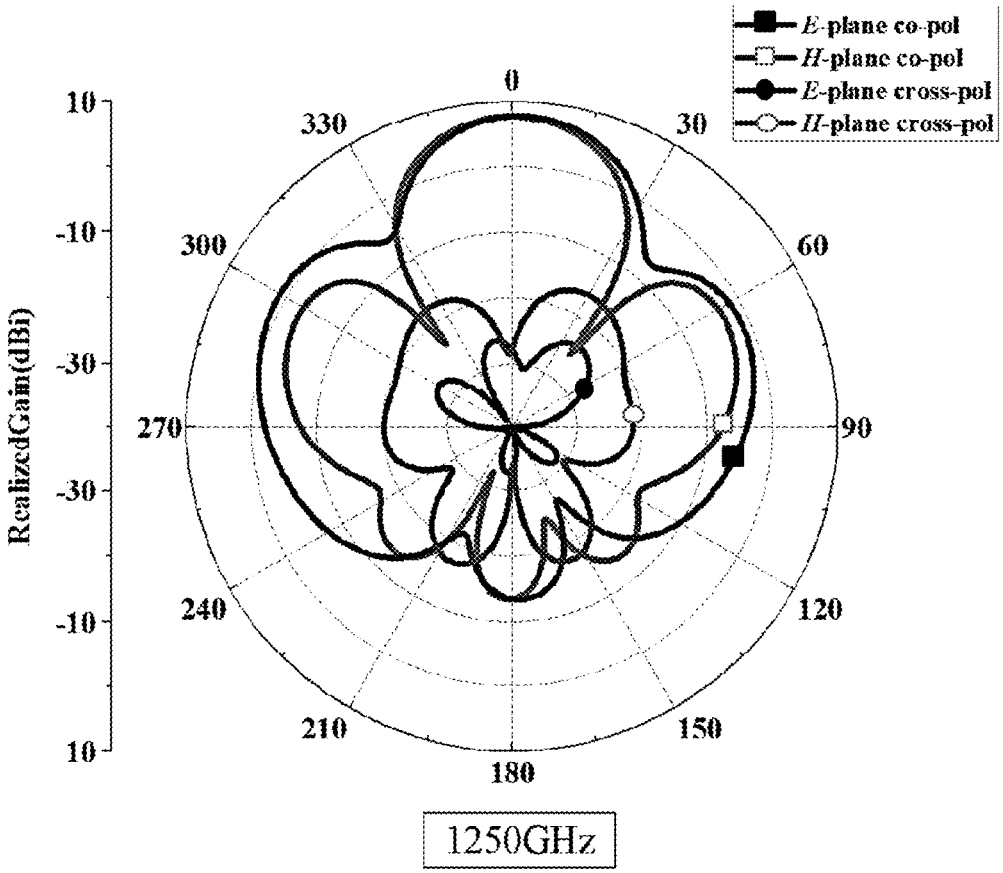
Figure 10I:
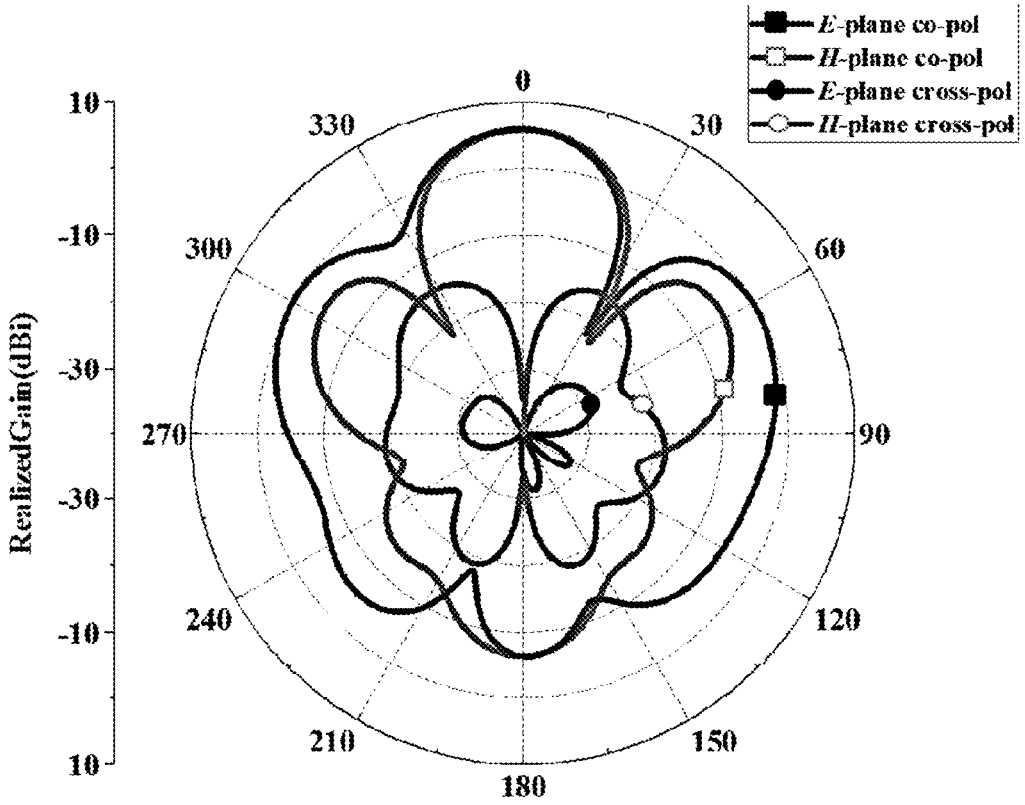

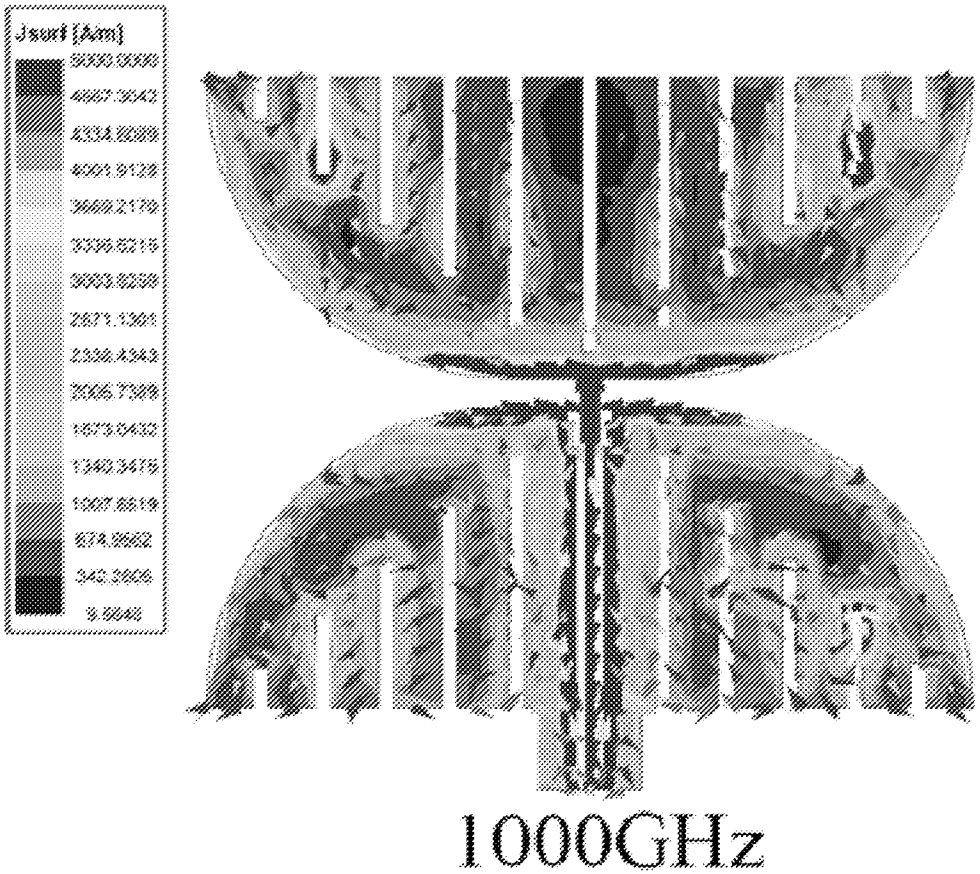
Figure 9g(ii)

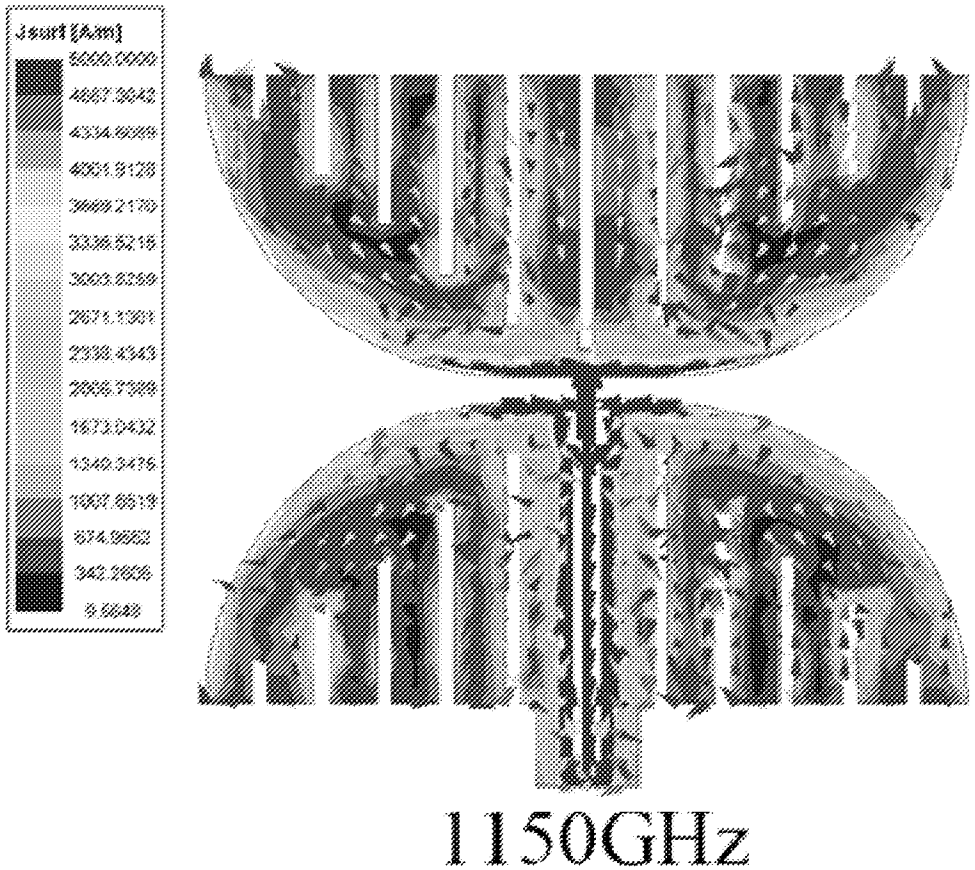
Figure 9g(iii)

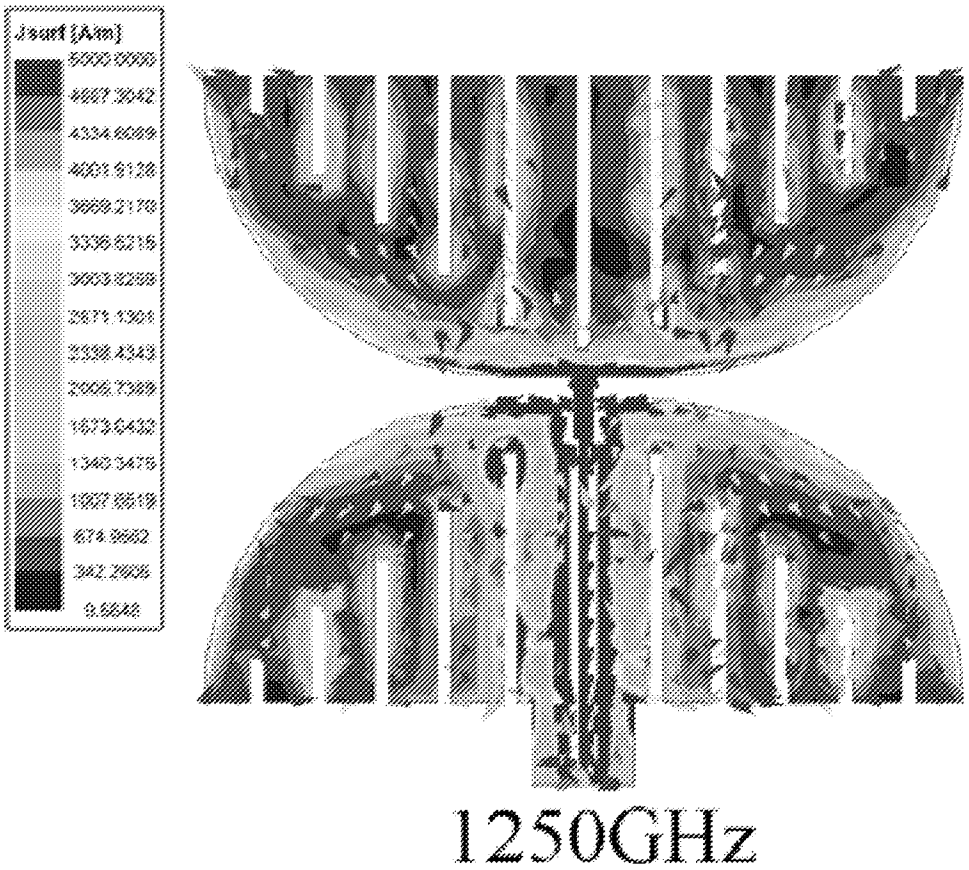
Figure 9g(iv)

ON-CHIP ANTENNA AND ON-CHIP ANTENNA ARRAY

BACKGROUND OF THE INVENTION

The present invention relates to an on-chip antenna. More particularly, but not exclusively, the present invention relates to an on-chip antenna comprising a substrate having first and second faces, a metal layer on the second face and a dipole antenna structure on the first face, wherein the on-chip antenna is configured to operate simultaneously in at least one dielectric resonator mode and at least one dipole mode to function as a cavity backed dipole antenna.

The present invention also relates to an on-chip antenna array. More particularly, but not exclusively the present invention relates to an on-chip antenna array comprising: a plurality of on-chip antennae arranged on a common base layer in an n*m array, each substrate being separated from an adjacent substrate by a separator that has a dielectric permittivity lower than that of the substrates.

The present invention also relates to an integrated circuit comprising: at least one of an on-chip antenna and/or an on chip antenna array.

The present invention also relates to a communications device comprising at least one of an on-chip antenna, an on-chip antenna array and an integrated circuit.

On-chip antennae are known. These have the advantage of overall system size reduction and lower cost. They also do not require matching networks. Further, there are no parasitic effects due to wire bonding. On-chip antenna however tend to have low gain and narrow bandwidth.

The present invention seeks to overcome the problems of the prior art.

STATEMENT OF INVENTION

Accordingly, in a first aspect, the present invention provides an on-chip antenna comprising an electrically insulating substrate having first and second faces; a metal layer arranged on the second face; and, a dipole antenna structure arranged on the first face, the dipole antenna structure comprising a dipole antenna and a feed structure connected to the dipole antenna; the on-chip antenna being configured such that when the feed structure is fed with an electrical signal it operates simultaneously in (i) at least one dielectric resonator mode to function as a dielectric resonance antenna, and (ii) at least one dipole mode to function as a cavity backed dipole antenna.

Prior art on-chip antennae suffer from narrow bandwidth and low antenna gain. However, the invention provides a possibility of mitigating these two problems, by the combination of a dipole mode and a dielectric resonator mode. Such an on-chip antenna provides a possibility of overall system size and cost reduction and, it provides a possibility of eliminating matching network and parasitic due to wire bonding when compared to off-chip antennae.

The on-chip antenna according to the invention overcomes these problems simultaneously by use of the dielectric resonator mode and the dipole mode.

Preferably the feed structure comprises a co-planar waveguide. Furthermore, it is also preferable that the coplanar waveguide and dipole antenna are coplanar.

Alternatively the coplanar waveguide and dipole antenna lie in different planes separated by a passivation layer.

Preferably the dipole antenna comprises at least one comb shaped dipole element, the comb shaped dipole element comprising a base and a plurality of substantially parallel fingers extending from the base. Advantageously, use of a comb-shaped dipole element provides a possibility of reducing the cross polarization level.

Preferably the length of the fingers increases towards the center of the base. Also, it is preferable that the base is curved.

Preferably the at least one comb shaped dipole element has a mirror symmetry about a symmetry axis in a plane parallel to the first face.

Preferably the dipole antenna further comprises two comb shaped dipole elements arranged back to back Preferably the dipole antenna has a mirror symmetry about first and second axes, the second symmetry axis being normal to the first.

Preferably the substrate comprises a silicon layer. Optionally, the substrate further comprises a silicon dioxide layer.

The high permittivity of a silicon substrate, the Si-air interface (or other interface between materials with high contrast of permittivity) is equivalent to a magnetic conducting surface. This provides the possibility that backscattering energy from the feeding source is restricted and resonates inside the silicon substrate.

Preferably the on-chip antenna further comprises a signal source connected to the feed structure and configured to provide a signal at wavelength $\lambda$ Preferably the thickness of the substrate is in the range $0.6\lambda$ to $0.8\lambda$. Furthermore, it is preferable that the distance between the dipole antenna and the edge of the substrate is in the range $0.6\lambda$ to $0.8\lambda$.

Preferably the substrate and dipole antenna structure are dimensioned for mm wave or THz operations.

Preferably the on-chip antenna further comprises at least one separator arranged in or around the substrate, the separator having a dielectric permittivity lower than that of the substrate.

Preferably the separator is an air gap.

In a further aspect of the invention there is provided an on-chip antenna array comprising:

a plurality of on-chip antennae, each on chip antenna comprising an electrically insulating substrate having first and second faces; a metal layer arranged on the second face; and, a dipole antenna structure arranged on the first face, the dipole antenna structure comprising a dipole antenna and a feed structure connected to the dipole antenna; the on-chip antenna being configured such that when the feed structure is fed with an electrical signal it operates simultaneously in (i) at least one dielectric resonator mode to function as a dielectric resonance antenna, and (ii) at least one dipole mode to function as a cavity backed dipole antenna; the antennae being arranged on a common base layer in an n*m array where n and m are positive integers; each substrate being separated from the adjacent substrate by a separator having a dielectric permittivity lower than that of the substrate.

Preferably the separator is an air gap.

In a further aspect of the invention there is provided an integrated circuit comprising at least one of an on-chip antenna and an on chip antenna array as described.

In a further aspect of the invention there is provided a communications device comprising at least one of an on chip antenna as described, an on chip antenna array as described and an integrated circuit as described.

DRAWINGS

Figure 1:
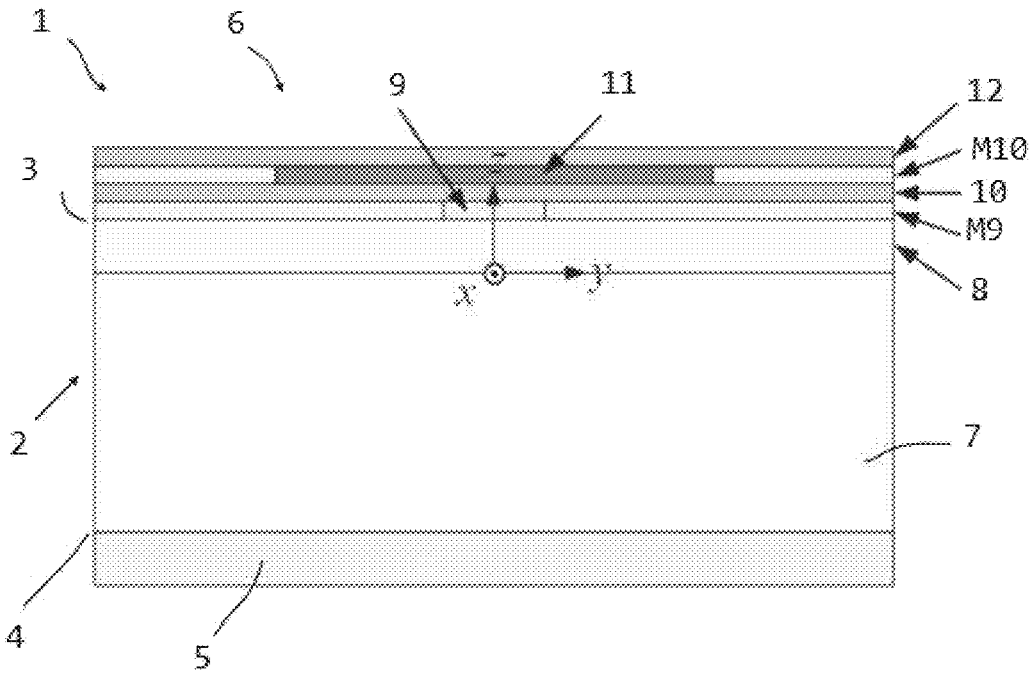
Figure 2A:
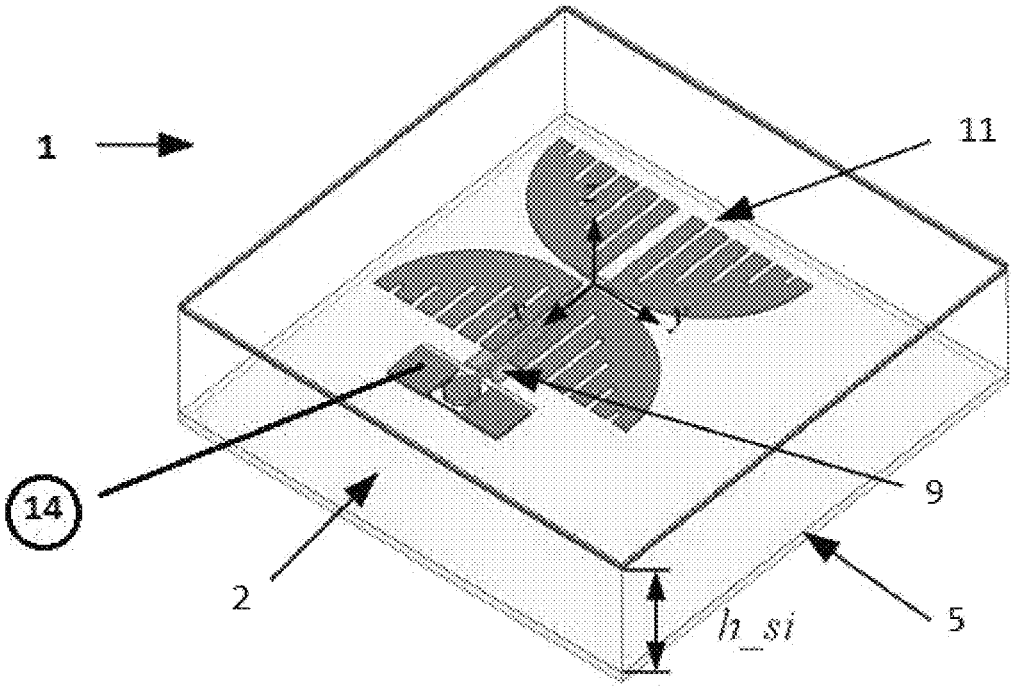
Figure 2B:
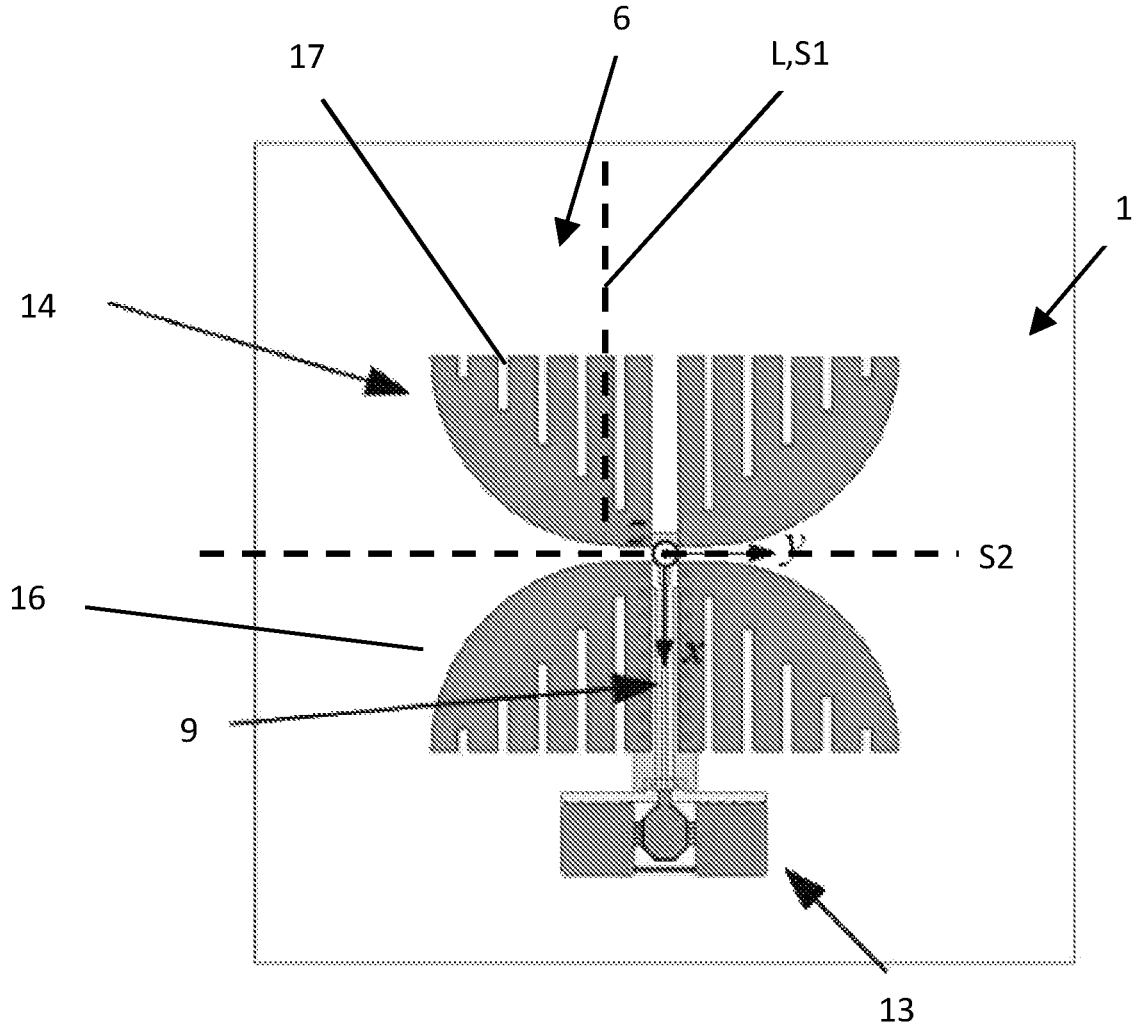
Figure 3A:
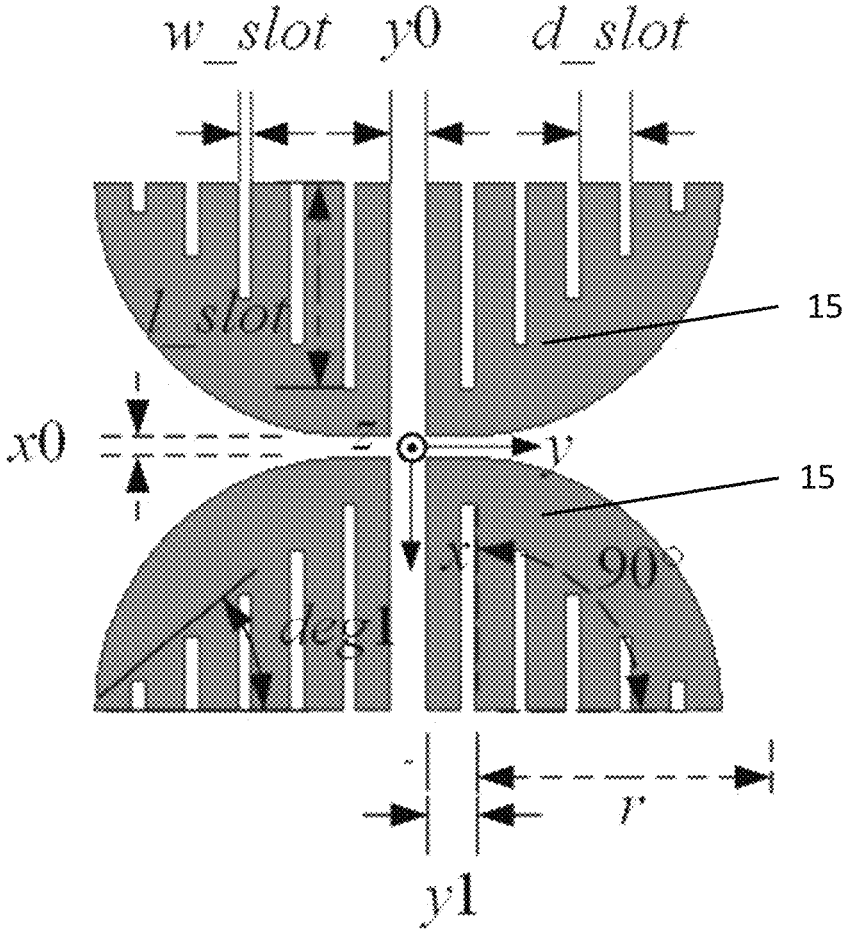
Figure 3B:
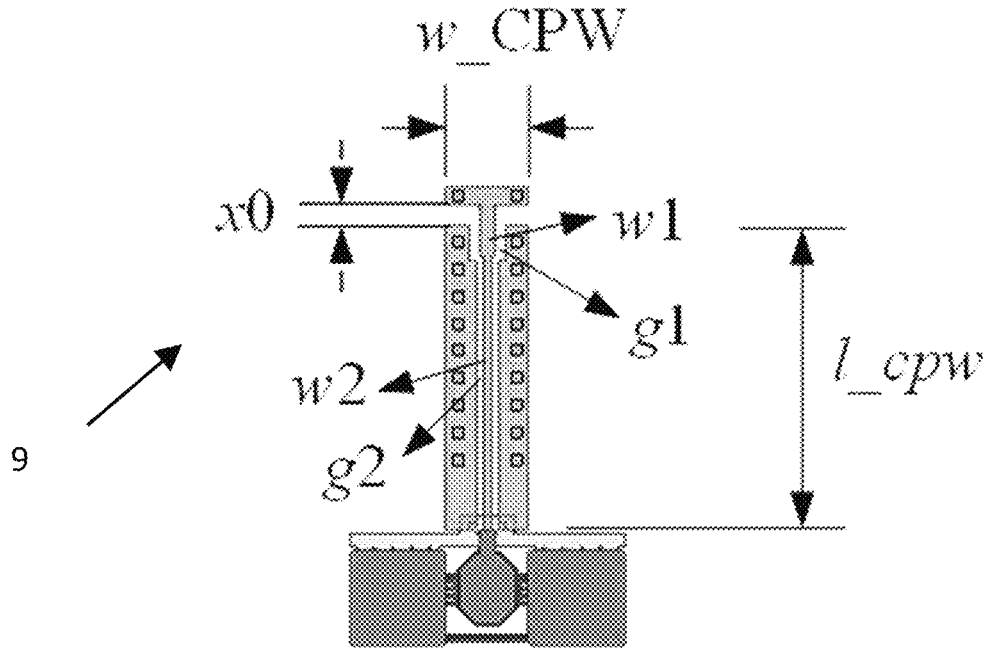
Figure 6A:
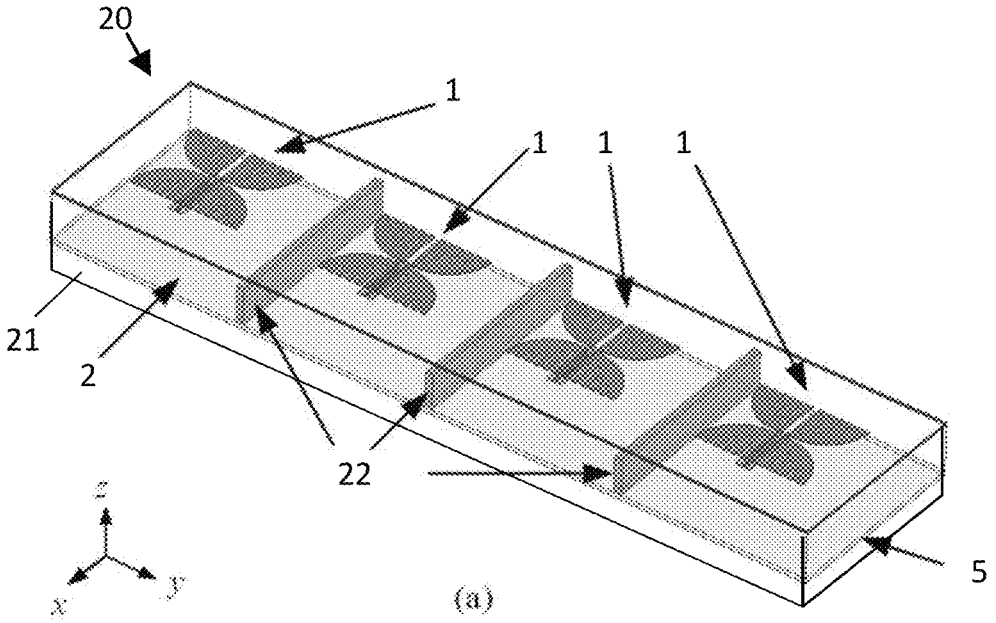
Figure 6B:
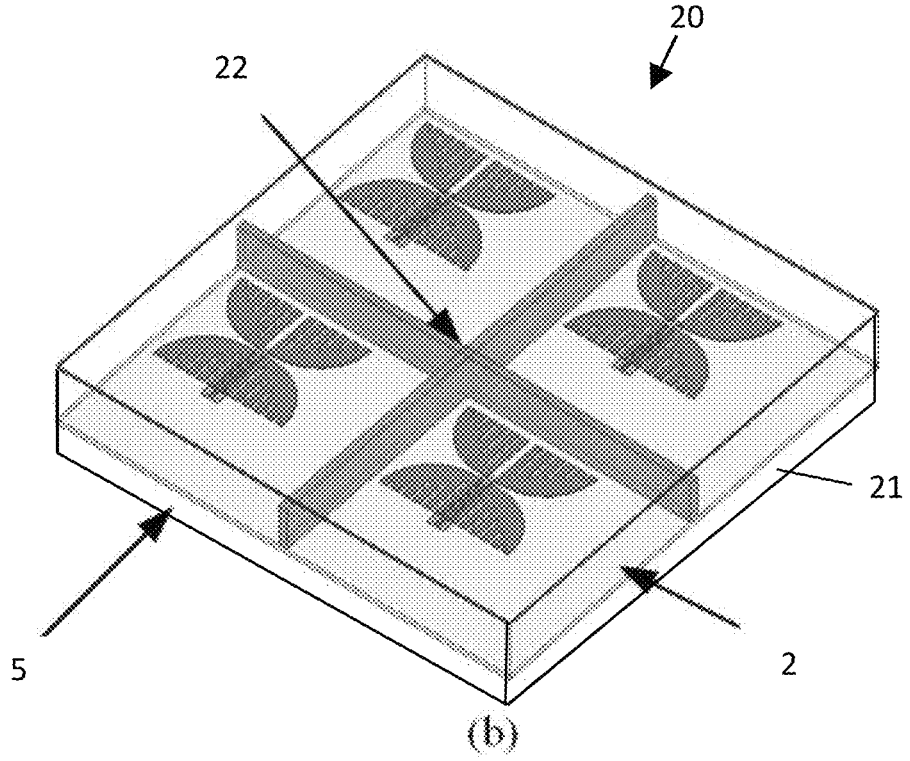
Figure 7A:
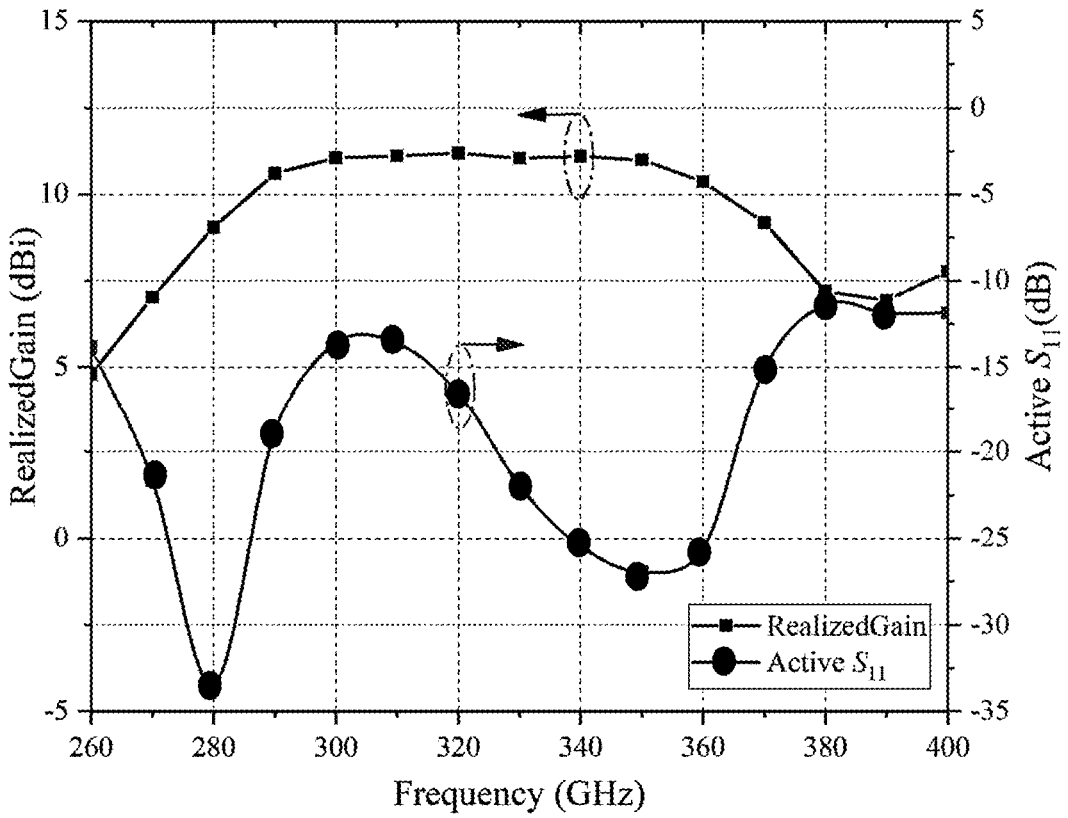
Figure 7B:
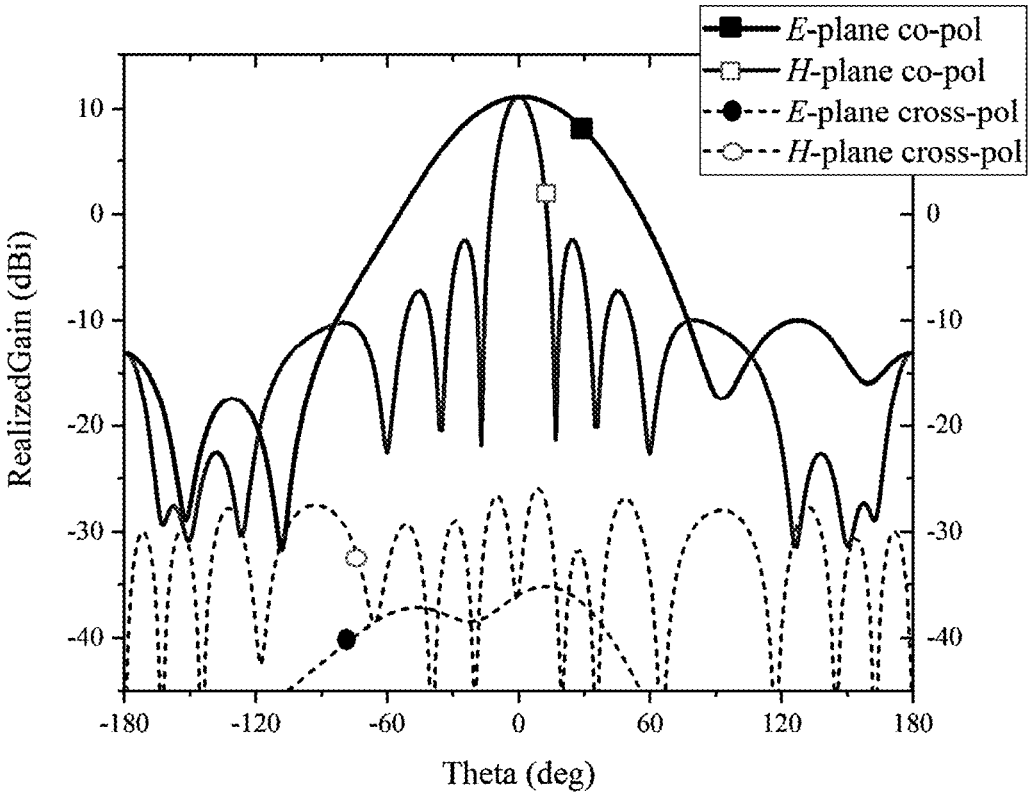
Figure 7C:
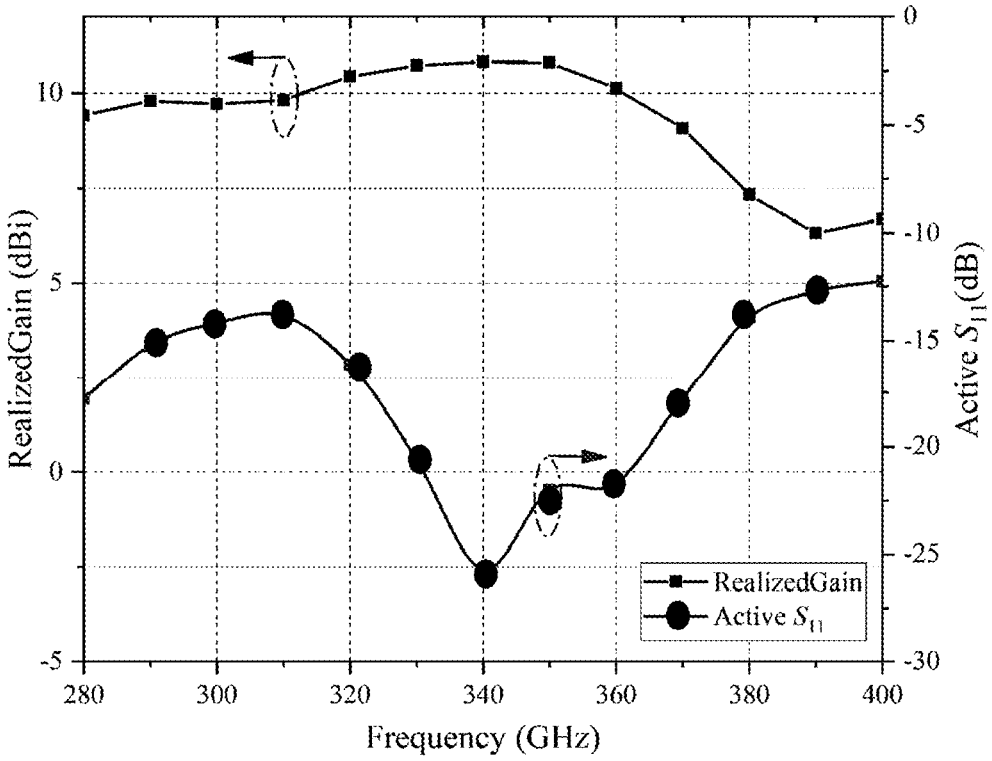
Figure 7D:
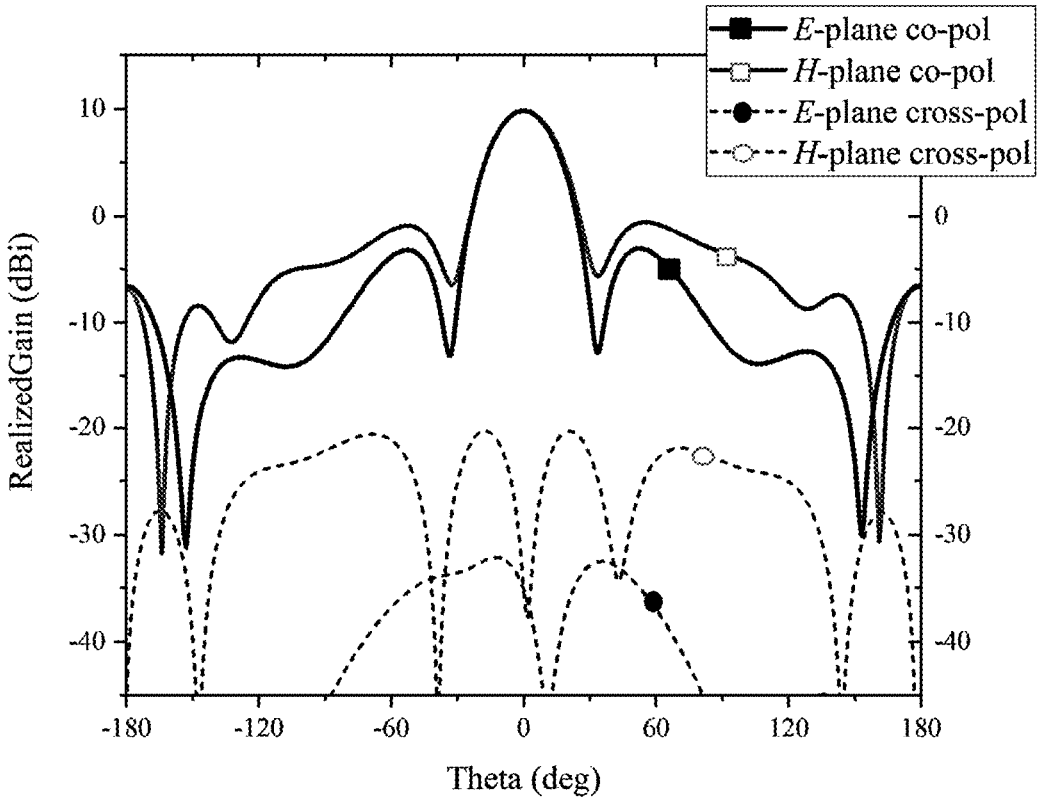
Figure 8A:
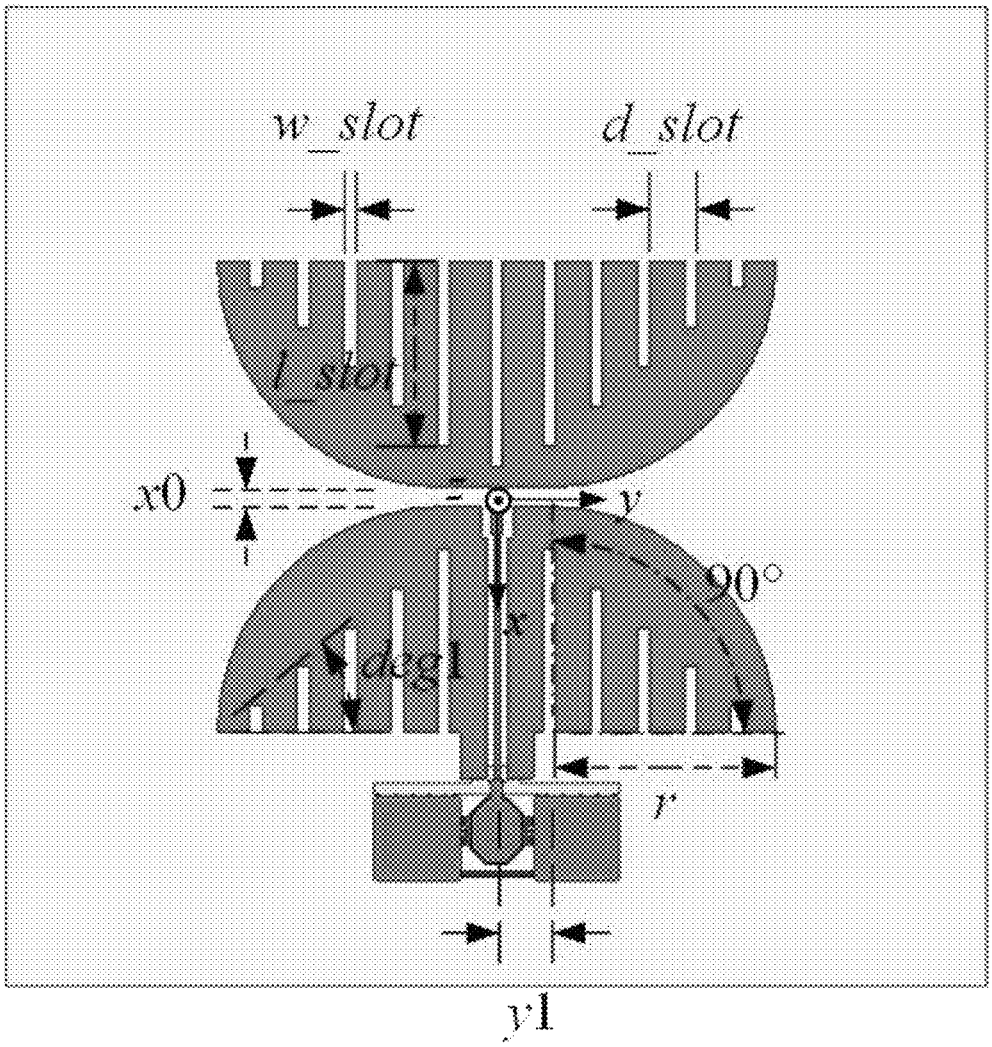
Figure 8B:
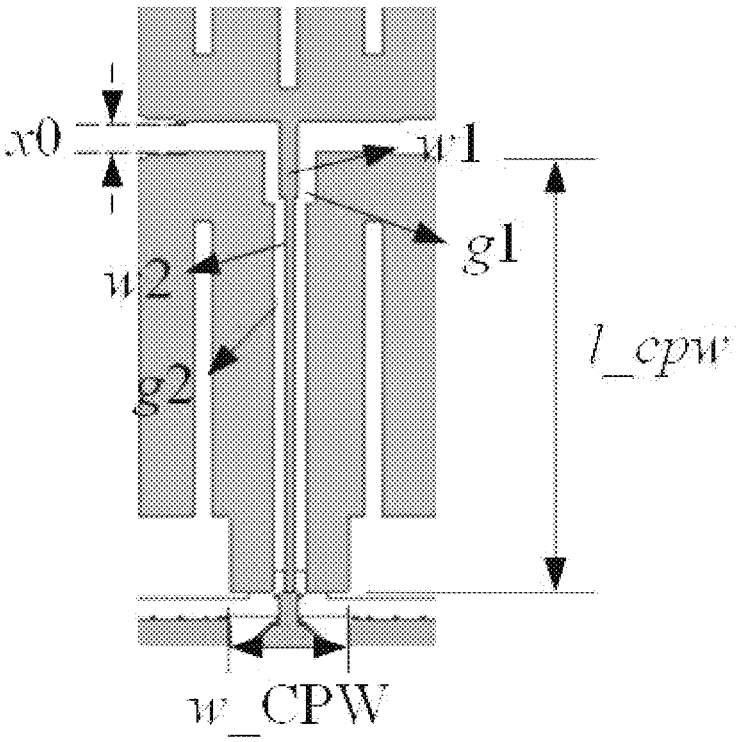

The present invention will now be described by way of example only and not in any limitative sense with reference to the accompanying drawings in which FIG. 1 shows a first embodiment of an on-chip antenna according to the invention in vertical cross section;

FIGS. 2(*a*) and 2(*b*) show the on-chip antenna of FIG. 1 in perspective view and plan view from above;

FIGS. 3(*a*) and 3(*b*) show the dipole antenna structure of an on-chip antenna according to the invention dimensioned to operate at 320 GHz;

FIGS. 4(*a*) to 4(*g*) show simulated properties of an on-chip antenna according to the invention adapted to operate at 320 GHz; in particular, FIGS. 4(*a*) to 4 (*g*) shows the simulated results of the 320 GHz on-chip antenna. (a) realised gain and S11 versus frequency; (b) input impedance Z11; (c) input admittance Y11; (d) magnitude of E-field distributions on xoy plane at z=−120 micron; (e) magnitude of E-field distributions on xoz plane; (f) magnitude of E-field distributions on yoz plane; and (g) current distributions on the dipole antenna and coplanar waveguide;

FIGS. 5(*a*) to 5(*f*) show simulated radiation patterns for the on-chip antenna of FIGS. 4(*a*) to 4(*g*);

FIGS. 6(*a*) and 6(*b*) show on-chip antenna arrays according to the invention in perspective view;

FIGS. 7(*a*) to 7(*d*) show simulated properties for the on-chip antenna arrays of FIGS. 6(*a*) and 6(*b*); in particular, FIG. 7(*d*) shows simulated results on the 320 GHz on chip antenna array. (a) Realised gain and S11 vs frequency for the on-chip antenna array of FIG. 6(*a*). (b) Radiation patterns at center frequency of the on-chip antenna array of FIG. 6(*a*). (c) Realised gain and S11 vs frequency for the on-chip antenna array of FIG. 6(*b*). (d) radiation patterns at center frequency of the on-chip antenna array of FIG. 6(*b*);

FIGS. 8(*a*) and 8(*b*) show the dipole antenna structure of an on-chip antenna according to the invention adapted to operate at 1.1 THz;

FIGS. 9(*a*) to 9(*g*) show various properties of the on-chip antenna according to FIGS. 8(*a*) and 8(*b*); Simulated results of the 1.1 THz on-chip antenna. (a) Realized gain and |S11| versus frequency; (b) input impedance Z11; (c) input admittance Y11; (d) magnitude of E-field distributions on xoy plane at z=−30 μm; (e) magnitude of E-field distributions on xoz plane; (f) magnitude of E-field distributions on yoz plane; and (g) current distributions on the comb-shaped dipole and the coplanar waveguide; and, FIGS. 10(*a*) to 10(*i*) show the radiation pattern of the on-chip antenna of FIGS. 8(*a*) and 8(*b*).

DESCRIPTION OF EMBODIMENTS

Shown in FIG. 1 is a first embodiment of an on-chip antenna 1 according to the invention in vertical cross section. The on-chip antenna 1 is a linearly polarised antenna 1 comprising a substrate 2 which in turn comprises first and second faces 3,4. Arranged on the second face 4 is a metal layer 5. Arranged on the first face 3 is a dipole antenna structure 6. The substrate 2 comprises a silicon layer 7 and a silicon dioxide layer 8 with the dipole antenna structure 6 arranged on the silicon dioxide layer 8 and the metal layer 5 arranged on the silicon layer 7.

The dipole antenna structure 6 comprises a feed structure 9, in this case a coplanar waveguide line 9, formed in a metal layer M9 on the silicon dioxide layer 8. Arranged on layer M9 is passivation layer 10. The dipole antenna structure 6 further comprises a dipole antenna 11 formed in a further metal layer M10 arranged on the passivation layer 10. Arranged on metal layer M10 is a further passivation layer 12. The dipole antenna 11 is connected to the coplanar waveguide line 9 by means of a via extending though the passivation layer 10.

Shown in FIGS. 2(*a*) and 2(*b*) is the on-chip antenna 1 of FIG. 1 in perspective view and plan view from above. In use the coplanar waveguide line 9 is typically connected to electronic circuitry such that the electronic circuitry and on-chip antenna 1 together form an integrated circuit. The integrated circuit is typically part of a communications device. For simplicity the coplanar waveguide line 9 is shown in FIGS. 2(*a*) and 2(*b*) connected to Ground-Signal-Ground (GSG) pads 13 which are used for testing purposes. When connected to a signal source 14 which provides an electrical signal at wavelength λ the substrate 2 is typically of thickness 0.6-0.8λ, more preferably 0.75λ. Similarly, the separation between the dipole antenna 11 and the edge of the substrate 2 is also around 0.6-0.8λ, more preferably 0.75λ.

The dipole antenna structure 6 is best shown in FIG. 2(*b*). The coplanar waveguide line 9 of the dipole antenna structure 6 extends along a length axis L. The dipole antenna 11 of the dipole antenna structure 6 comprises first and second dipole elements 15, each connected to the coplanar waveguide line 9. Each dipole element 15 is generally comb shaped comprising a curved base 16 and a plurality of spaced apart fingers 17 extending from the base 16. The fingers 17 extend in a direction generally parallel to the length axis L so as to substantially eliminate currents flowing in a direction orthogonal to the length axis L. This reduces cross polarisation. As can be seen, for each dipole element 15 the length of the fingers 17 increases in a direction towards the center of the base 16. Each dipole element 15 has mirror symmetry about a first symmetry axis $S_1$. The two comb shaped dipole elements 15 are arranged back to back such that the dipole antenna 11 has mirror symmetry about a second symmetry axis $S_2$ normal to the first symmetry axis $S_1$.

The geometrical parameters of a dipole antenna 11 and feed structure 9 of an on-chip antenna 1 according to the invention adapted to operate around 320 GHz are shown in FIGS. 3(*a*) and 3(*b*) and table I.

In use the on-chip antenna 1 according to the invention operates in the dielectric resonator mode in which it functions as a dielectric resonance antenna. In this mode the on-chip antenna 1 employs the silicon based substrate 2 as a dielectric resonator which has the dipole antenna 11 as its feeding source. Due to the high permittivity of the silicon based substrate 2 the substrate-air interface is equivalent to a magnetic conducting surface. The back scattering energy from the dipole antenna 11 is therefore restricted and resonates inside the silicon based substrate 2. By appropriate choice of dimensions of the silicon-based substrate 2 and the dipole antenna 11 the on-chip antenna 1 according to the invention can also simultaneously work in a dipole mode where it functions as a cavity backed dipole antenna. As the thickness of the substrate 2 is around 0.75λ the on-chip antenna 1 is optimally designed to work in this way.

The shape of the dipole antenna 11 and dimensions of the silicon based substrate 2 are chosen to excite multi-high-order dielectric resonances. Different dielectric resonances resonating at various adjacent frequencies together with the dipole mode excited by the cavity backed dipole antenna 11 itself lead to simultaneous wide bandwidth and relatively high gain.

As mentioned above, the dipole antenna 11 acts not only as a radiator but also as the feeding source to the substrate 2 which acts as a dielectric resonator. The metal layer 5 on the second face 4 of the substrate 2 functions as the reflector for the comb shaped dipole elements 15 and also as the ground for the resonating substrate 2 in the dielectric resonator mode.

In an alternative embodiment of the invention the coplanar waveguide line 9 and the dipole antenna 11 are coplanar, both being formed in the same metal layer M10.

FIG. 4(*a*) shows the simulated realised gain and $|S_{11}|$ versus frequency for the on-chip antenna according to the invention dimensioned to operate around 320 GHz of FIGS. 3(*a*) and 3(*b*) and table 1. Whilst $|S_{11}|<-10$ dB spans over the entire band from 260 to 400 GHz, the 3-dB gain bandwidth is 34% from 275 to 385 GHz with a peak gain of 6.2 dBi at 300 GHz. For a gain better than 5 dBi, a bandwidth of 25% from 285 to 370 GHz is achieved.

In order to further explain the radiation mechanism of the on-chip antenna 1 according to the invention simulated input impedance $Z_{11}$ and input admittance $Y_{11}$ are shown in FIGS. 4(*b*) and 4(*c*). As can be seen, there is one peak at around 320 GHz in the real $Y_{11}$ curve indicating the series resonance of the dipole mode. Four distinctive peaks can be seen at around 275, 290, 350 and 390 GHz in the real $Z_{11}$ curve indicating the parallel resonance of the dielectric resonator mode. Different series and parallel resonances in dielectric resonator mode and dipole mode at adjacent frequencies lead to simultaneous wide band and high gain. The magnitude of the electric field distributions on the xoy, xoz and yoz planes and the current distributions on the dipole antenna 11 at 275, 290, 320, 350 and 390 GHz are shown in FIGS. 4(*d*) to 4(*g*) respectively. Strong electric field confinements inside the silicon based substrate 2 and strong electric current densities along the edge of the dipole antenna 11 suggest the existence of dielectric resonances and a good coupling condition. Mixed resonances can also been seen in FIGS. 4(*d*) to 4(*f*).

FIGS. 5(*a*) to 5(*f*) show the simulated radiation patterns for the simulated on-chip antenna 1 of FIGS. 4(*a*) to 4(*g*). Radiation patterns from 280 GHz to 380 GHz at 20 GHz intervals are shown. In general the broadside radiation patterns are symmetrical and with low cross polarisation (better than −20 dB).

Shown in FIGS. 6(*a*) and 6(*b*) are embodiments of an on-chip antenna array 20 according to the invention. In each case the on-chip antenna array 20 comprises a plurality of on-chip antennae 1 as previously described arranged on a common base layer 21. The substrates 2 of adjacent antennae 1 are separated by a separator 22 having a dielectric permittivity less than of the substrates 2. In this embodiment the separators 22 are air gaps. In general, the antennae 1 are arranged in an n*m array with n and m being positive integers. In FIG. 6(*a*) the antennae 1 are arranged in a 1*4 array. In FIG. 6(*b*) the antennae 1 are arranged in a 2*2 array.

For the 1*4 antenna array 20 of FIG. 6(*a*), FIGS. 7(*a*) and 7(*b*) show the simulated peak gain is 11.2 dBi and the 3-dB gain bandwidth is 31% from 275 to 375 GHz. For gain better than 10 dBi a 24% bandwidth is achieved from 286 to 363 GHz. The first side lobe in the H plane is lower than −12 dB. For the 2*2 antenna array 20 of FIG. 6(*b*) simulated results shown in FIGS. 7(*c*) and 7(*d*) show that the peak gain 10 dBi and the 3-dB gain bandwidth is 34% from 268 to 377 GHz. Fora gain better than 10 dBi a 15.6% bandwidth is achieved from 312 to 362 GHz. The first side lobe in the H plane is lower than −10 dB.

The frequency of operation of the on-chip antenna 1 according to the invention depends upon the dimensions of the substrate 2 and the dipole antenna structure 6. In the above embodiments the on-chip antenna 1 is dimensioned to operate in the mm wave range. FIGS. 8(*a*) and 8(*b*) show the dipole antenna structure 6 of an on-chip antenna 1 according to the invention dimensioned to operate in the 1.1 THz range. The corresponding dimensions of the coplanar waveguide 9 and dipole antenna 11 of the dipole antenna structure 6 are shown in table II.

Simulated results for the 1.1 THz on-chip antenna 1 according to the invention are shown in FIGS. 9(*a*)-9(*g*) and 10(*a*)-10(*i*). As can be seen the 3 dB gain bandwidth for the on-chip antenna 1 is around 39% from 0.88 to 1.31 THz with a peak gain of 7.8 dBi at 1.21 THz. The cross polarisation level is better than −16 dB. From the input impedance $Z_{11}$ and input admittance $Y_{11}$ shown in FIGS. 9(*b*) and 9(*c*) five series resonances in dipole mode and six parallel resonances in dielectric resonator mode can be seen. That is, the skilled reader would appreciate that a dielectric resonator mode can comprise a plurality of resonances (i.e. sub-modes). This embodiment of the on-chip antenna 1 has a larger number of resonances than the on-chip antenna 1 adapted to operate around 320 GHz previously described which further expands the on-chip antenna bandwidth. The magnitude of the electric field distributions on the xoy, xoz and yoz planes, and current distributions on the dipole antenna 11 at 880, 1000, 1150 and 1250 GHz are shown in FIGS. 9(*d*) to 9(*g*). From the E field distribution different resonances in the dielectric resonator mode can be seen.

Embodiments of an on-chip antenna 1 and on-chip antenna array 20 operating at 320 GHz and 1.1 THz are described above using TSMC 65 nm CMOS technology. In alternative embodiments the on-chip antenna 1 and on-chip antenna array 20 can be arranged to operate at other frequencies or can be fabricated using other IC fabrication technologies.

While there has been described in the foregoing description preferred embodiments of the present invention, it will be understood by those skilled in the technology concerned that many variations or modifications in details of design, construction or operation may be made without departing from the scope of the present invention as claimed.

The invention claimed is:

1. An on-chip antenna comprising:

an electrically insulating substrate having first and second faces;

a metal layer arranged on the second face; and, a dipole antenna structure arranged on the first face, the dipole antenna structure comprising a dipole antenna and a feed structure connected to the dipole antenna;

the on-chip antenna being configured such that when the feed structure is fed with an electrical signal it operates simultaneously in (i) at least one dielectric resonator mode to function as a dielectric resonance antenna, and (ii) at least one dipole mode to function as a cavity backed dipole antenna.

2. An on-chip antenna as claimed in claim 1, wherein the feed structure comprises a co-planar waveguide.

3. An on-chip antenna as claimed in claim 2 wherein the coplanar waveguide and dipole antenna are coplanar.

4. An on-chip antenna as claimed in claim 2, wherein the coplanar waveguide and dipole antenna lie in different planes separated by a passivation layer.

5. An on-chip antenna as claimed in claim 1, wherein the dipole antenna comprises at least one comb shaped dipole element, the comb shaped dipole element comprising a base and a plurality of substantially parallel fingers extending from the base.

6. An on-chip antenna as claimed in claim 5, wherein the length of the fingers increases towards the center of the base.

7. An on-chip antenna as claimed in claim 5, wherein the base is curved.

8. An on-chip antenna as claimed in claim 5, wherein the comb shaped dipole element has a mirror symmetry about a symmetry axis in a plane parallel to the first face.

9. An on-chip antenna as claimed in claim 5, comprising two comb shaped dipole elements arranged back to back.

10. An on-chip antenna as claimed in claim 9, wherein the dipole antenna has a mirror symmetry about first and second symmetry axes, the second symmetry axis being normal to the first.

11. An on-chip antenna as claimed in claim 1, wherein the substrate comprises a silicon layer.

12. An on-chip antenna as claimed in claim 11, wherein the substrate further comprises a silicon dioxide layer.

13. An on-chip antenna as claimed in claim 1, further comprising a signal source connected to the feed structure and configured to provide a signal at wavelength λ.

14. An on-chip antenna as claimed in claim 13, wherein the thickness of the substrate is in the range 0.6λ to 0.8λ.

15. An on-chip antenna as claimed in claim 13, wherein the distance between the dipole antenna and the edge of the substrate is in the range 0.6λ to 0.8λ.

16. An on-chip antenna as claimed in claim 1, wherein the substrate and dipole antenna structure are dimensioned for mm wave or THz operations.

17. An on-chip antenna as claimed in claim 1 further comprising at least one separator arranged in or around the substrate, the separator having a dielectric permittivity lower than that of the substrate.

18. An on-chip antenna as claimed in claim 17, wherein the separator is an air gap.

19. An on-chip antenna array comprising:

a plurality of on-chip antennae, each on chip antenna comprising an electrically insulating substrate having first and second faces;

a metal layer arranged on the second face; and, a dipole antenna structure arranged on the first face, the dipole antenna structure comprising a dipole antenna and a feed structure connected to the dipole antenna;

the on-chip antenna being configured such that when the feed structure is fed with an electrical signal it operates simultaneously in (i) at least one dielectric resonator mode to function as a dielectric resonance antenna, and (ii) at least one dipole mode to function as a cavity backed dipole antenna the antennae being arranged on a common base layer in an n*m array where n and m are positive integers;

each substrate being separated from the adjacent substrate by a separator having a dielectric permittivity lower than that of the substrate.

20. An on-chip antenna array as claimed in claim 19 wherein the separator is an air gap.

* * * * *